US011099521B2

(12) United States Patent
Uneme et al.

(10) Patent No.: US 11,099,521 B2
(45) Date of Patent: Aug. 24, 2021

(54) CARTRIDGE, PROCESS CARTRIDGE AND ELECTROPHOTOGRAPHIC IMAGE FORMING APPARATUS

(71) Applicant: CANON KABUSHIKI KAISHA

(72) Inventors: Tetsushi Uneme, Kawasaki (JP); Masaaki Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/846,530

(22) Filed: Apr. 13, 2020

(65) Prior Publication Data

US 2020/0241467 A1 Jul. 30, 2020
US 2021/0200145 A9 Jul. 1, 2021

Related U.S. Application Data

(62) Division of application No. 16/360,147, filed on Mar. 21, 2019, now Pat. No. 10,678,185, which is a (Continued)

(30) Foreign Application Priority Data

Jun. 5, 2015 (JP) ..... 2015-115119
May 16, 2016 (JP) ..... 2016-098243

(51) Int. Cl.
*G03G 21/18* (2006.01)
*G03G 15/08* (2006.01)

(52) U.S. Cl.
CPC ..... *G03G 21/186* (2013.01); *G03G 15/0896* (2013.01); *G03G 21/1825* (2013.01)

(58) Field of Classification Search
CPC ..... G03G 21/186; G03G 21/1825; G03G 15/0896
See application file for complete search history.

(56) References Cited

U.S. PATENT DOCUMENTS 5,787,323 A 7/1998 Nomura et al.
5,884,124 A 3/1999 Karakama et al.
(Continued)

FOREIGN PATENT DOCUMENTS

CN 104541212 A 4/2015
EP 0 833 226 A2 4/1998
(Continued)

OTHER PUBLICATIONS

Mar. 13, 2020 Decision to Grant in Russian Patent Application No. 2017135258 (with English translation).
(Continued)

*Primary Examiner* — Sevan A Aydin
(74) *Attorney, Agent, or Firm* — Venable LLP

(57) ABSTRACT

A process cartridge detachably mountable to an electrophotographic image forming apparatus including a main assembly side drive transmission member and a main assembly side urging member, the cartridge including a rotatable photosensitive drum; a rotatable developing roller for developing a latent image formed on the drum, the developing roller contactable to and spaceable from the drum; an urging force receiving portion for receiving an urging force from the urging member to space the roller from the drum; a cartridge side drive transmission portion capable of coupling with the main assembly side drive transmission member to receive a rotational force for rotating the roller; a releasing member capable of urging the main assembly side drive transmission member to decouple the cartridge side drive transmission member from the main assembly side drive transmission member by the urging force receiving portion receiving the urging force from the main assembly side urging member.

12 Claims, 54 Drawing Sheets

Related U.S. Application Data division of application No. 15/565,749, filed as application No. PCT/JP2016/067298 on Jun. 3, 2016, now Pat. No. 10,254,712.

(56) References Cited

U.S. PATENT DOCUMENTS

| | | | |
|---|---|---|---|
| 6,029,027 | A | 2/2000 | Yokomori et al. |
| 6,163,665 | A | 12/2000 | Watanabe et al. |
| 8,275,286 | B2 | 9/2012 | Ueno et al. |
| 8,285,173 | B2 | 10/2012 | Hashimoto |
| 8,335,454 | B2 | 12/2012 | Chadani et al. |
| 2003/0086723 | A1 | 5/2003 | Yamaguchi et al. |
| 2003/0138270 | A1 | 7/2003 | Matsuoka |
| 2007/0160388 | A1 | 7/2007 | Yoshimura et al. |
| 2008/0260428 | A1 | 10/2008 | Ueno et al. |
| 2009/0003876 | A1 | 1/2009 | Maeshima et al. |
| 2009/0257779 | A1 | 10/2009 | Shimura et al. |
| 2010/0054823 | A1 | 3/2010 | Takasaka et al. |
| 2010/0272470 | A1 | 10/2010 | Tomatsu et al. |
| 2015/0093146 | A1 | 4/2015 | Sato et al. |
| 2019/0129356 | A1 | 5/2019 | Murakami et al. |

FOREIGN PATENT DOCUMENTS

| | | | |
|---|---|---|---|
| EP | 0 833 230 | A2 | 4/1998 |
| EP | 0 889 374 | A2 | 1/1999 |
| EP | 2 136 262 | | 12/2009 |
| EP | 2 157 486 | | 2/2010 |
| EP | 2 863 271 | A1 | 4/2015 |
| JP | H10-105025 | A | 4/1998 |
| JP | H11-73010 | A | 3/1999 |
| JP | H11-167335 | A | 6/1999 |
| JP | 2001-337511 | A | 12/2001 |
| JP | 2003-162137 | A | 6/2003 |
| JP | 2003-208024 | A | 7/2003 |
| JP | 2009-265628 | A | 11/2009 |
| JP | 2010-204384 | A | 9/2010 |
| JP | 2010-256766 | A | 11/2010 |
| JP | 2012-177840 | A | 9/2012 |
| JP | 2014-016610 | A | 1/2014 |
| JP | 2014-170141 | A | 9/2014 |
| TW | 2014-03270 | A | 1/2017 |

OTHER PUBLICATIONS

Written Opinion of the International Searching Authority and International Search Report in PCT/JP2013/073462.
Jan. 11, 2017 Office Action in Taiwanese Patent Application No. 105117743 (with English translation).
Examination Report in Australian Patent Application No. 2016273091, dated Mar. 1, 2018.
Notice of Acceptance in Australian Patent Application No. 201627391; dated Sep. 25, 2018.
Office Action in Canadian Patent Application No. 2,987,891; dated Sep. 5, 2018.
Apr. 1, 2019 Office Action in Russian Patent Application No. 2017135258 (with English translation).
English translation of May 1, 2019 Office Action in Korean Patent Application No. 10-2019-7003595.
Examination Report in Australian Patent Application No. 2018282485, dated Jul. 2, 2019.
Oct. 1, 2019 Chilean Patent Application No. 201703008 (with English translation).
Feb. 18, 2020 Notice of Acceptance in Australian Patent Application No. 2018282485.
Feb. 3, 2020 Office Action in Chinese Patent Application No. 201680033199.5 (with English translation).
Jan. 16, 2020 Office Action in Taiwanese Patent Application No. 107146336 (with English translation).
Jul. 28, 2020 Office Action in Brazilian Patent Application No. BR112017021391-5 (with English translation).
Oct. 19, 2020 Office Action in Indonesian Patent Application No. P00201709673.
Oct. 12, 2020 Office Action in Australian Patent Application No. 2020203200.
Oct. 6, 2020 Office Action in Indian Patent Application No. 201747045797.
Oct. 13, 2020 Decision to Grant in Russian Patent Application No. 2020116589 (with English translation).
Jul. 28, 2020 Office Action in Colombian Patent Application No. NC2017/0012456 (with English translation).
Apr. 14, 2021 Office Action in United Arab Emirates Patent Application No. P6001570.
Mar. 23, 2021 Notice of Allowance in Colombian Patent Application No. NC2017/0012456 (with English translation).
May 25, 2021 Decision to Grant in Russian Patent Application NO. 2020139498 (with English translation).
Jun. 28, 2021 Office Action in Canadian Patent Application No. 3,081,660.
Jul. 2, 2021 Notice of Allowance in Korean Patent Application No. 10-2020-7035435 (with English translation).

CARTRIDGE, PROCESS CARTRIDGE AND ELECTROPHOTOGRAPHIC IMAGE FORMING APPARATUS

TECHNICAL FIELD

The present invention relates to an electrophotographic image forming apparatus (image forming apparatus) and a cartridge detachably mountable to a main assembly of the image forming apparatus.

The image forming apparatus forms an image on a recording material using an electrophotographic image forming process. Examples of the image forming apparatus include an electrophotographic copying machine, an electrophotographic printer (laser beam printer, LED or printer, for example), a facsimile machine, a word processor and so on.

A cartridge is a unit detachably mountable to a main assembly of the image forming apparatus (main assembly). For example, the process cartridge may comprise an electrophotographic photosensitive drum and at least one of process means actable on the drum (developer carrying member (developing roller), for example) which are unified into a cartridge.

The cartridge may comprise the drum and the developing roller as a unit, or may comprise the drum, or may comprise the developing roller. A cartridge which comprises the drum is a drum cartridge, and the cartridge which comprises the developing roller is a developing cartridge.

The main assembly of the image forming apparatus is portions of the image forming apparatus other than the cartridge.

BACKGROUND ART

In a conventional image forming apparatus, a drum and process means actable on the drum are unified into a cartridge which is detachably mountable to a main assembly of the apparatus (cartridge type).

With such a cartridge type, maintenance operations for the image forming apparatus can be performed in effect by the user without relying on a service person, and therefore, the operationality can be remarkably improved. Therefore, the process cartridge type is widely used in the field of the image forming apparatus.

SUMMARY OF THE INVENTION

Technical Problem

A process cartridge (Japanese Laid-open Patent Application 2001-337511), for example) and an image forming apparatus (Japanese Laid-open Patent Application 2003-208024, for example) have been proposed, in which a clutch is provided to effect switching to drive the developing roller during an image forming operation and to shut off the drive of the developing roller during a non-image-formation.

It is an object of the present invention to improve a structure for switching the drive transmission to the developing roller.

Solution to Problem

According to an aspect of the present invention, there is provided a process cartridge detachably mountable to a main assembly of the electrophotographic image forming apparatus including a main assembly side drive transmission member and a main assembly side urging member, said process cartridge comprising (i) a rotatable photosensitive member; (ii) a rotatable developing roller configured to develop a latent image formed on said photosensitive member, said developing roller being capable of contacting to and the spacing from said photosensitive member; (iii) an urging force receiving portion configured to receive an urging force from the main assembly side urging member to space said developing roller from said photosensitive member; (iv) a cartridge side drive transmission member capable of coupling with the main assembly side drive transmission member to receive a rotational force for rotating said developing roller; (v) a releasing member capable of urging the main assembly side drive transmission member to decouple said cartridge side drive transmission member from the main assembly side drive transmission member by said urging force receiving portion receiving the urging force from the main assembly side urging member.

According to another aspect of the present invention, there is provided a process cartridge for electrophotographic image formation, comprising (i) a rotatable photosensitive member; (ii) a rotatable developing roller configured to develop a latent image formed on said photosensitive member, said developing roller being capable of contacting to and the spacing from said photosensitive member; (iii) an urging force receiving portion configured to receive an urging force for spacing said developing roller from said photosensitive member; (iv) a rotational force receiving portion configured to receive a rotational force for rotating said developing roller from an outside of said process cartridge; and (v) a movable member movable relative to rotational force receiving portion at least in a longitudinal direction of said developing roller, said movable member being movable outwardly in the longitudinal direction by said urging force receiving portion receiving the urging force.

According to a further aspect of the present invention, there is provided a process cartridge detachably mountable to a main assembly of the electrophotographic image forming apparatus including a main assembly side drive transmission member, said process cartridge comprising: (i) a photosensitive member; (ii) a photosensitive member frame rotatably supporting said photosensitive member; (iii) a developing roller configured to develop a latent image formed on said photosensitive member; (iv) a developing device frame rotatably supporting said developing roller, said developing device frame being movable relative to said photosensitive member frame; (v) a cartridge side drive transmission member capable of coupling with the main assembly side drive transmission member to receive a rotational force for rotating said developing roller; and (vi) a releasing member capable of urging the main assembly side drive transmission member to decouple said cartridge side drive transmission member from the main assembly side drive transmission member by movement of said developing device frame relative to said photosensitive member frame.

According to a further aspect of the present invention, there is provided a process cartridge for electrophotographic image formation, comprising: (i) a photosensitive member; (ii) a photosensitive member frame rotatably supporting said photosensitive member; (iii) a developing roller configured to develop a latent image formed on said photosensitive member; (iv) a developing device frame rotatably supporting said developing roller, said developing device frame being movable relative to said photosensitive member frame; (v) a rotational force receiving portion configured to receive a rotational force for rotating said developing roller from a outside of said process cartridge; and (vi) a movable member movable relative to said rotational force receiving portion at least in a longitudinal direction of said developing roller, said movable member being movable outwardly in the longitudinal direction by such movement of said developing device frame that said developing roller is away from said photosensitive member.

According to a further aspect of the present invention, there is provided a cartridge detachably mountable to a main assembly of the electrophotographic image forming apparatus including a main assembly side drive transmission member and a main assembly side urging member, comprising: (i) a rotatable developing roller configured to develop a latent image formed on said photosensitive member; (ii) an urging force receiving portion configured to receive the urging force from the main assembly side urging member; (iii) a cartridge side drive transmission member capable of coupling with the main assembly side drive transmission member to receive a rotational force for rotating said developing roller; (iv) a releasing member capable of urging the main assembly side drive transmission member to decouple said cartridge side drive transmission member from the main assembly side drive transmission member by said urging force receiving portion receiving the urging force from the main assembly side urging member.

According to a further aspect of the present invention, there is provided a cartridge for electrophotographic image formation, comprising: (i) a rotatable developing roller configured to develop a latent image formed on a photosensitive member; (ii) a rotational force receiving portion configured to receive a rotational force for rotating said developing roller, from an outside of said cartridge; (iii) an urging force receiving portion configured to receive an urging force from an outside of said cartridge; and (iv) a movable member movable relative to rotational force receiving portion at least in a longitudinal direction of said developing roller, said movable member being movable outwardly in the longitudinal direction by said urging force receiving portion receiving the urging force.

Advantageous Effects of the Invention

According to the present invention, the switching of the drive for the developing roller can be effected between the cartridge and the main assembly of the image forming apparatus.

These and other objects, features and advantages of the present invention will become more apparent upon a consideration of the following Description of the embodiments of the present invention taken in conjunction with the accompanying drawings.

Figure 7:
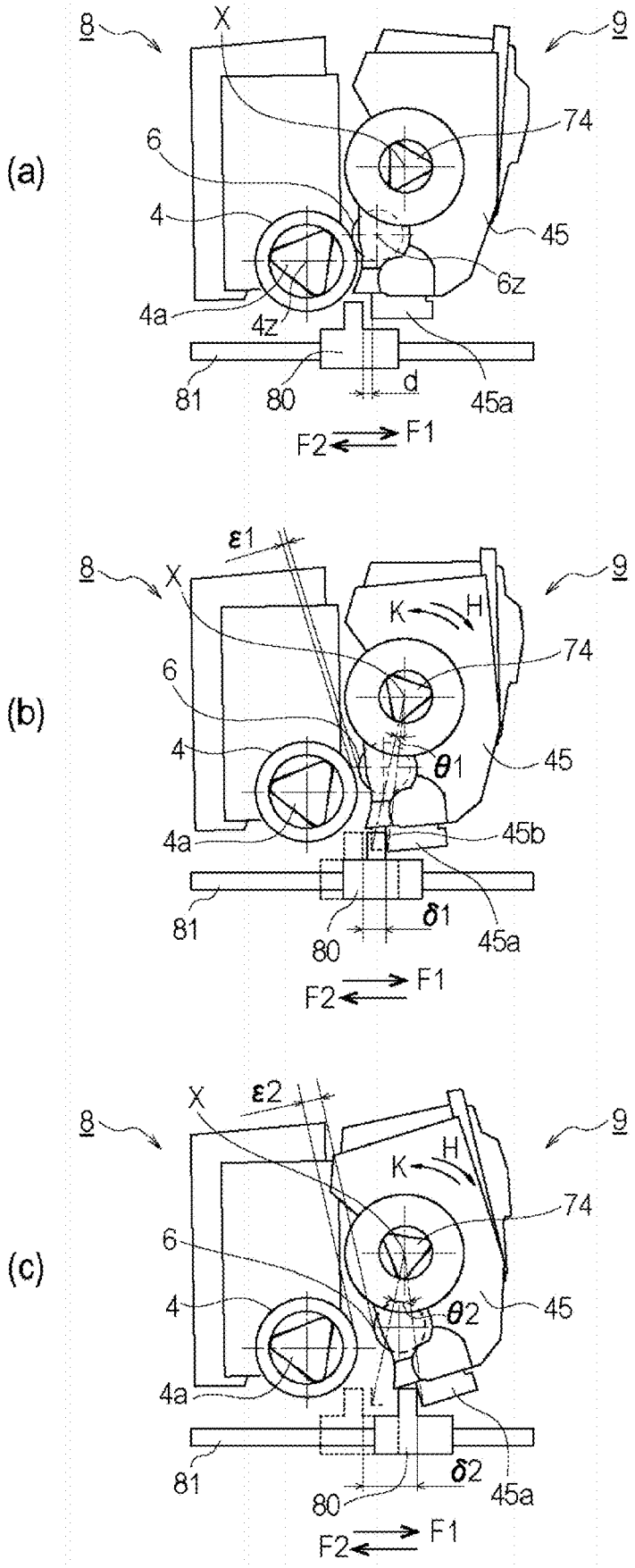

Parts (a), (b) and (c) of FIG. 7 are side views of the process cartridge according to the first embodiment, in which part (a) shows a state in which a developing roller is in contact with a drum, part (b) shows a state in which an urging force receiving portion has moved through a distance $\delta 1$, and part (c) shows a state in which the urging force receiving portion has moved through a distance $\delta 2$.

Figure 8:
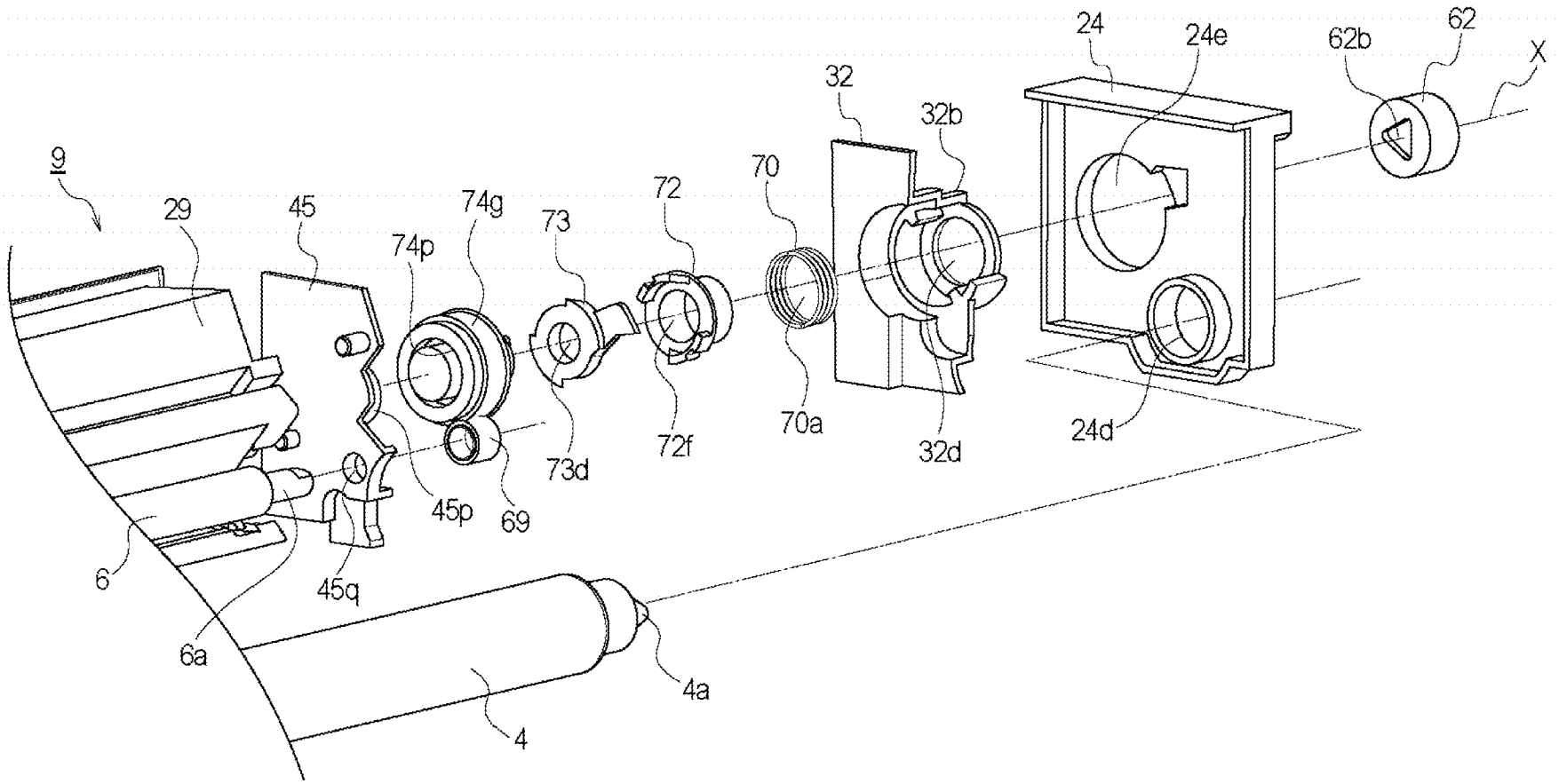

FIG. 8 is an exploded perspective view of a structure of and adjacent to the drive connecting portion of the process cartridge according to the first embodiment, as seen from the non-driving side.

Figure 9:
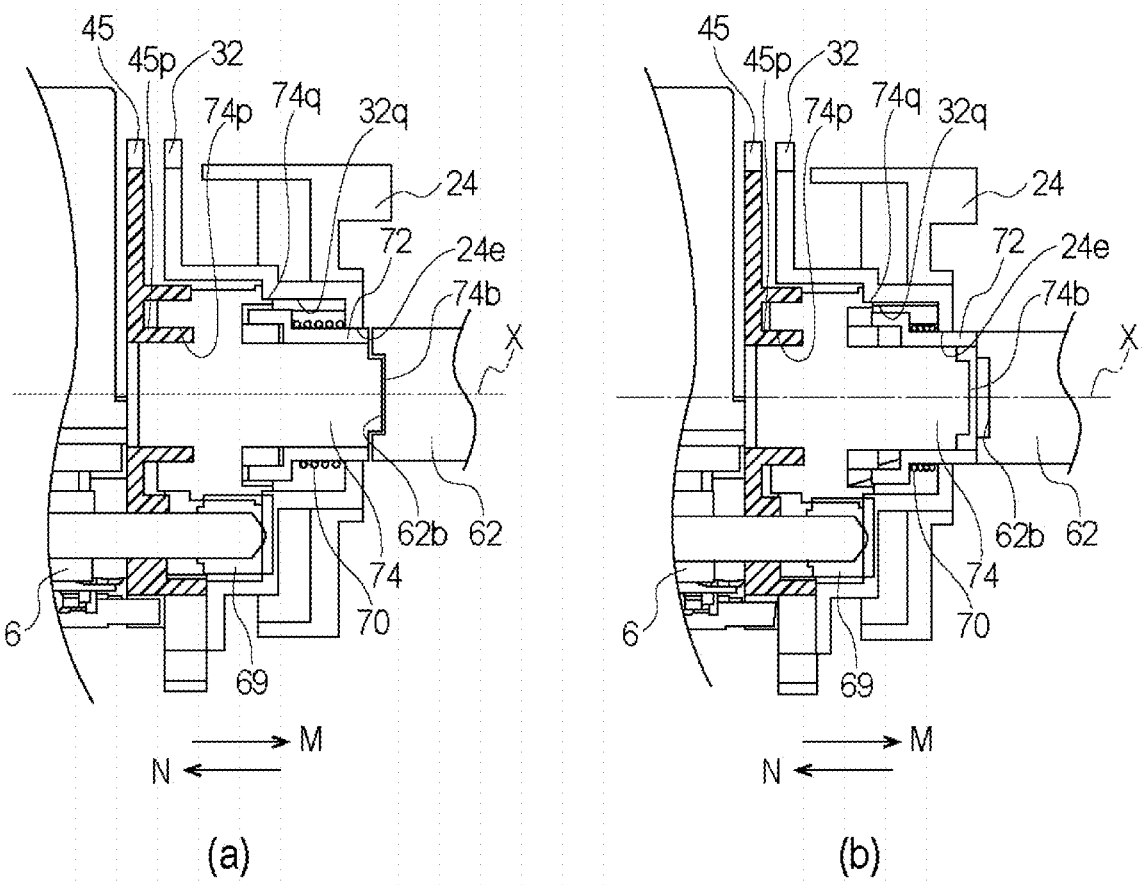

Parts (a) and (b) of FIG. 9 are schematic sectional views of and adjacent a cartridge drive transmission member according to the first embodiment, in which part (a) shows a drive transmission state, and part (b) shows a drive disconnection state.

Figure 10:
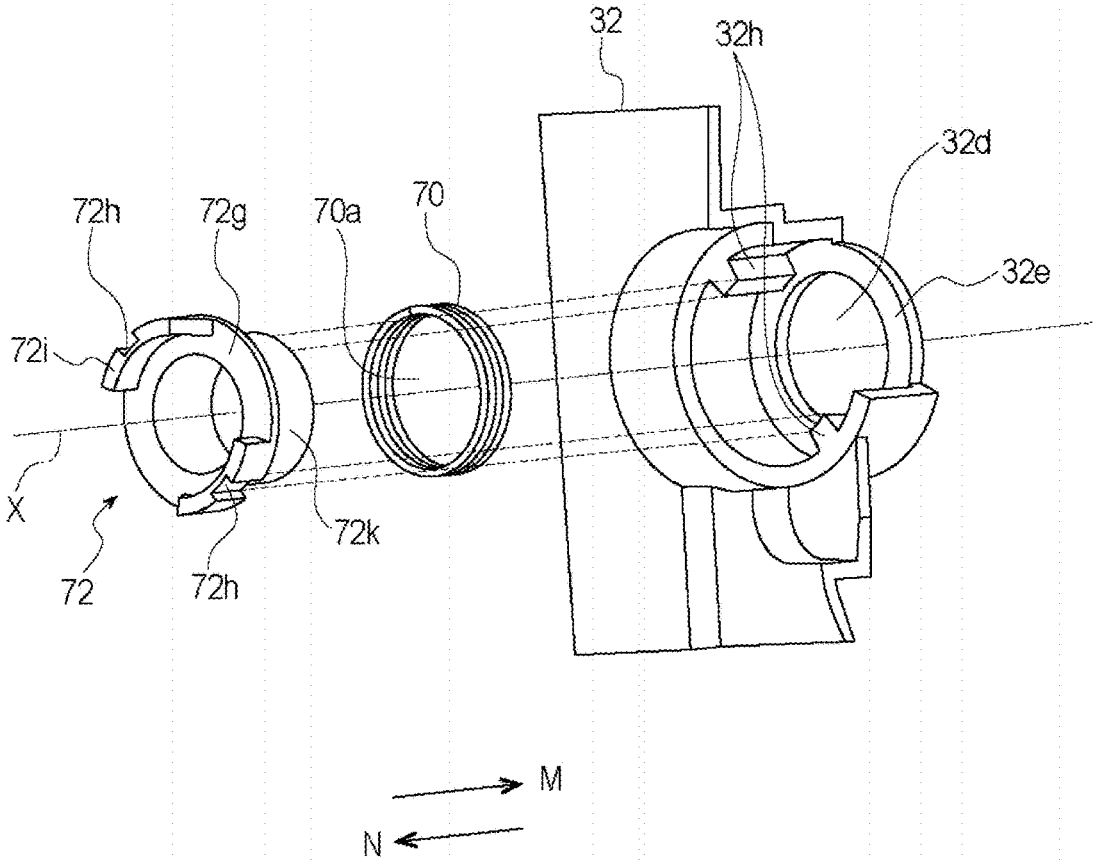

FIG. 10 is schematic exploded views of a release cam, a spring and the developing device covering member.

Figure 11:
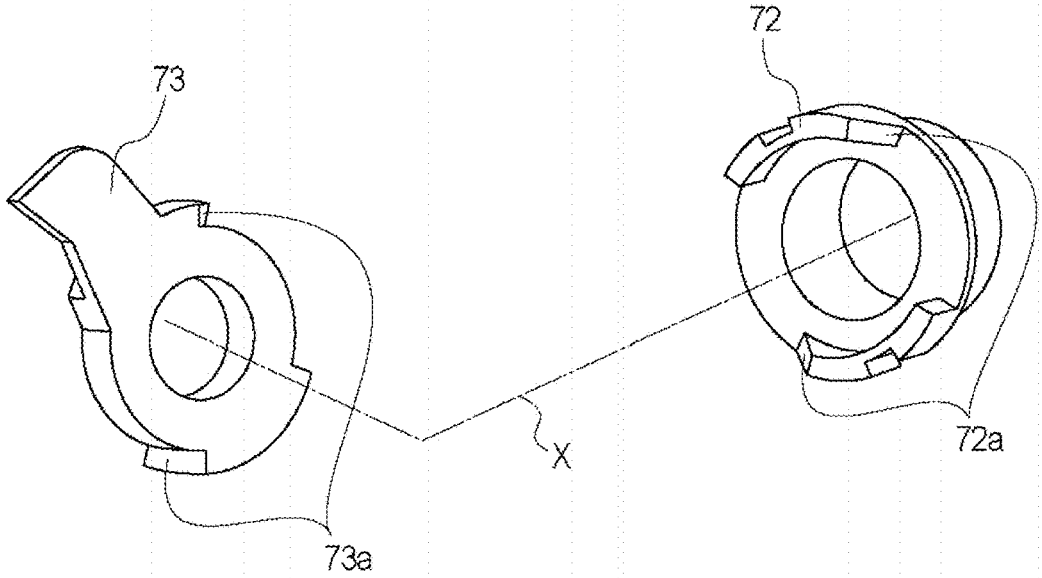

FIG. 11 is schematic exploded views of the release cam and the release lever in the first embodiment.

Figure 12:
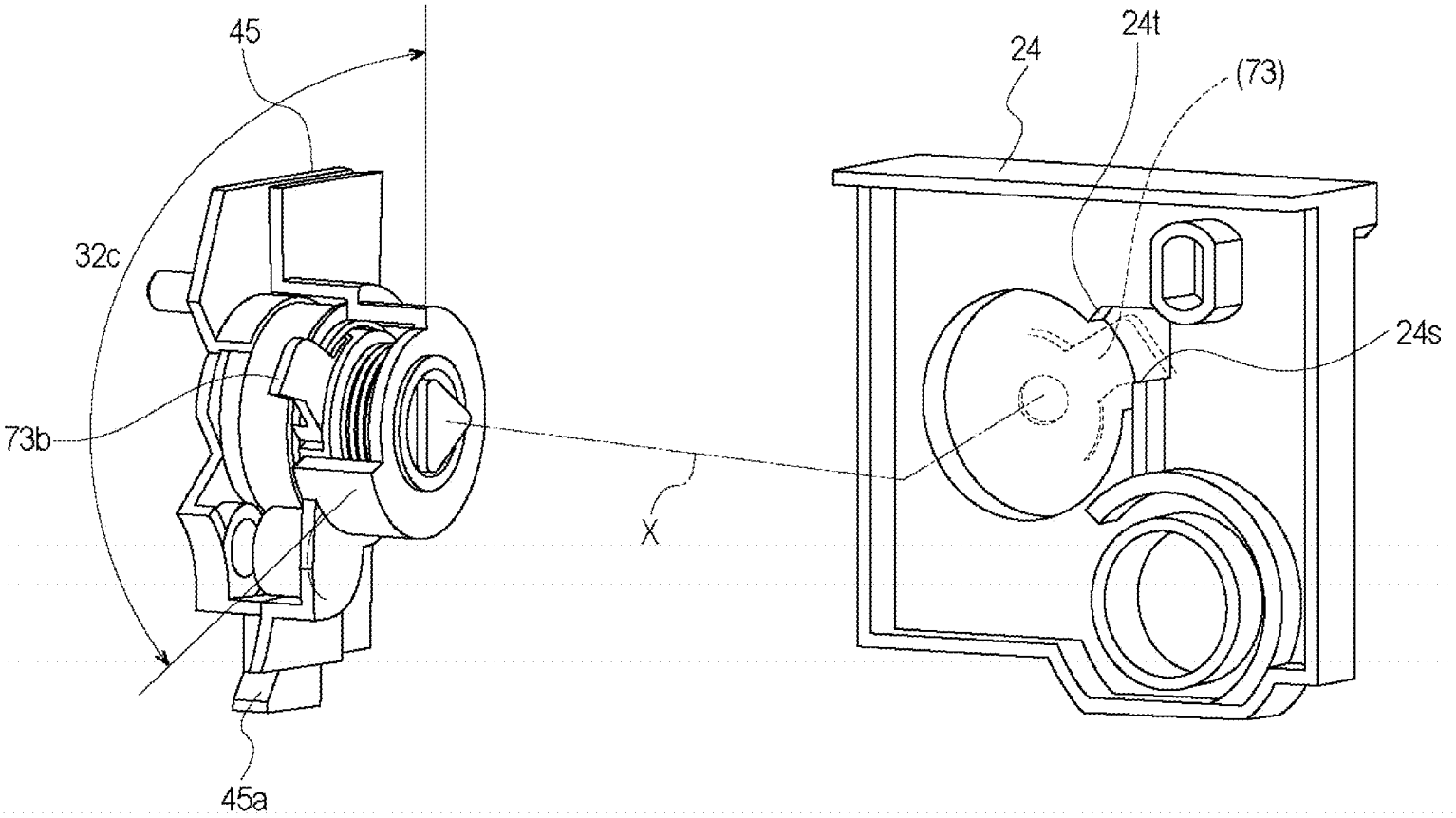

FIG. 12 is a schematic view of the cartridge side drive transmission member and releasing member, a peripheral parts thereof, and a driving side cartridge cover member, in the first embodiment.

Figure 13:
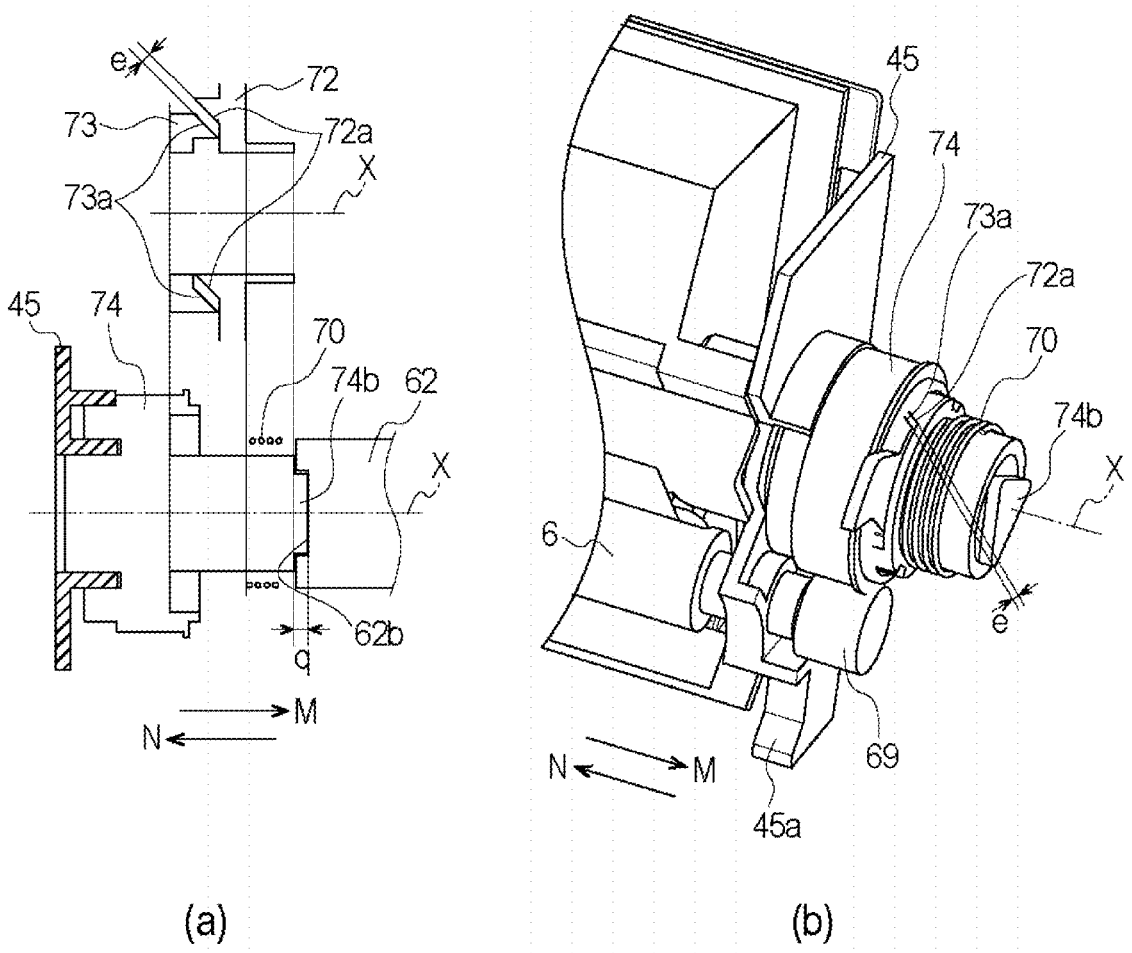

Parts (a) and (b) of FIG. 13 are schematic views of and adjacent the cartridge side drive transmission member in the contact and drive transmission state in the first embodiment, in which (a) is a schematic sectional view of the drive connecting portion, and) is a perspective view of the drive connecting portion.

Figure 14:
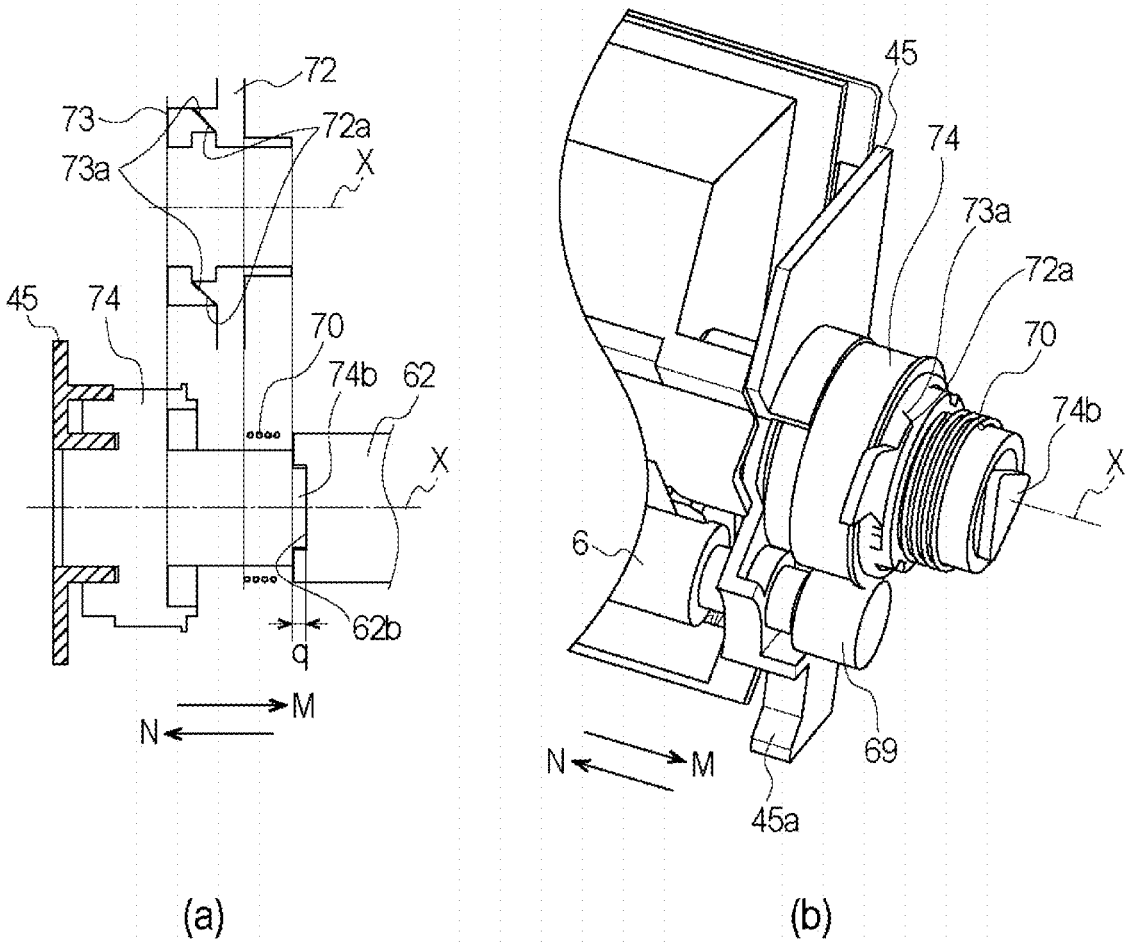

Parts (a) and (b) of FIG. 14 are schematic views of and adjacent the cartridge side drive transmission member in the developing device separation and drive transmission state in the first embodiment, in which (a) is a schematic sectional view of the drive connecting portion, and (b) is a perspective view of the drive connecting portion.

Figure 15:
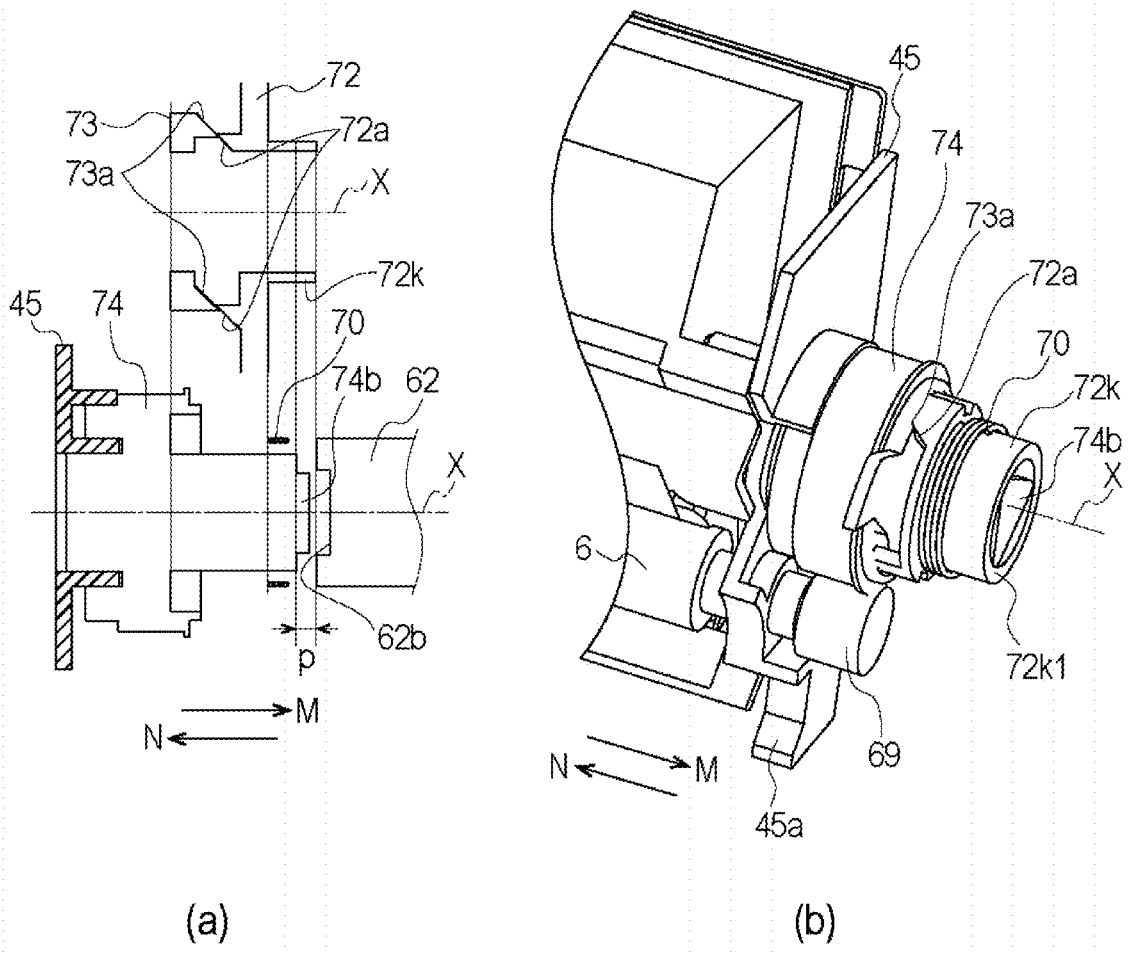

Parts (a) and (b) of FIG. 15 are schematic views of and adjacent the cartridge side drive transmission member in the developing device separation and drive disconnection state in the first embodiment, in which (a) is a schematic sectional view of the drive connecting portion, and (b) is a perspective view of the drive connecting portion.

Figure 16:
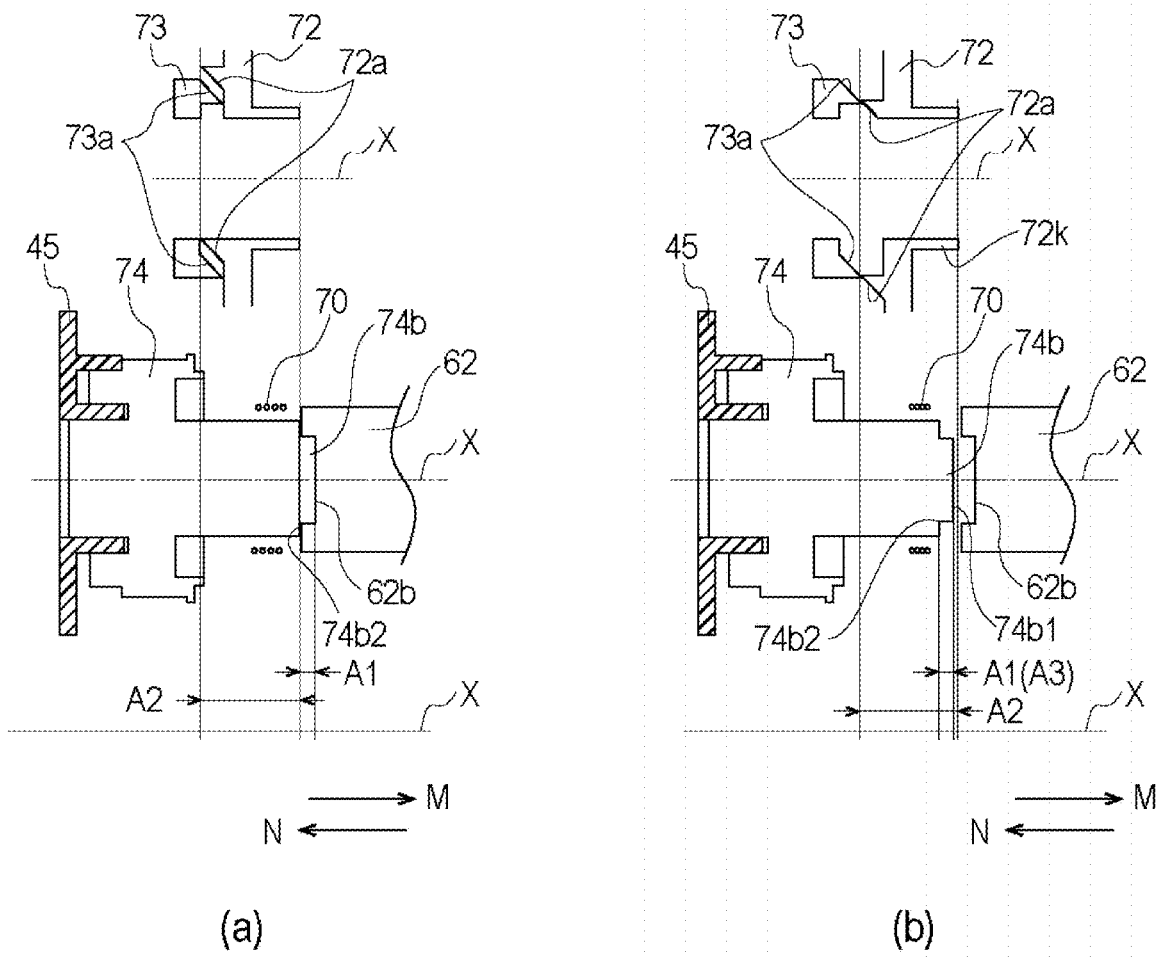

Parts (a) and (b) of FIG. 16 are schematic sectional views of the drive connecting portion, in which (a) shows the drive transmission, and (b) shows the drive disconnection.

Figure 17:
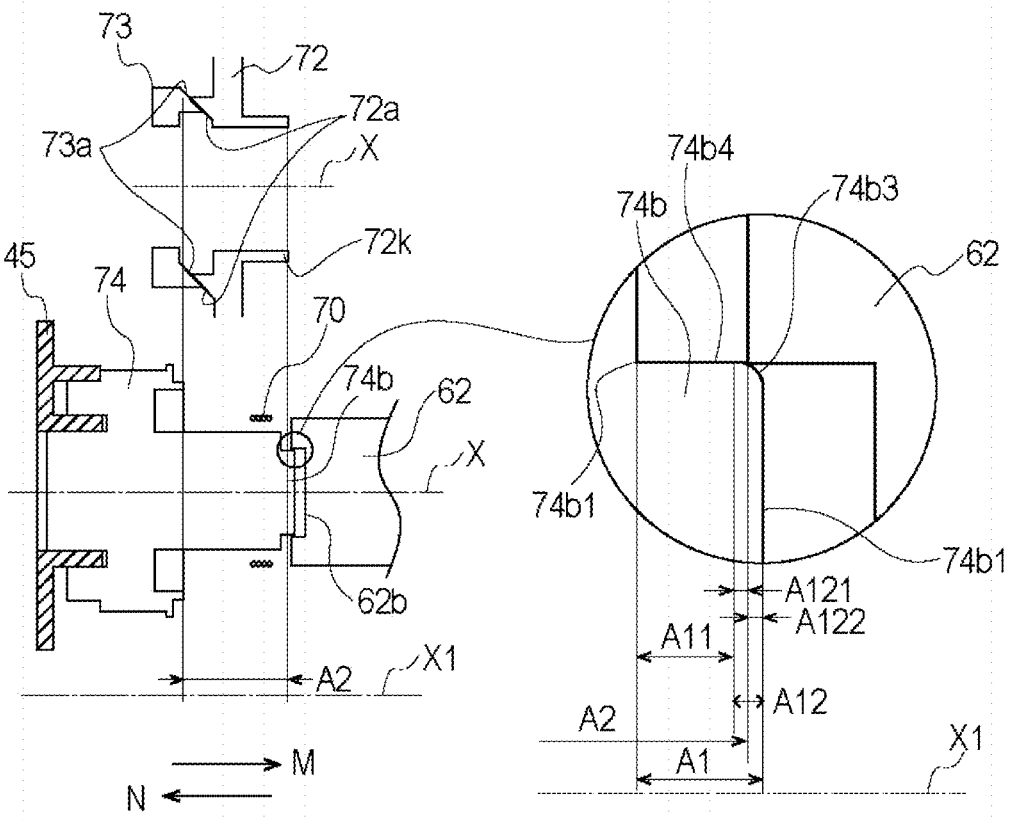

FIG. 17 is a schematic sectional view of the drive connecting portion according to a modified example of the first embodiment.

Figure 18:
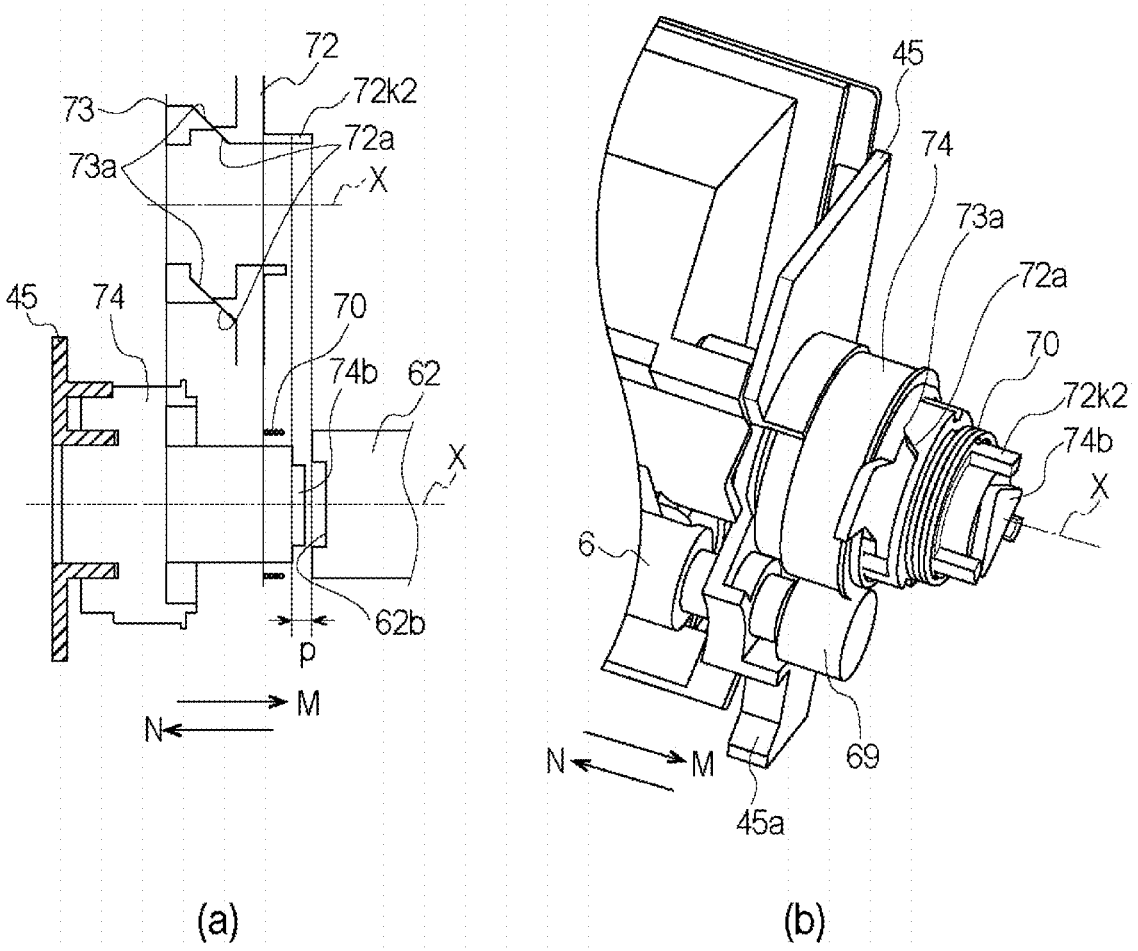

Parts (a) and (b) of FIG. 18 are illustrations of the drive disconnection state in a modified example of the first embodiment, in which (a) is a schematic sectional view of the drive connecting portion, and (b) is a perspective view of the drive connecting portion.

Figure 19:
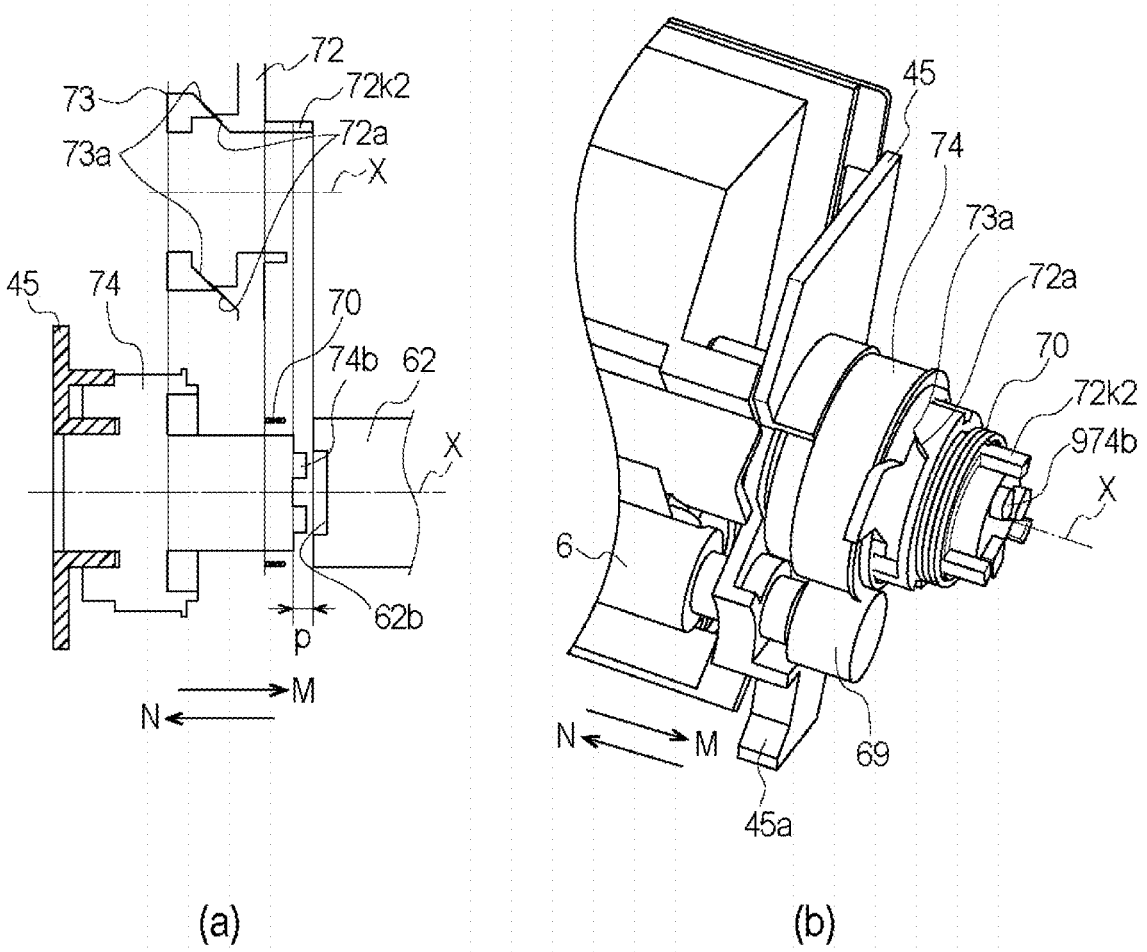

Parts (a) and (b) of FIG. 19 are illustrations of the drive disconnection state in a modified example of the first embodiment, in which (a) is a schematic sectional view of the drive connecting portion, and (b) is a perspective view of the drive connecting portion.

Figure 20:
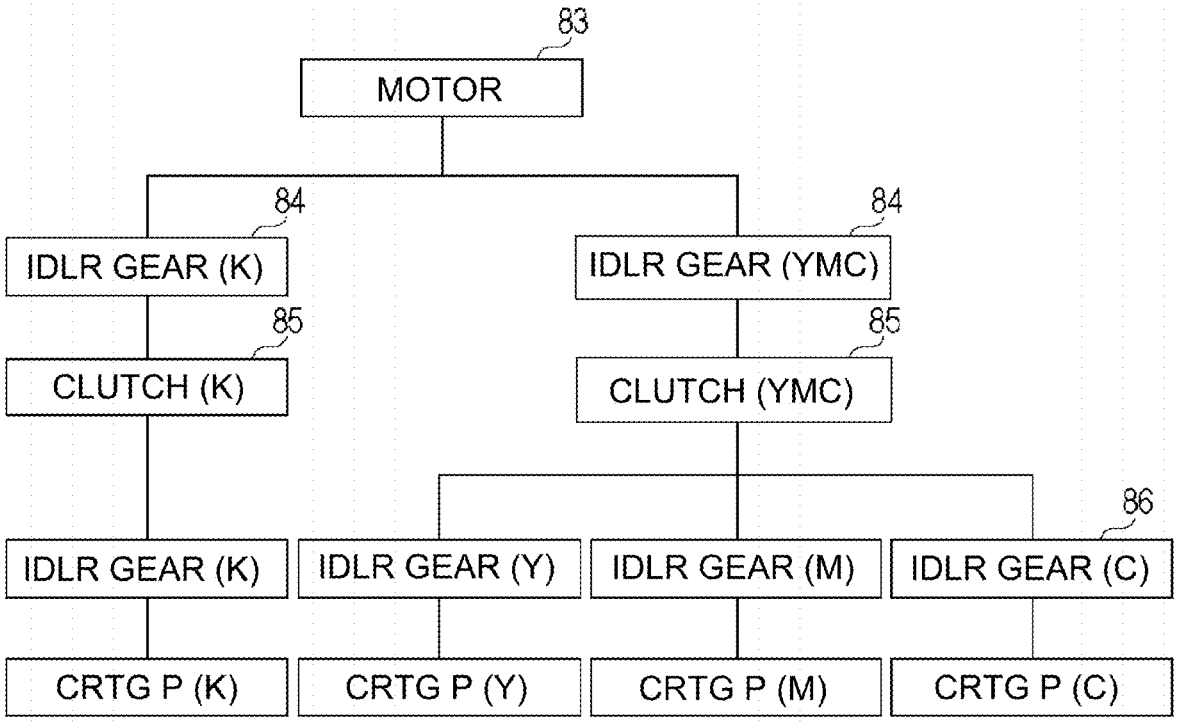

FIG. 20 is a block diagram of a gear arrangement in a conventional example.

Figure 21:
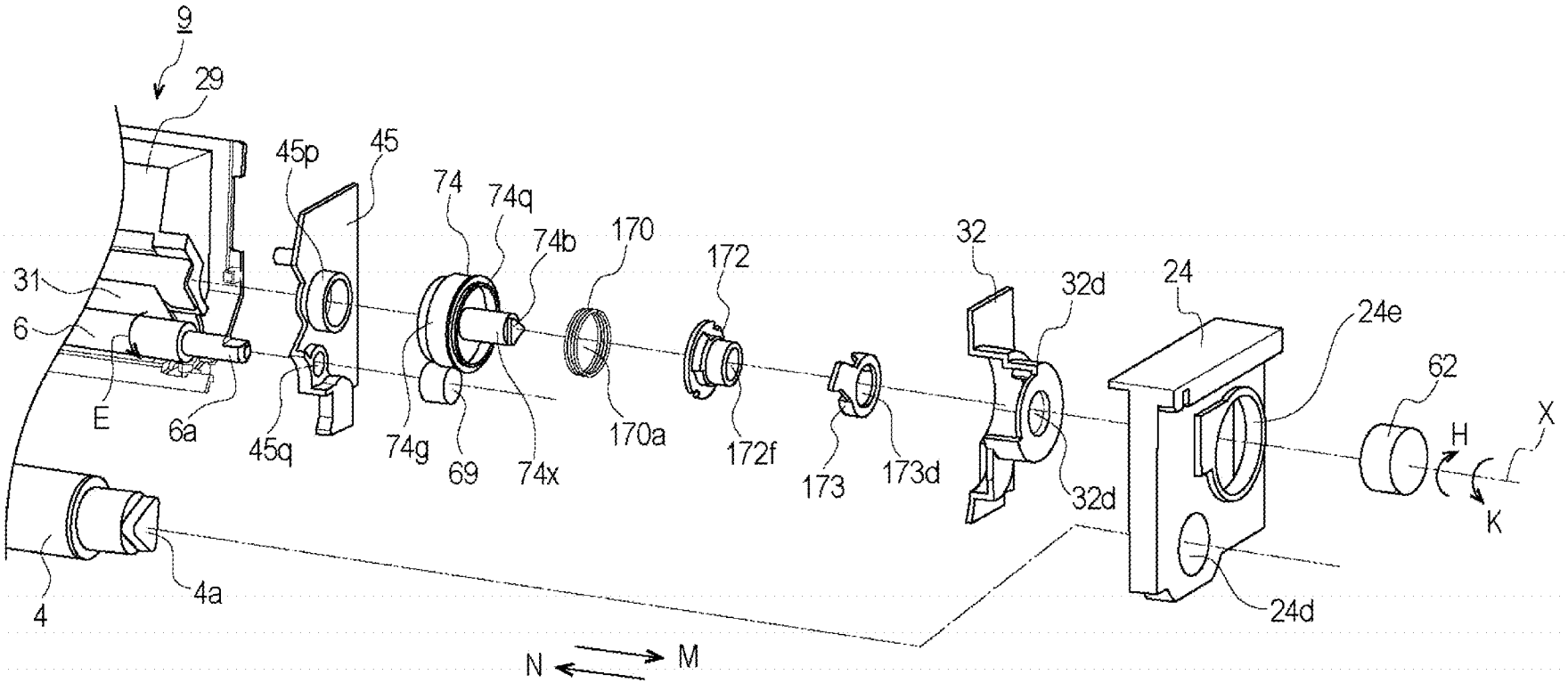

FIG. 21 is an exploded perspective view of and adjacent the drive connecting portion of the process cartridge according to a second embodiment, as seen from a driving side.

Figure 22:
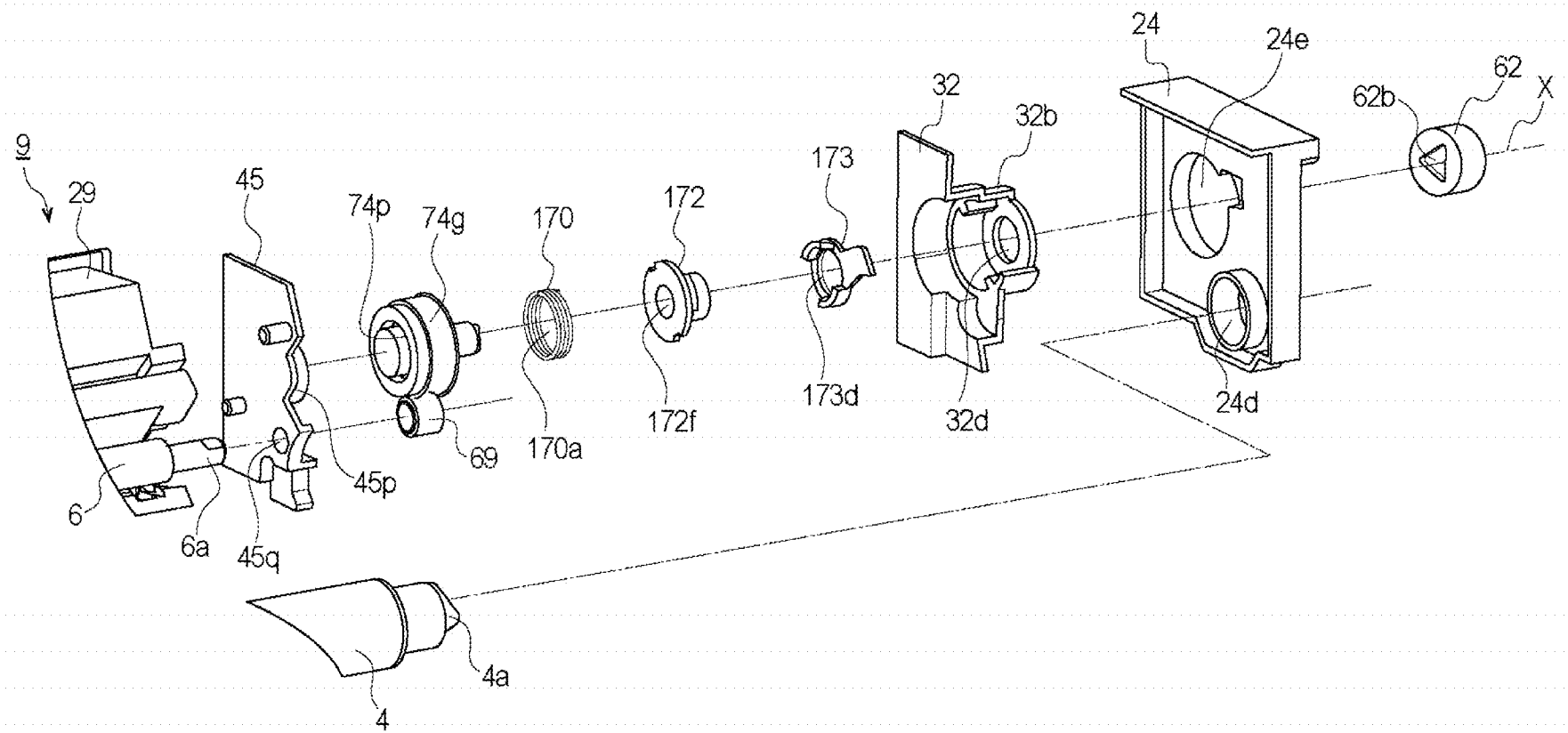

FIG. 22 is an exploded perspective view of and adjacent the drive connecting portion of the process cartridge according to the second embodiment, as seen from a non-driving side.

Figure 23:
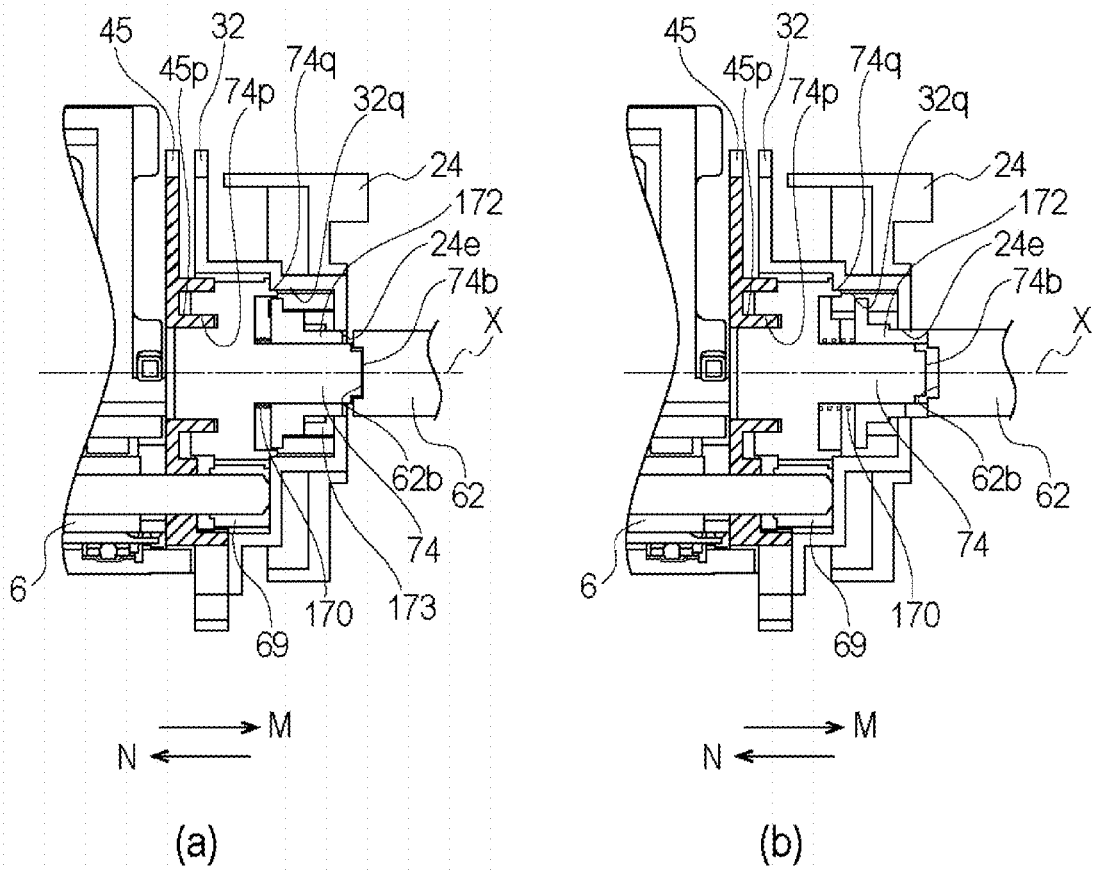

Parts (a) and (b) of FIG. 23 are schematic sectional views of and adjacent the cartridge side drive transmission member according to the second embodiment, in which (a) shows a drive transmission state, and (b) shows a drive disconnection state.

Figure 24:
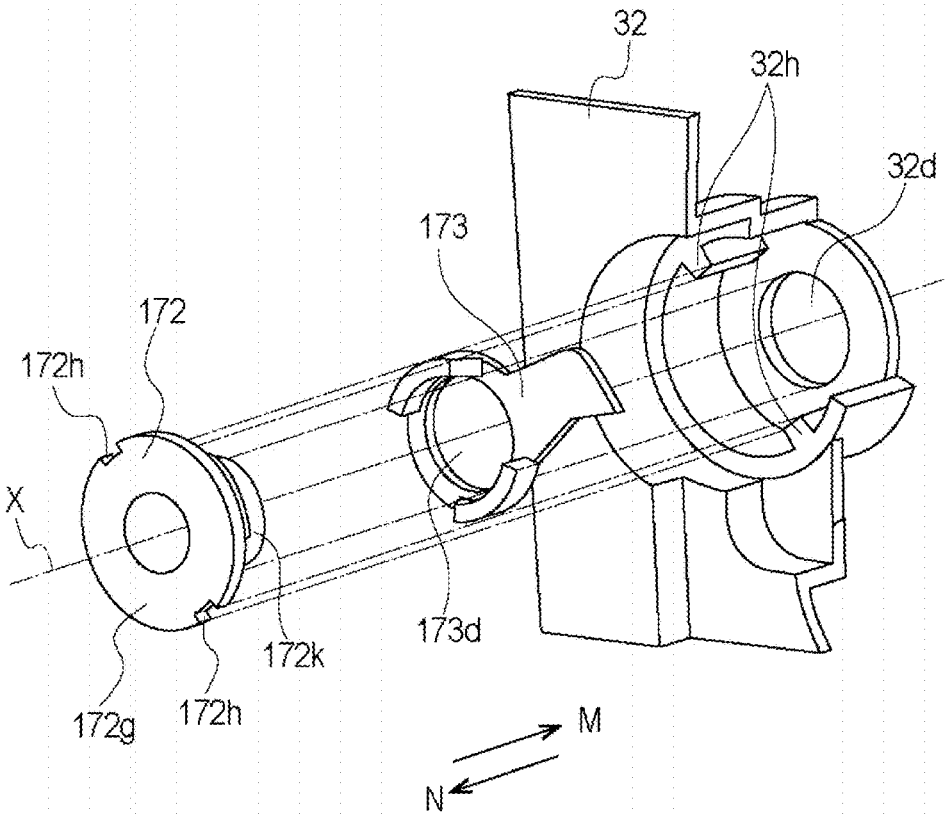

FIG. 24 is schematic exploded views of a release cam, a release lever and a developing device covering member in the second embodiment.

Figure 25:
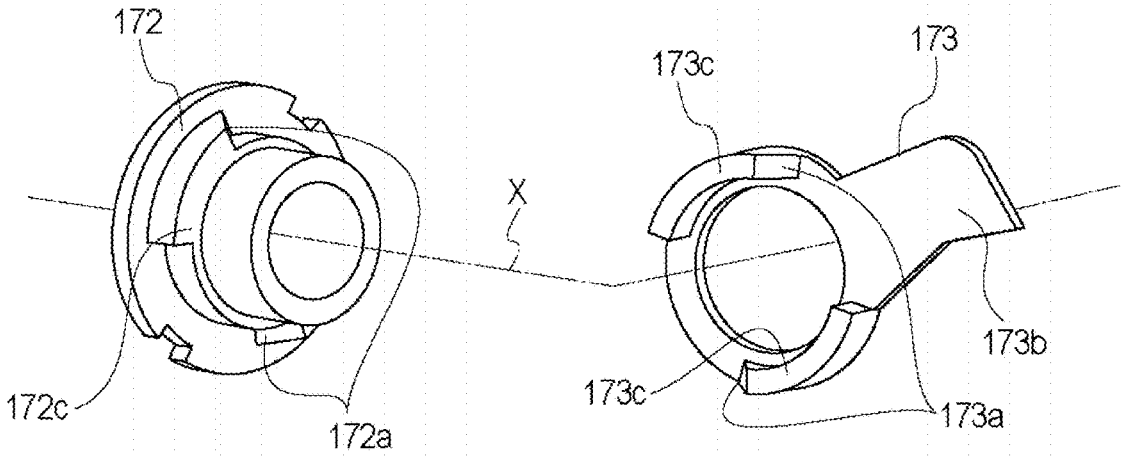

FIG. 25 is schematic exploded views of the release cam and the release lever in the second embodiment.

Figure 26:
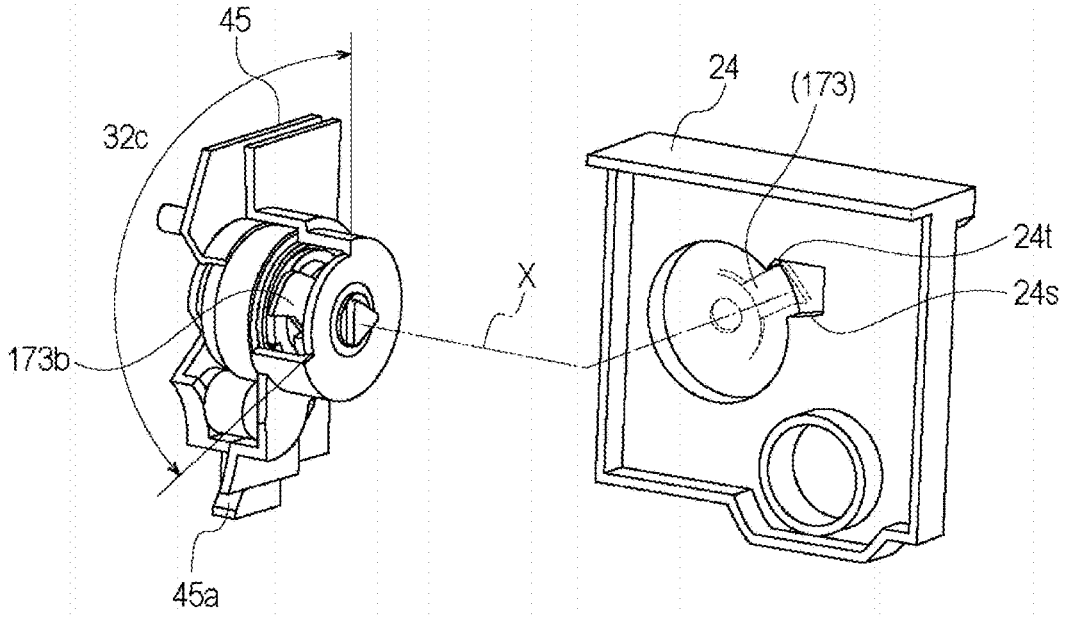

FIG. 26 is a schematic view of the cartridge side drive transmission member and releasing member, a peripheral parts thereof, and a driving side cartridge cover member, in the second embodiment.

Figure 27:
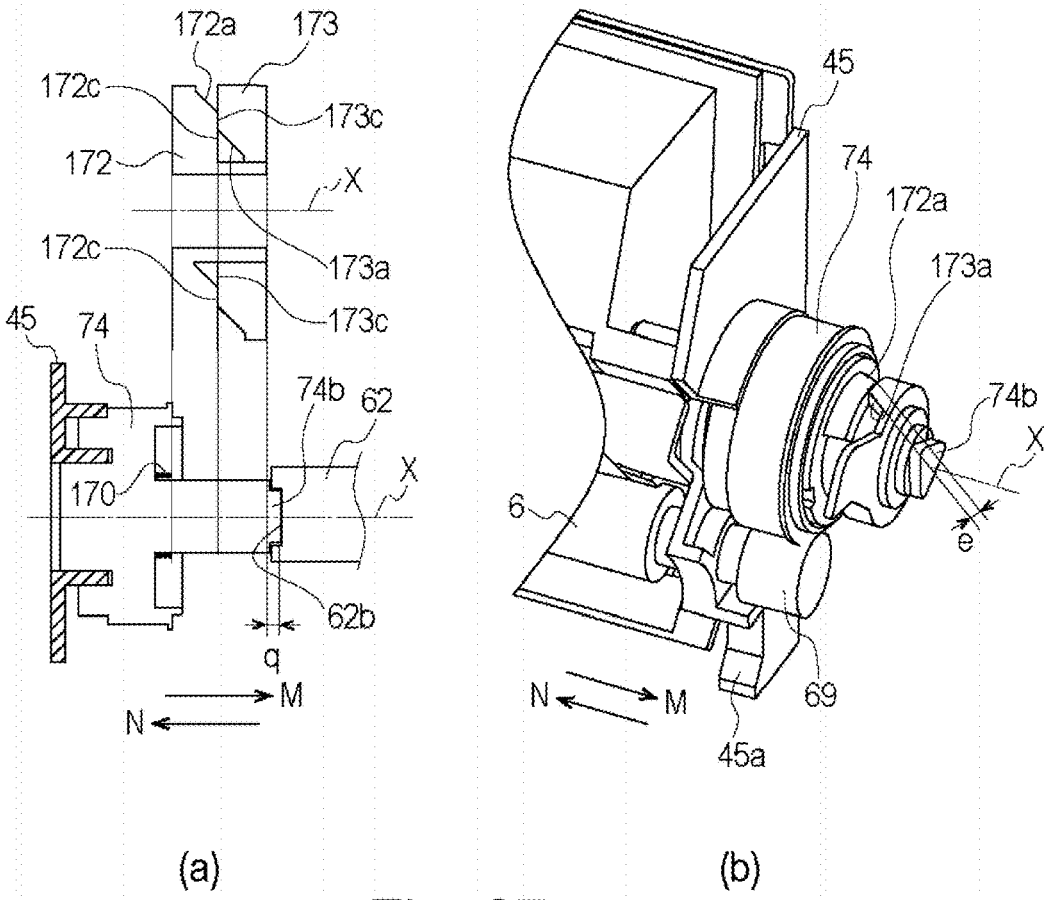

Parts (a) and (b) of FIG. 27 are schematic views of and adjacent the cartridge side drive transmission member in the contact and drive transmission state in the second embodiment, in which (a) is a schematic sectional view of the drive connecting portion, and (b) is a perspective view of the drive connecting portion.

Figure 28:
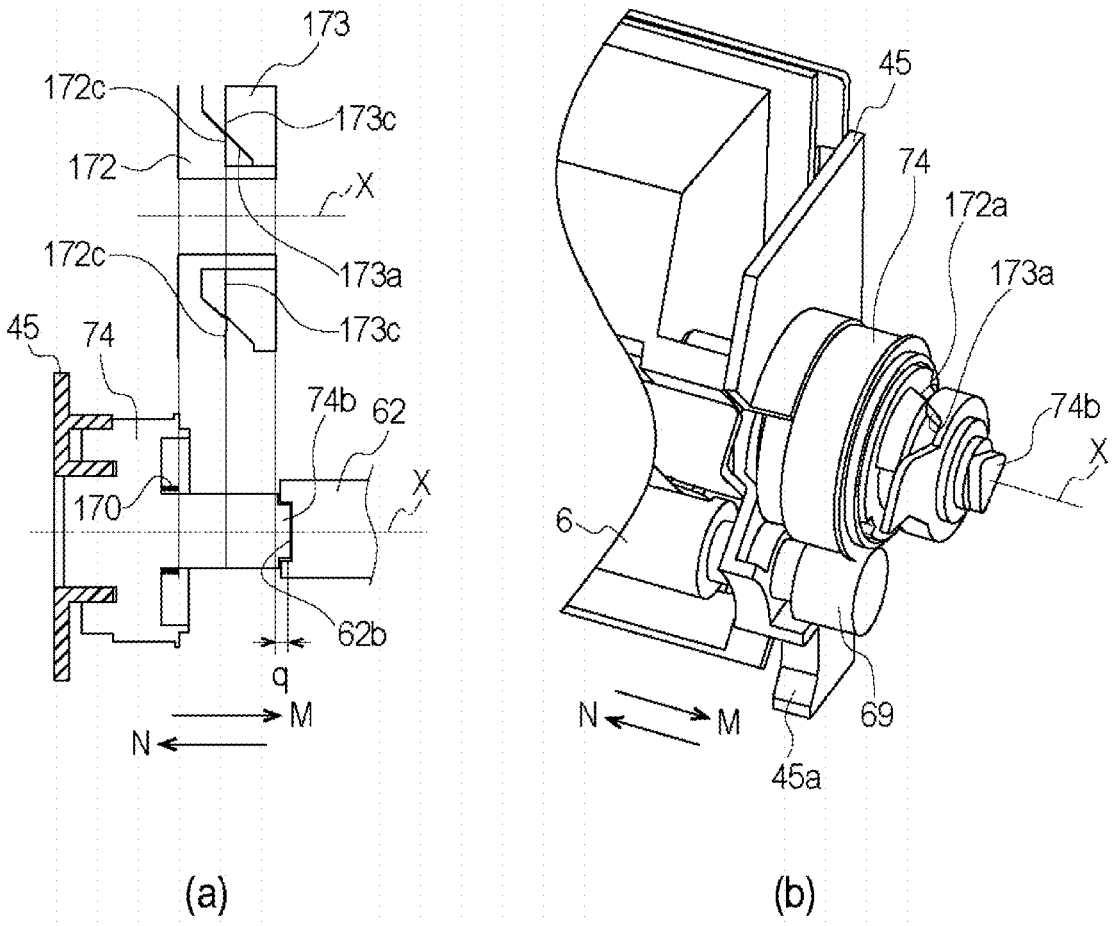

Parts (a) and (b) of FIG. 28 are schematic views of and adjacent the cartridge side drive transmission member in the developing device separation and drive transmission state in the second embodiment, in which (a) is a schematic sectional view of the drive connecting portion, and (b) is a perspective view of the drive connecting portion.

Figure 29:
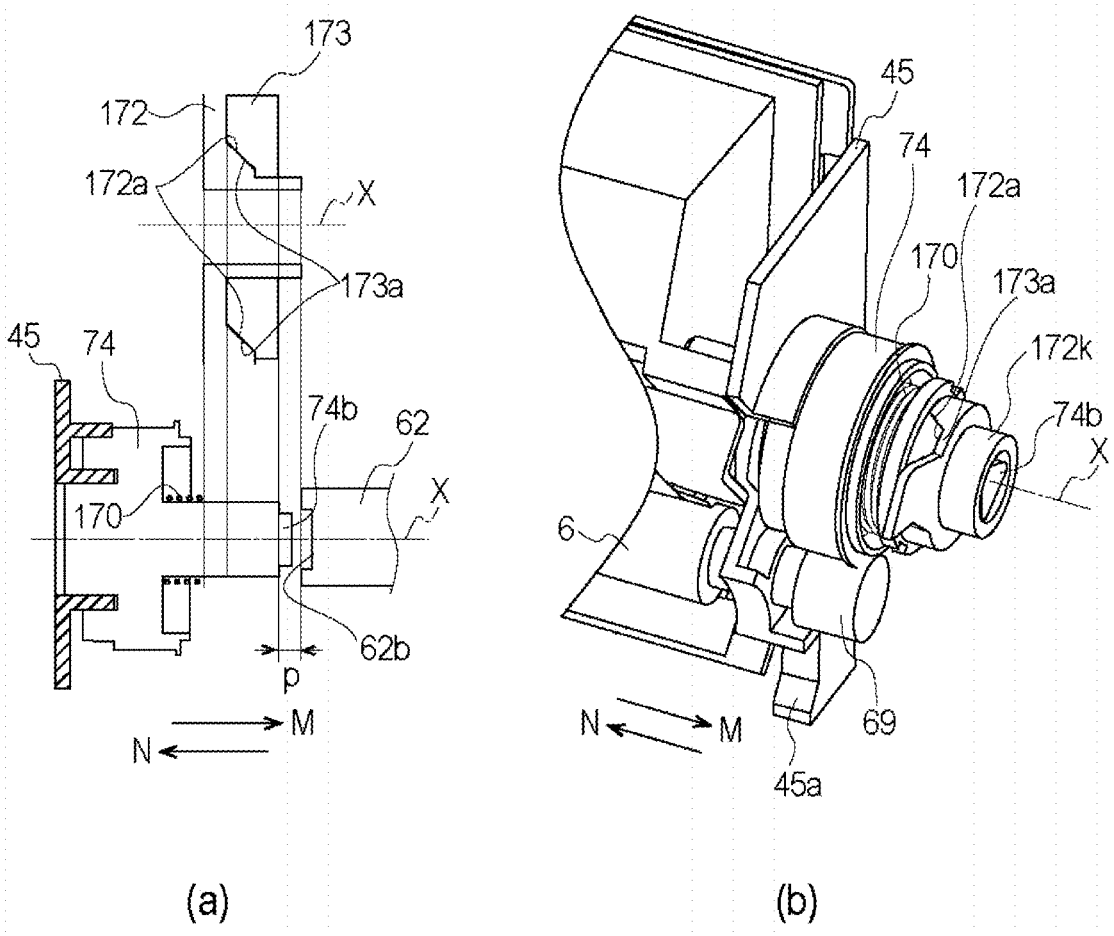

Parts (a) and (b) of FIG. 29 are schematic views of and adjacent the cartridge side drive transmission member in the developing device separation and drive disconnection state in the second embodiment, in which (a) is a schematic sectional view of the drive connecting portion, and (b) is a perspective view of the drive connecting portion.

Figure 30:
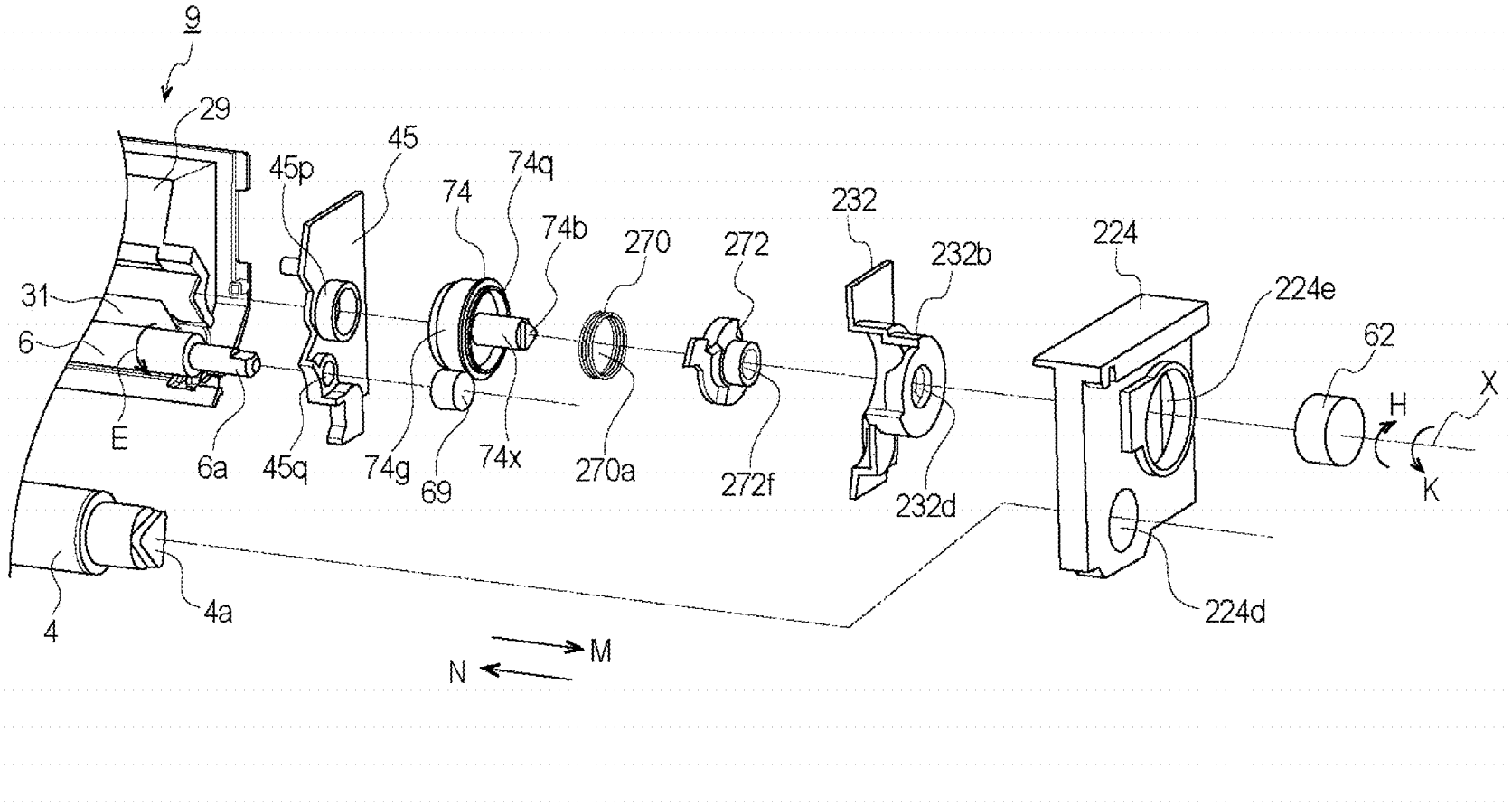

FIG. 30 is an exploded perspective view of and adjacent a drive connecting portion of a process cartridge according to a third embodiment, as seen from a driving side.

Figure 31:
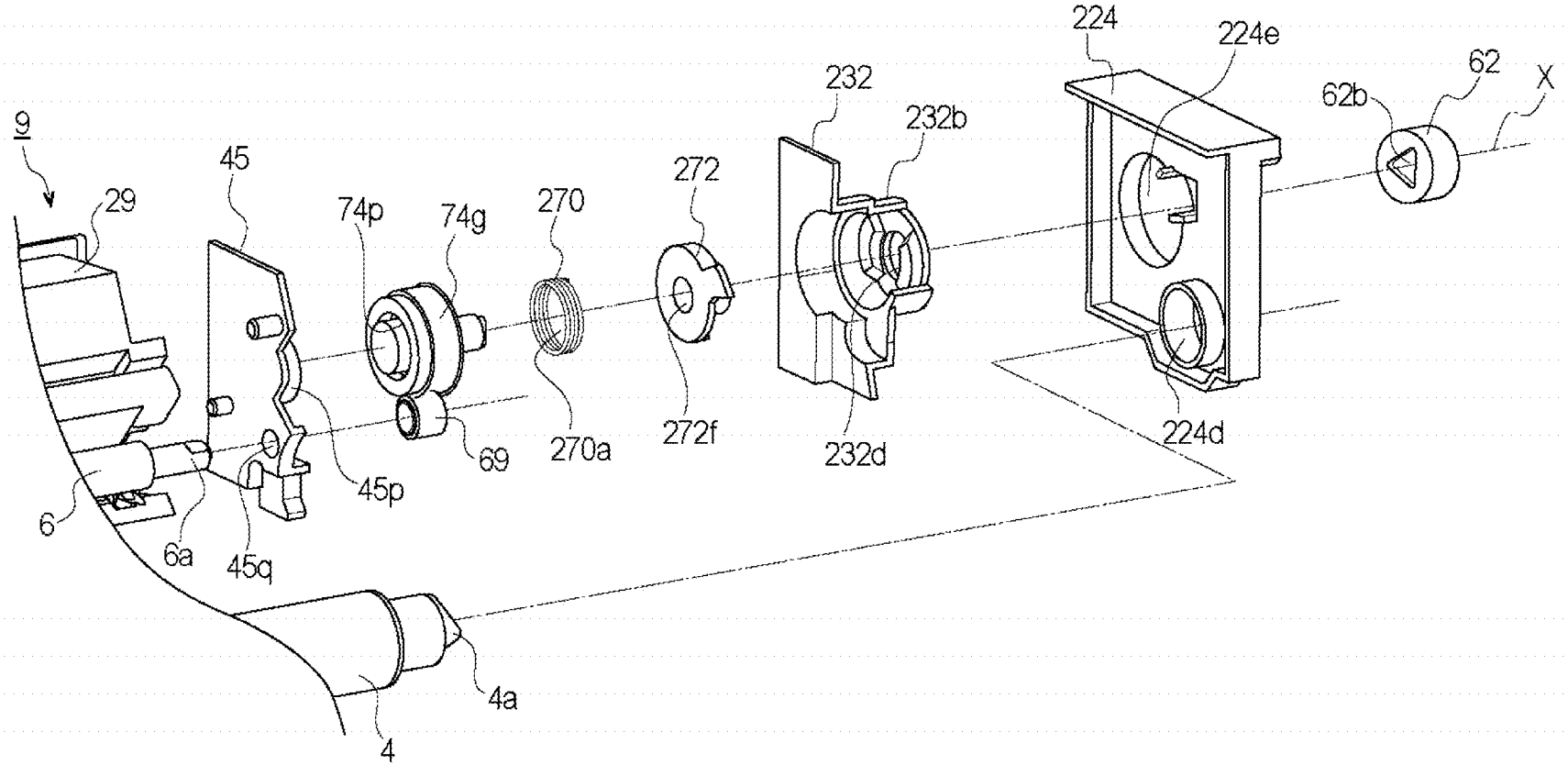

FIG. 31 is an exploded perspective view of and adjacent the drive connecting portion of the process cartridge according to the third embodiment, as seen from a non-driving side.

Figure 32:
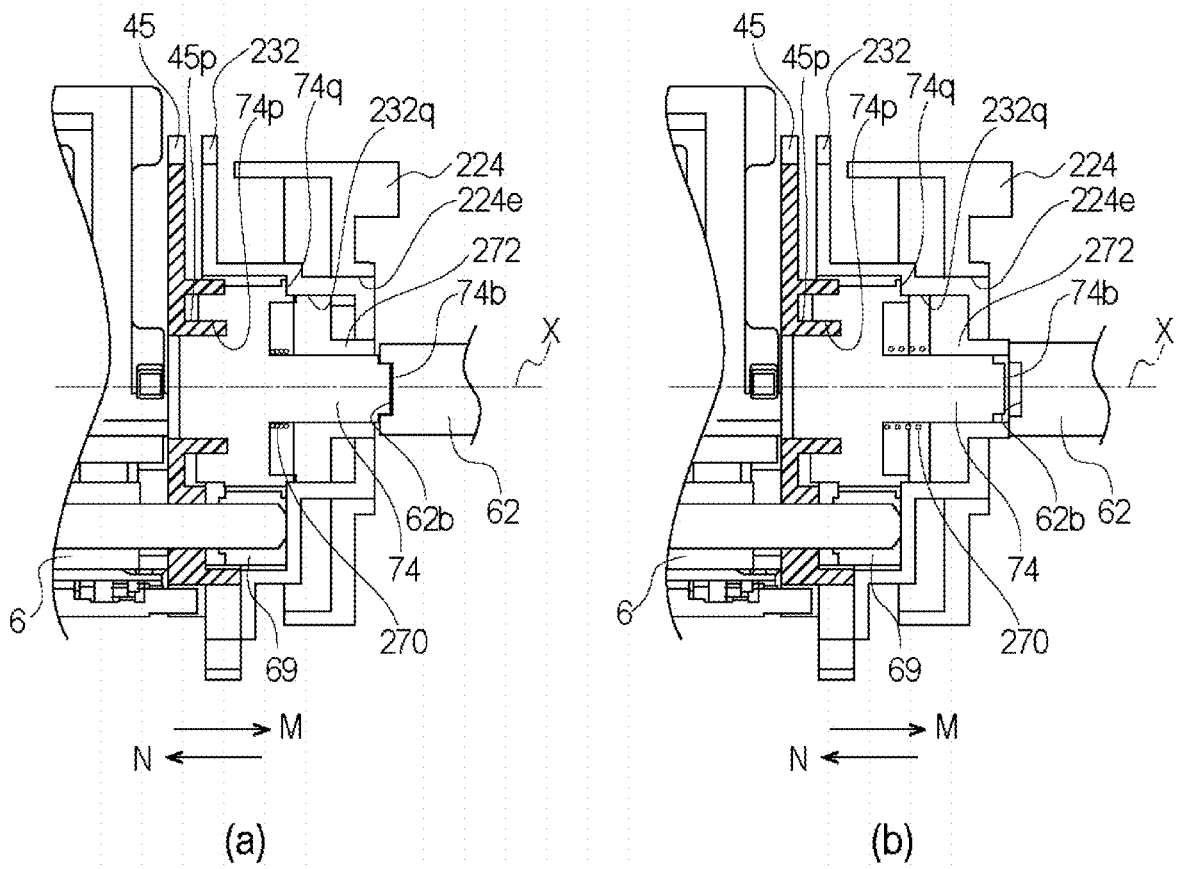

Parts (a) and (b) of FIG. 32 are schematic sectional views of and adjacent the cartridge side drive transmission member according to the third embodiment, in which (a) shows a drive transmission state, and (b) shows a drive disconnection state.

Figure 33:
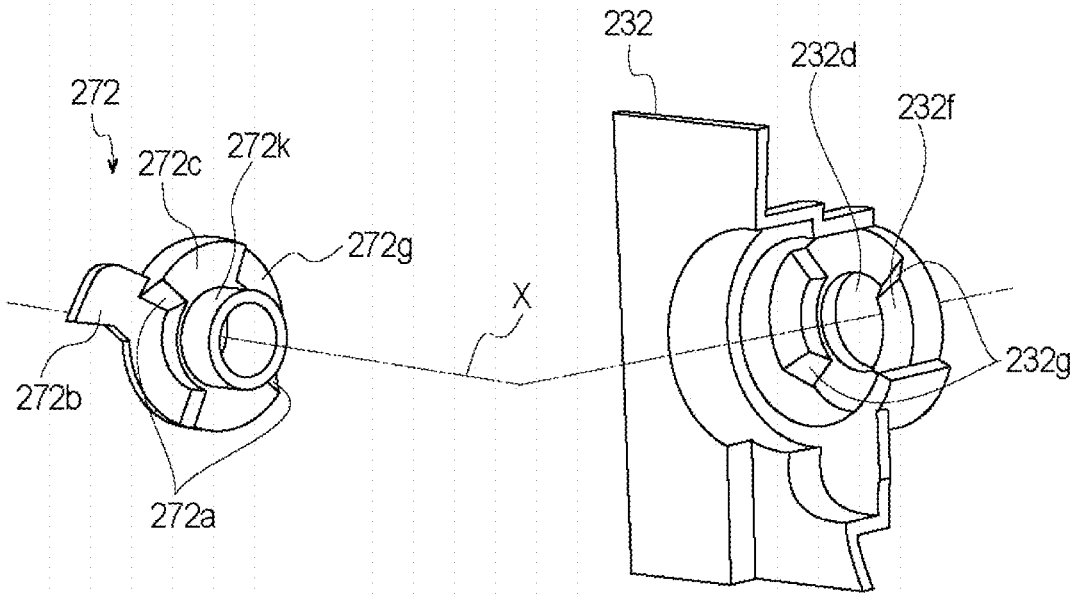

FIG. 33 is a schematic exploded view of the developing device covering member and the release cam according to the third embodiment.

Figure 34:
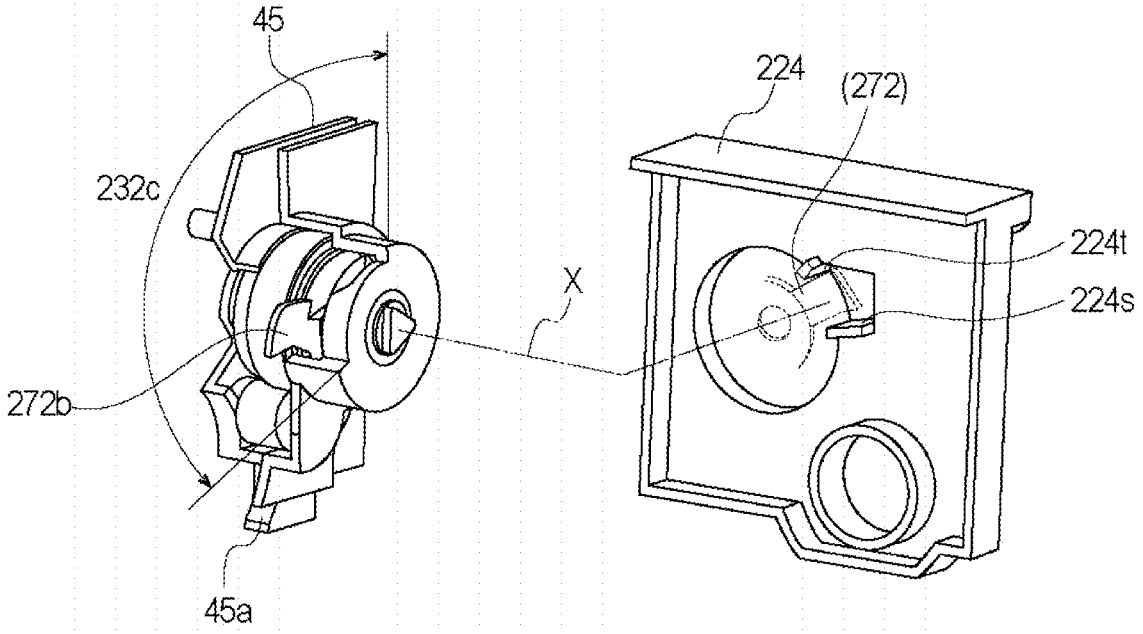

FIG. 34 is a schematic view of the cartridge side drive transmission member and releasing member, a peripheral parts thereof, and a driving side cartridge cover member, in the third embodiment.

Figure 35:
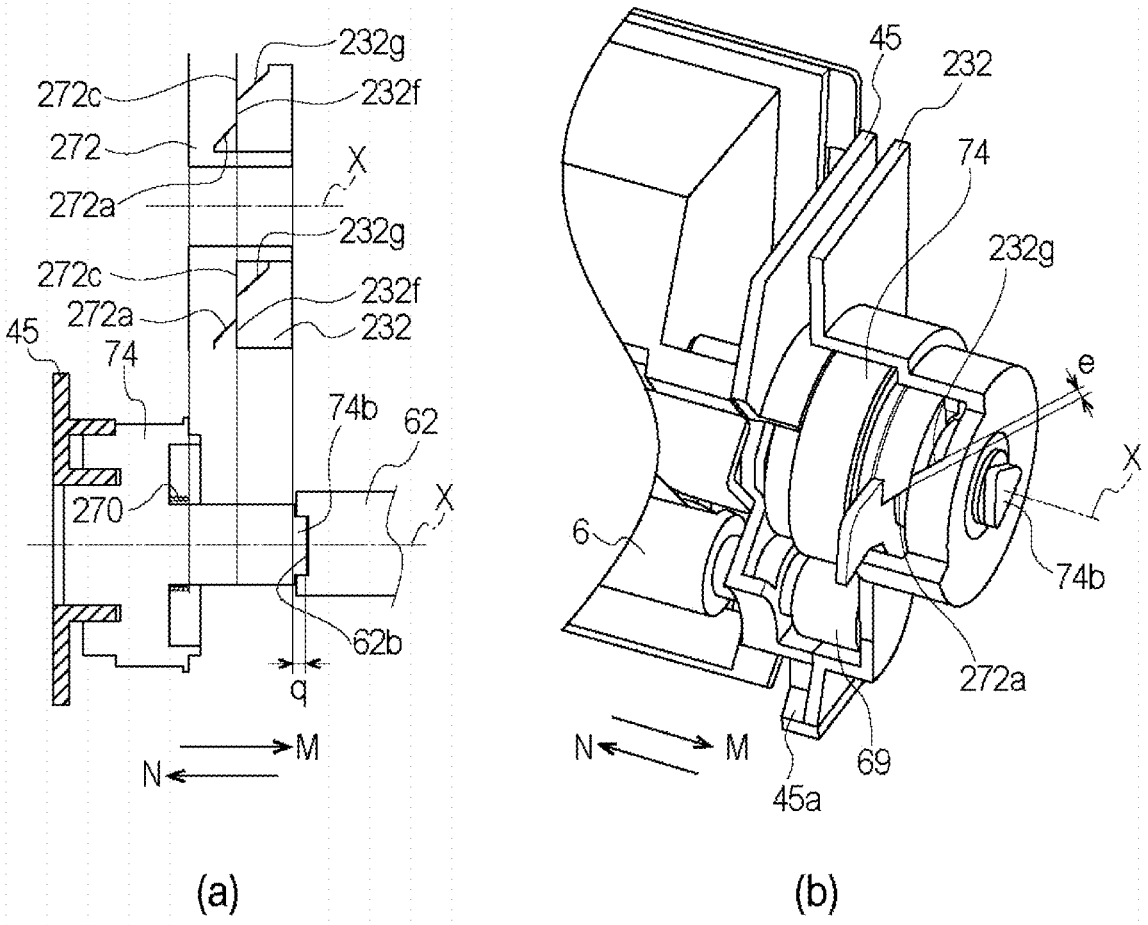

Parts (a) and (b) of FIG. 35 are schematic views of and adjacent the cartridge side drive transmission member in the contact and drive transmission state in the third embodiment, in which (a) is a schematic sectional view of the drive connecting portion, and (b) is a perspective view of the drive connecting portion.

Figure 36:
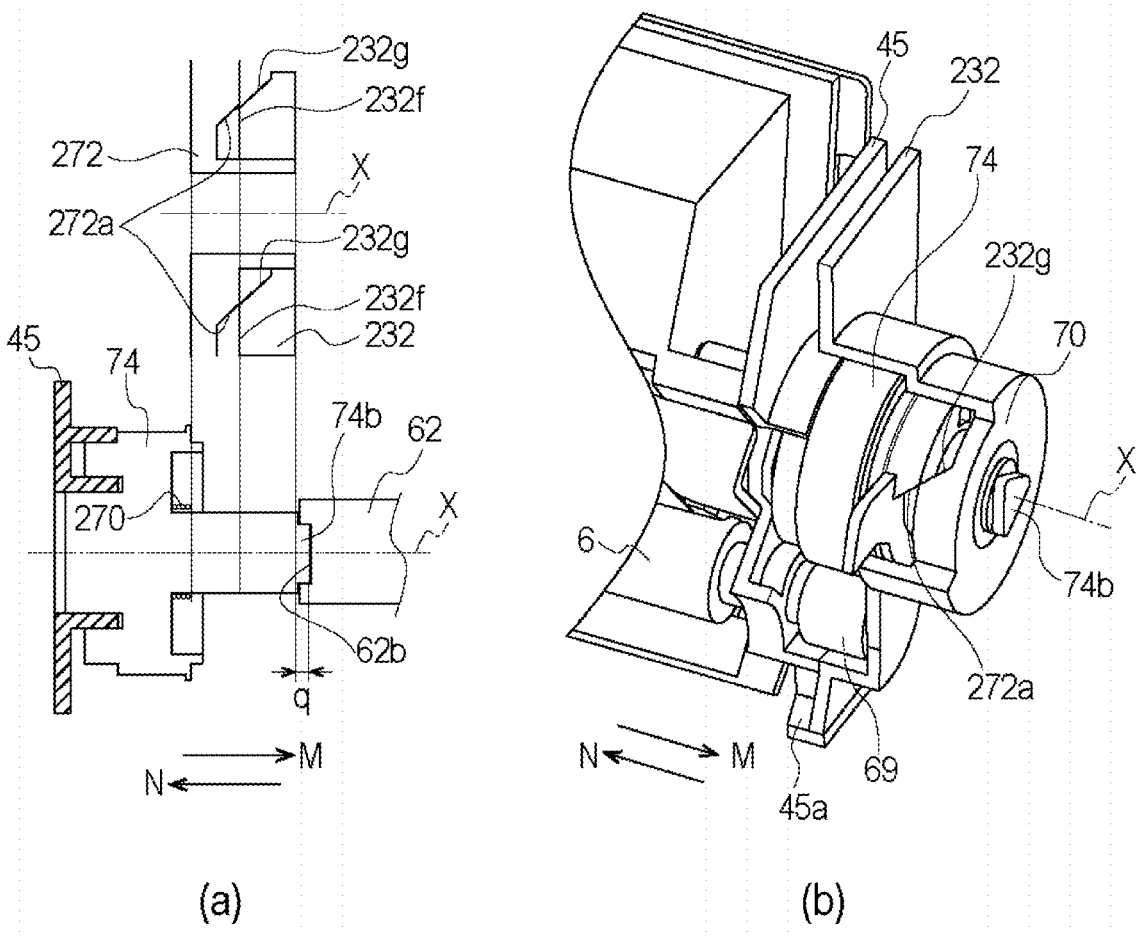

Parts (a) and (b) of FIG. 36 are schematic views of and adjacent the cartridge side drive transmission member in the developing device separation and drive transmission state in the third embodiment, in which (a) is a schematic sectional view of the drive connecting portion, and (b) is a perspective view of the drive connecting portion.

Figure 37:
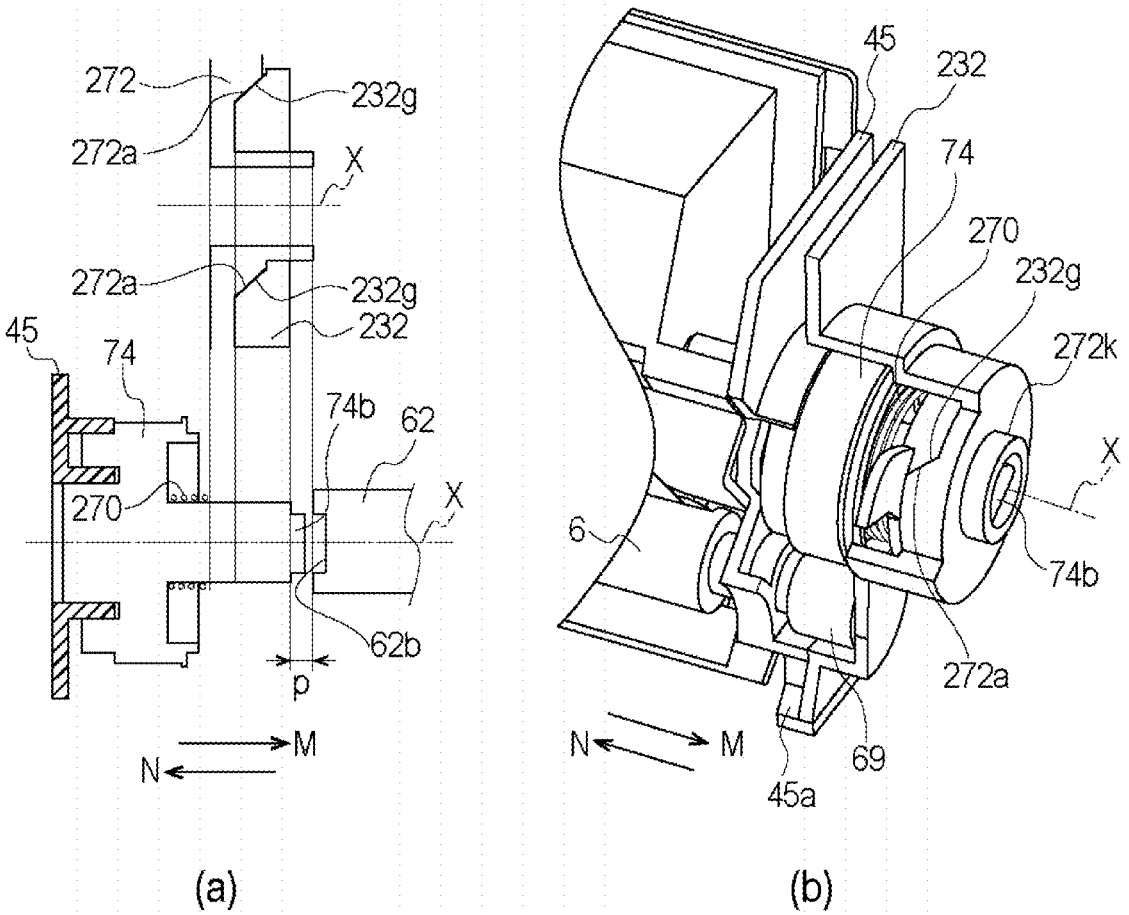

Parts (a) and (b) of FIG. 37 are schematic views of and adjacent the cartridge side drive transmission member in the developing device separation and drive disconnection state in the third embodiment, in which (a) is a schematic sectional view of the drive connecting portion, and (b) is a perspective view of the drive connecting portion.

Figure 38:
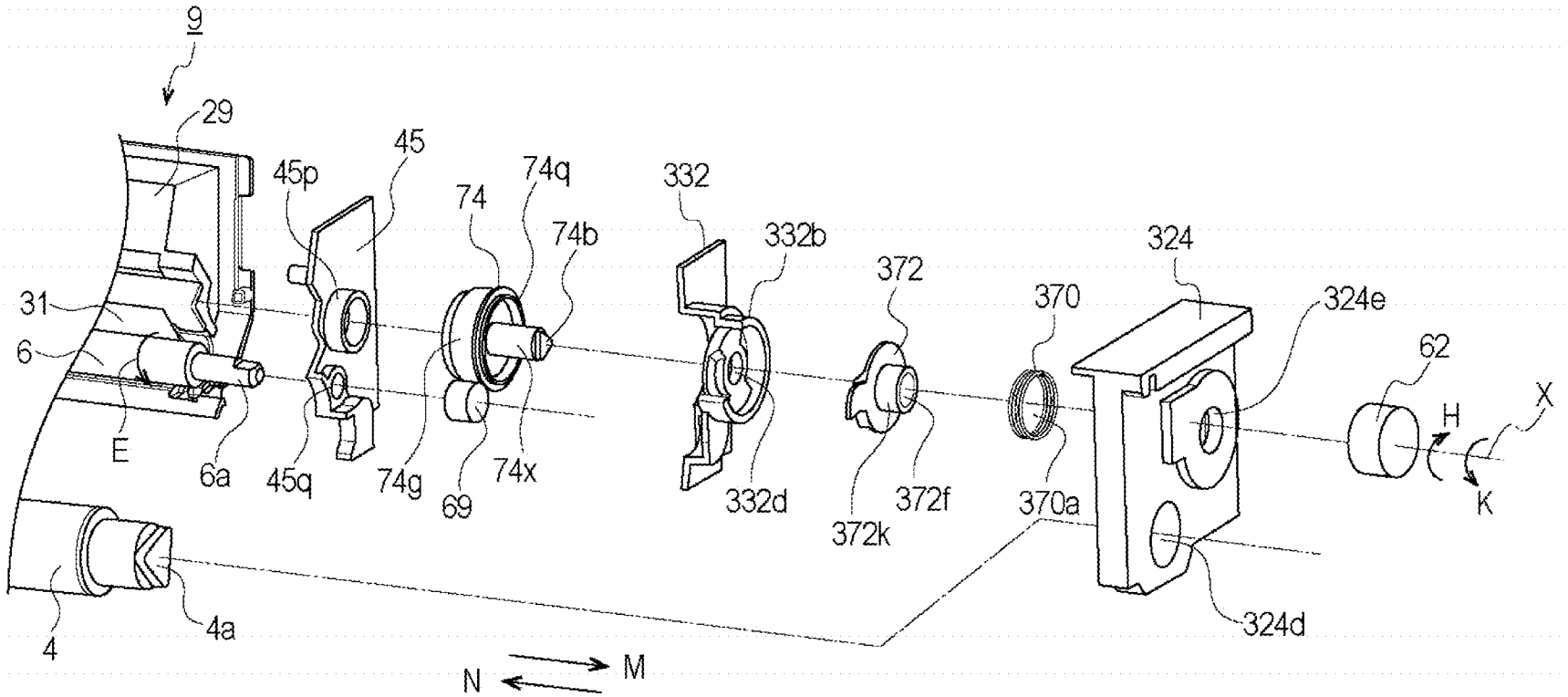

FIG. 38 is an exploded perspective view of and adjacent a drive connecting portion of a process cartridge according to a fourth embodiment, as seen from a driving side.

Figure 39:
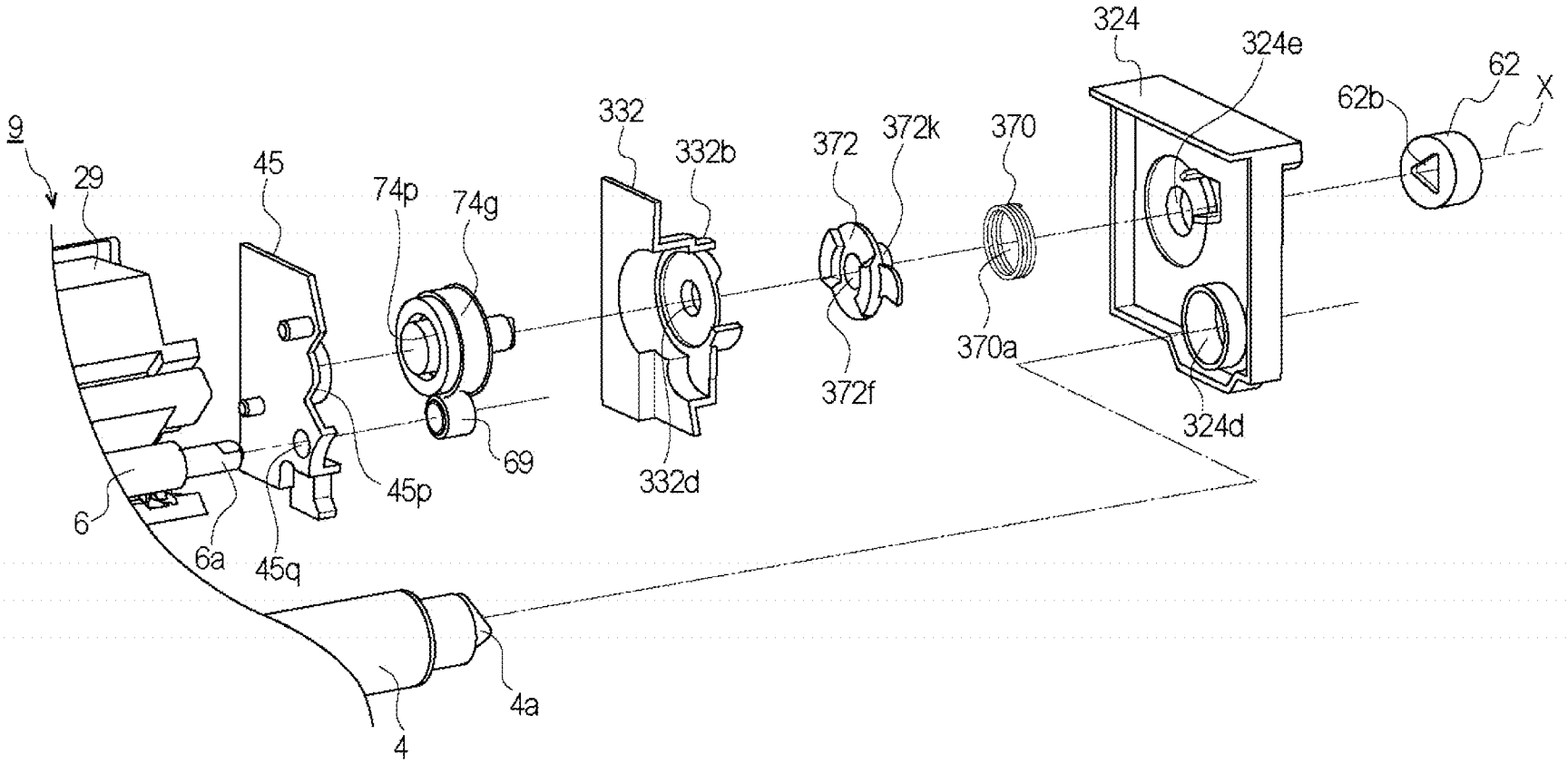

FIG. 39 is an exploded perspective view of and adjacent the drive connecting portion of the process cartridge according to the fourth embodiment, as seen from a non-driving side.

Figure 40:
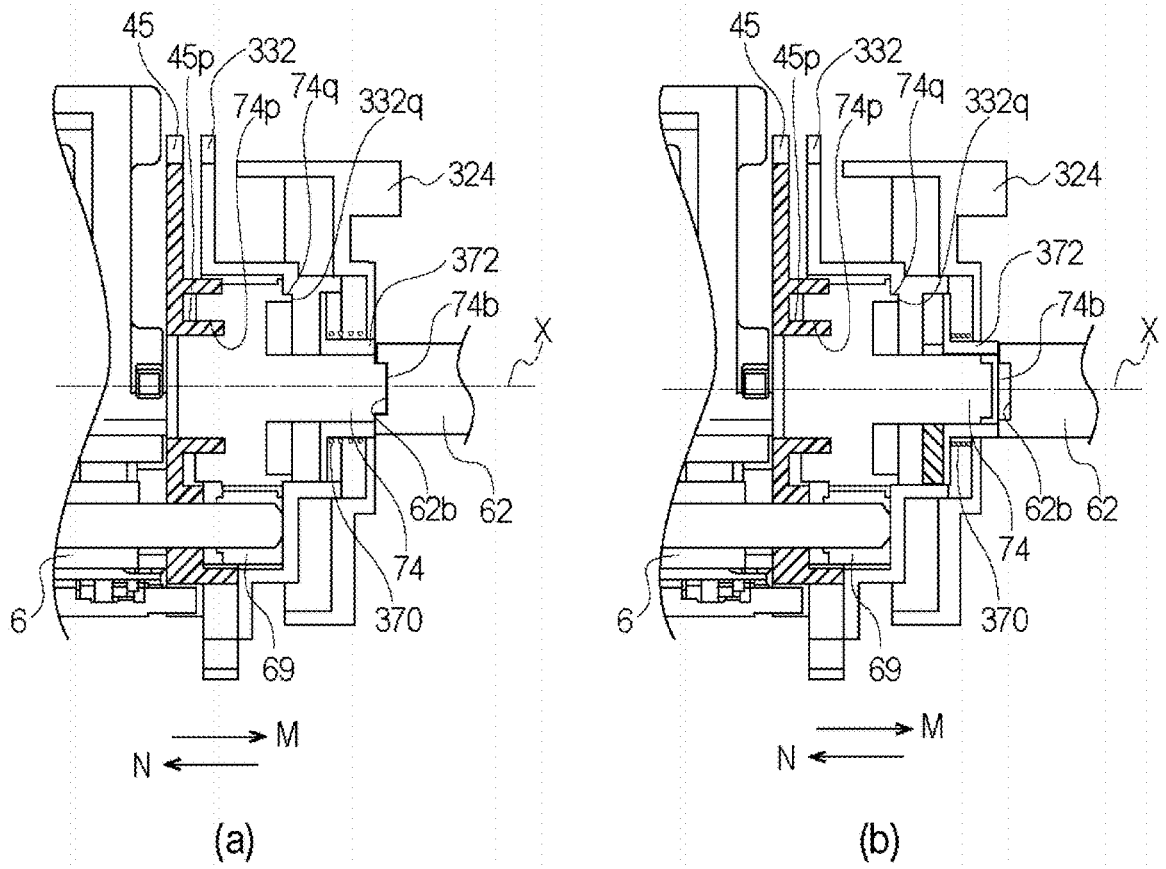

Parts (a) and (b) of FIG. 40 are schematic sectional views of and adjacent the cartridge side drive transmission member according to the fourth embodiment, in which (a) shows a drive transmission state, and (b) shows a drive disconnection state.

Figure 41:
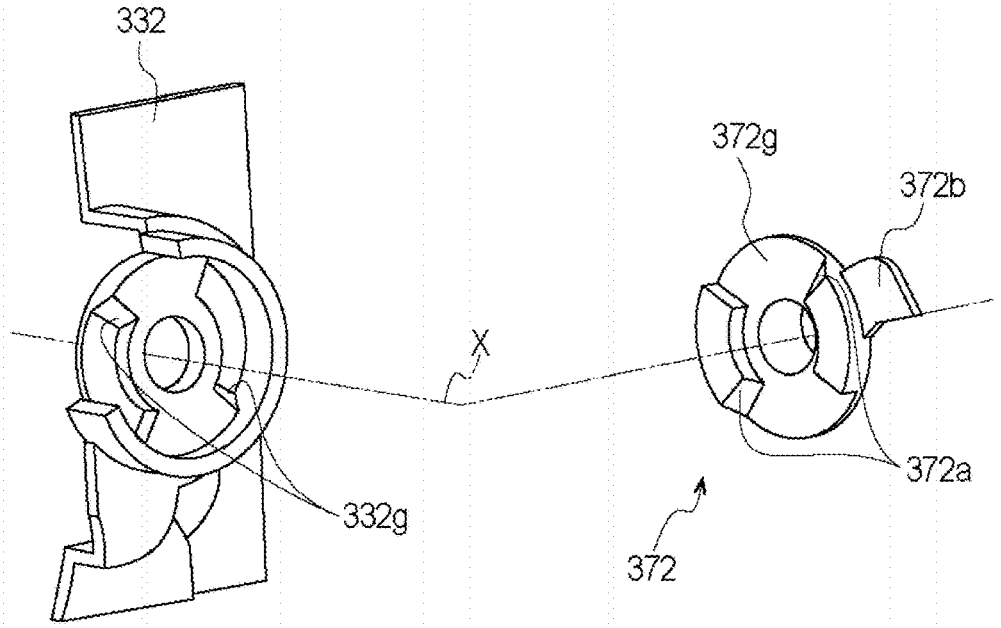

FIG. 41 is schematic exploded views of a release cam and a developing device covering member in the fourth embodiment.

Figure 42:
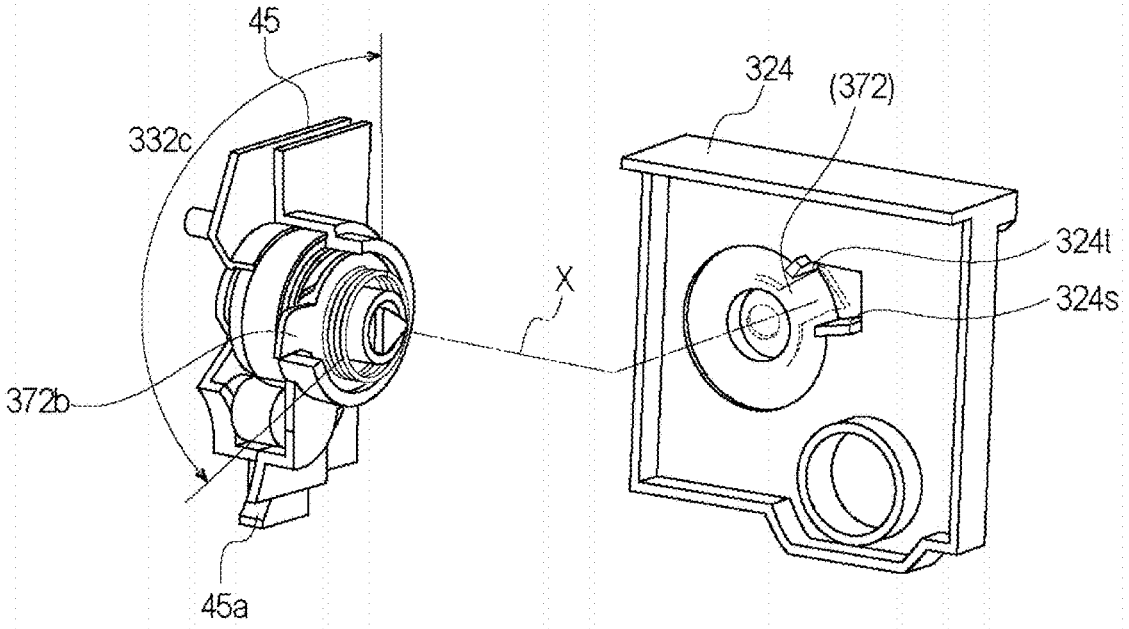

FIG. 42 is a schematic view of the cartridge side drive transmission member and releasing member, a peripheral parts thereof, and a driving side cartridge cover member, in the fourth embodiment.

Figure 43:
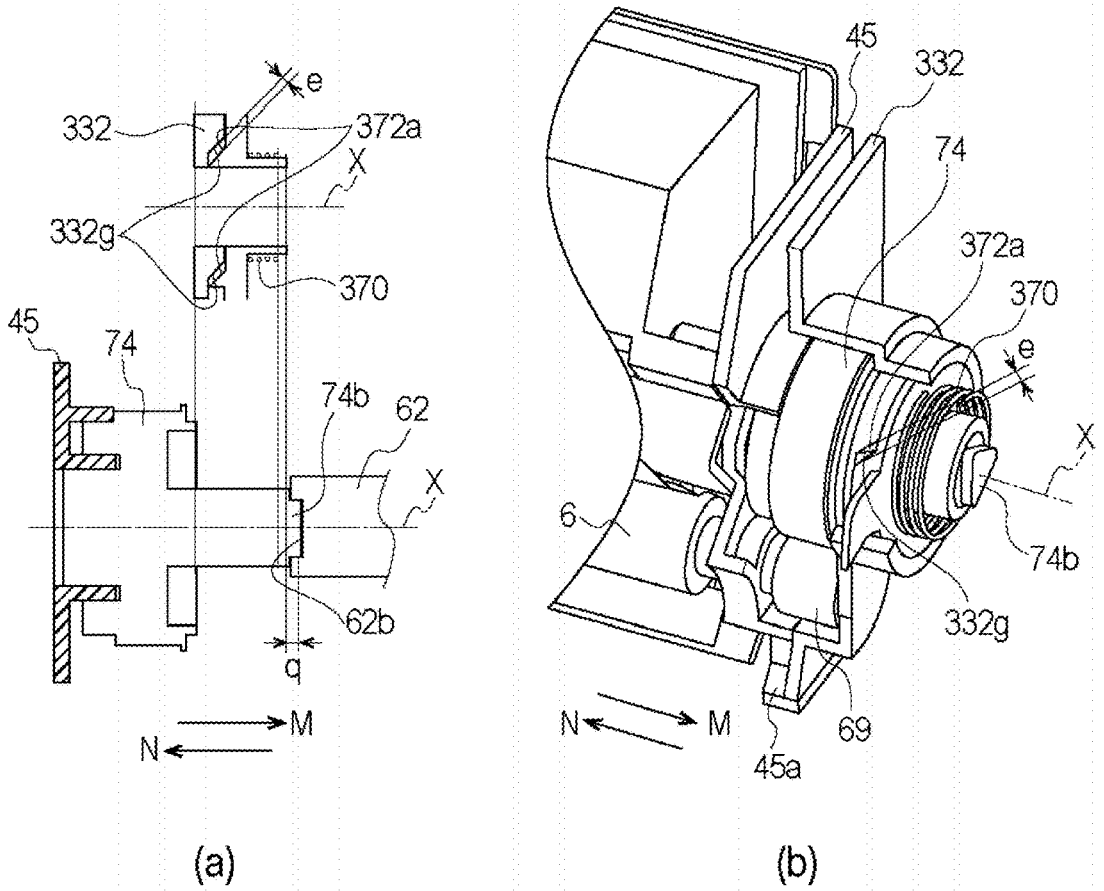

Parts (a) and (b) of FIG. 43 are schematic views of and adjacent the cartridge side drive transmission member in the contact and drive transmission state in the fourth embodiment, in which (a) is a schematic sectional view of the drive connecting portion, and (b) is a perspective view of the drive connecting portion.

Figure 44:
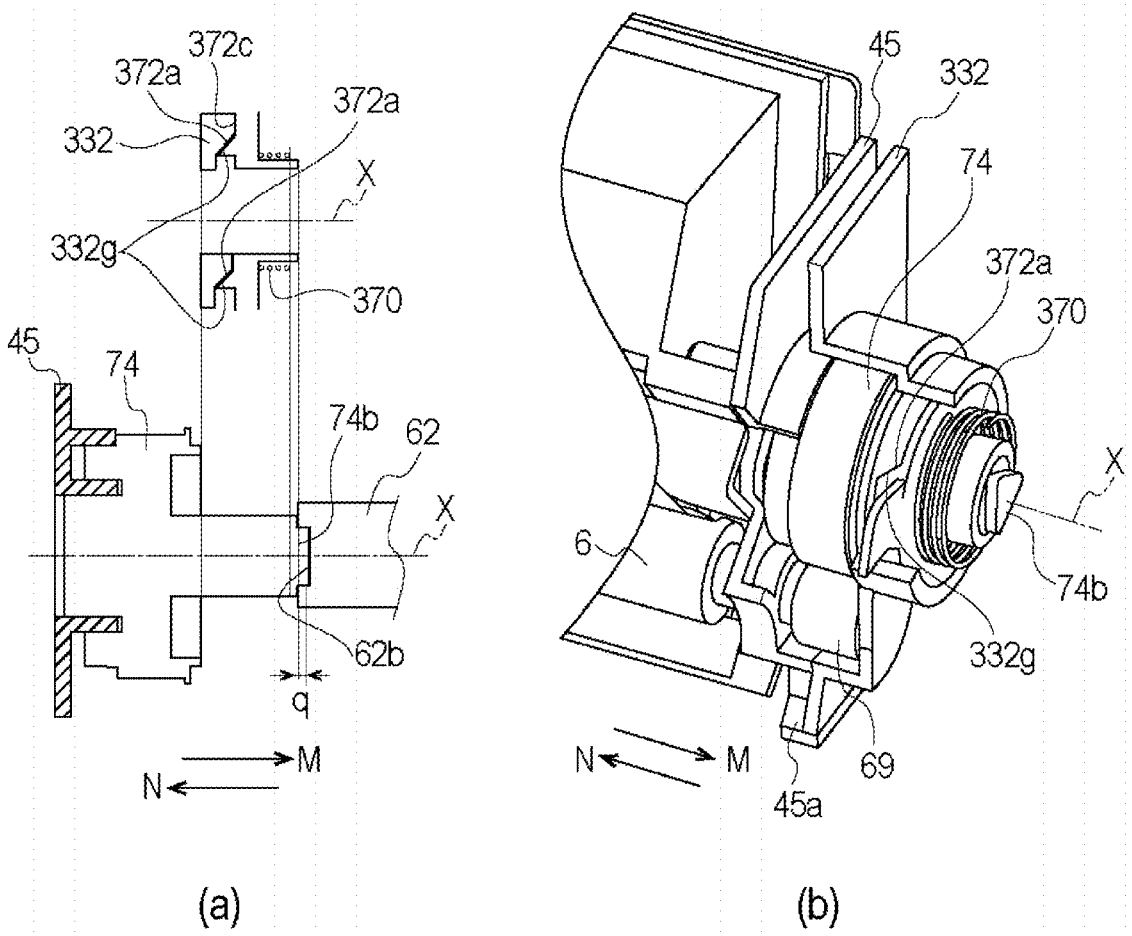

Parts (a) and (b) of FIG. 44 are schematic views of and adjacent the cartridge side drive transmission member in the developing device separation and drive transmission state in the fourth embodiment, in which (a) is a schematic sectional view of the drive connecting portion, and (b) is a perspective view of the drive connecting portion.

Figure 45:
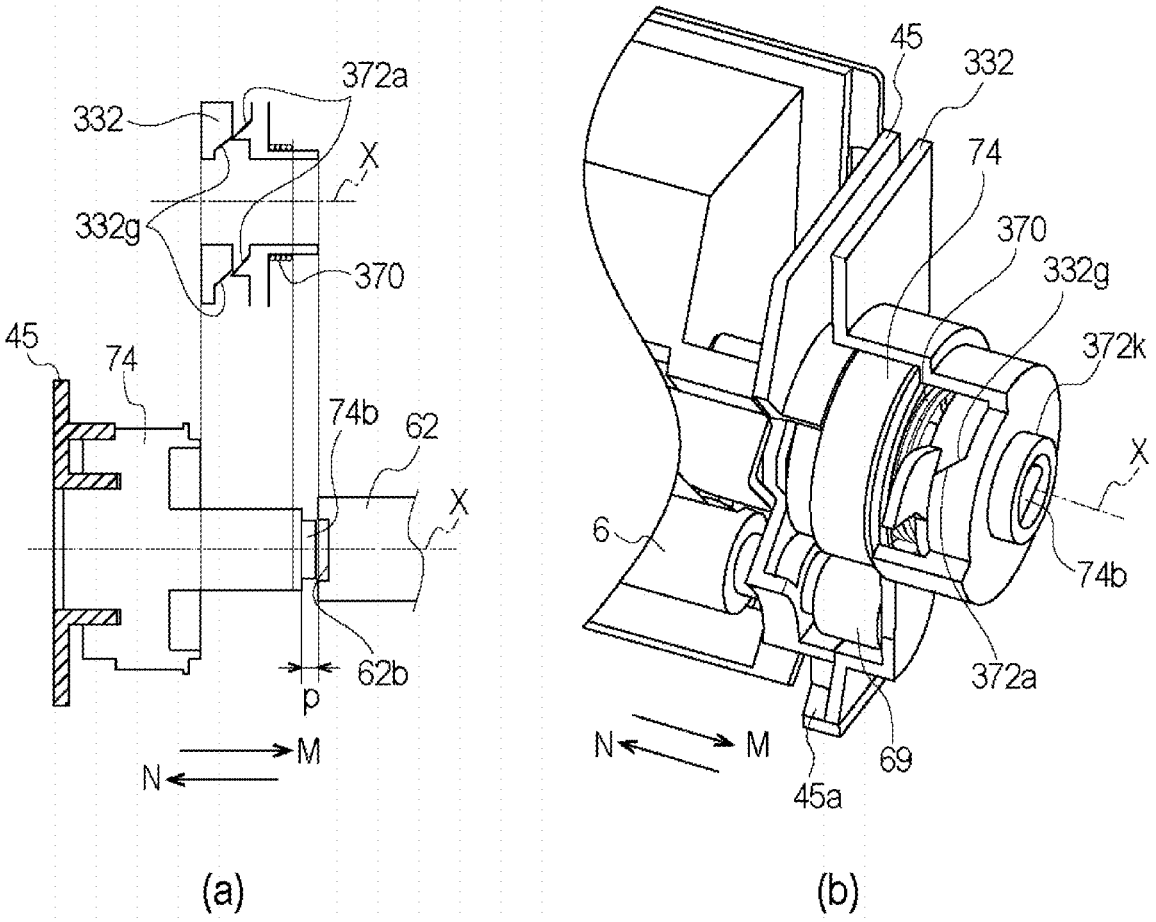

Parts (a) and (b) of FIG. 45 are schematic views of and adjacent the cartridge side drive transmission member in the developing device separation and drive disconnection state in the fourth embodiment, in which (a) is a schematic sectional view of the drive connecting portion, and (b) is a perspective view of the drive connecting portion.

Figure 46:
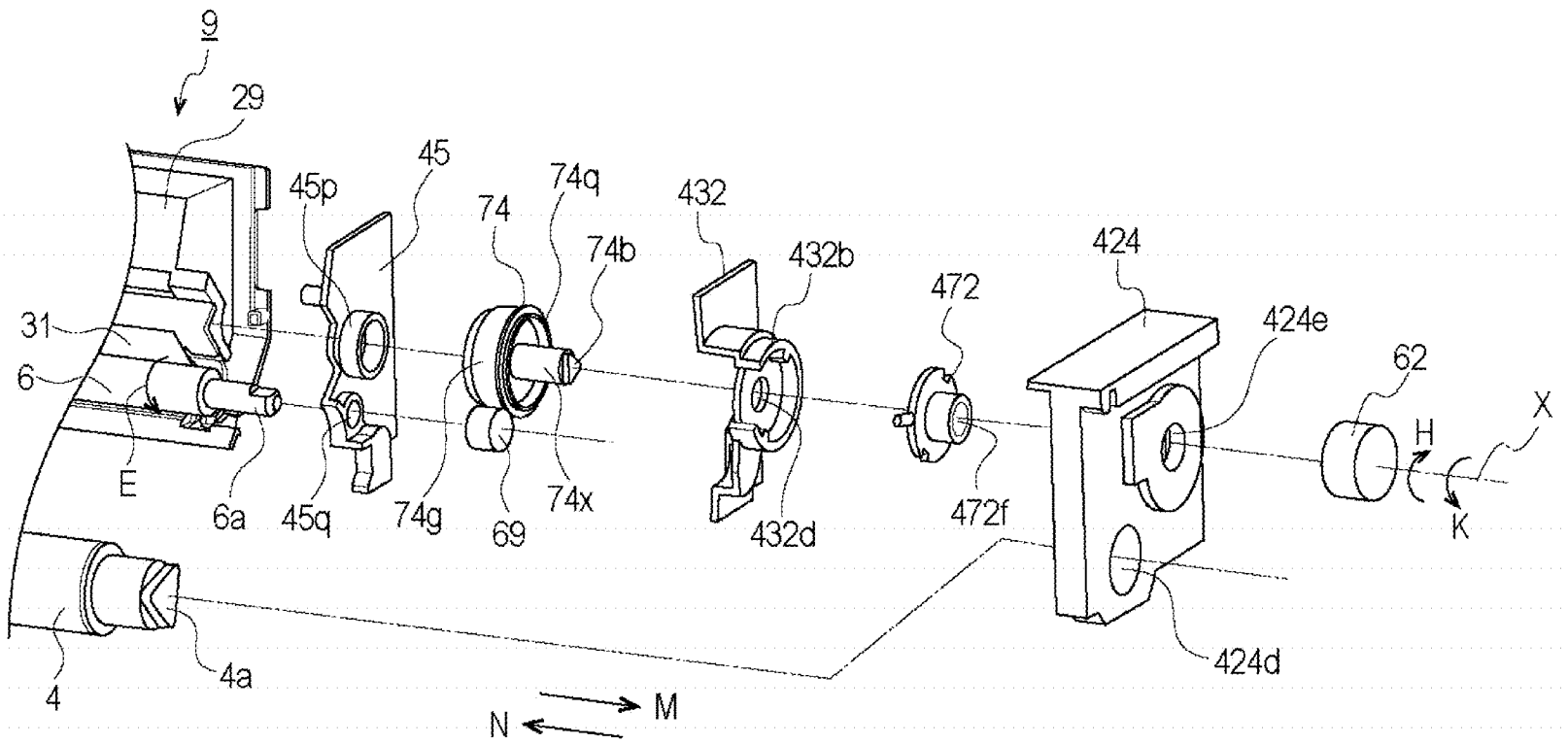

FIG. 46 is an exploded perspective view of and adjacent a drive connecting portion of a process cartridge according to a fifth embodiment, as seen from a driving side.

Figure 47:
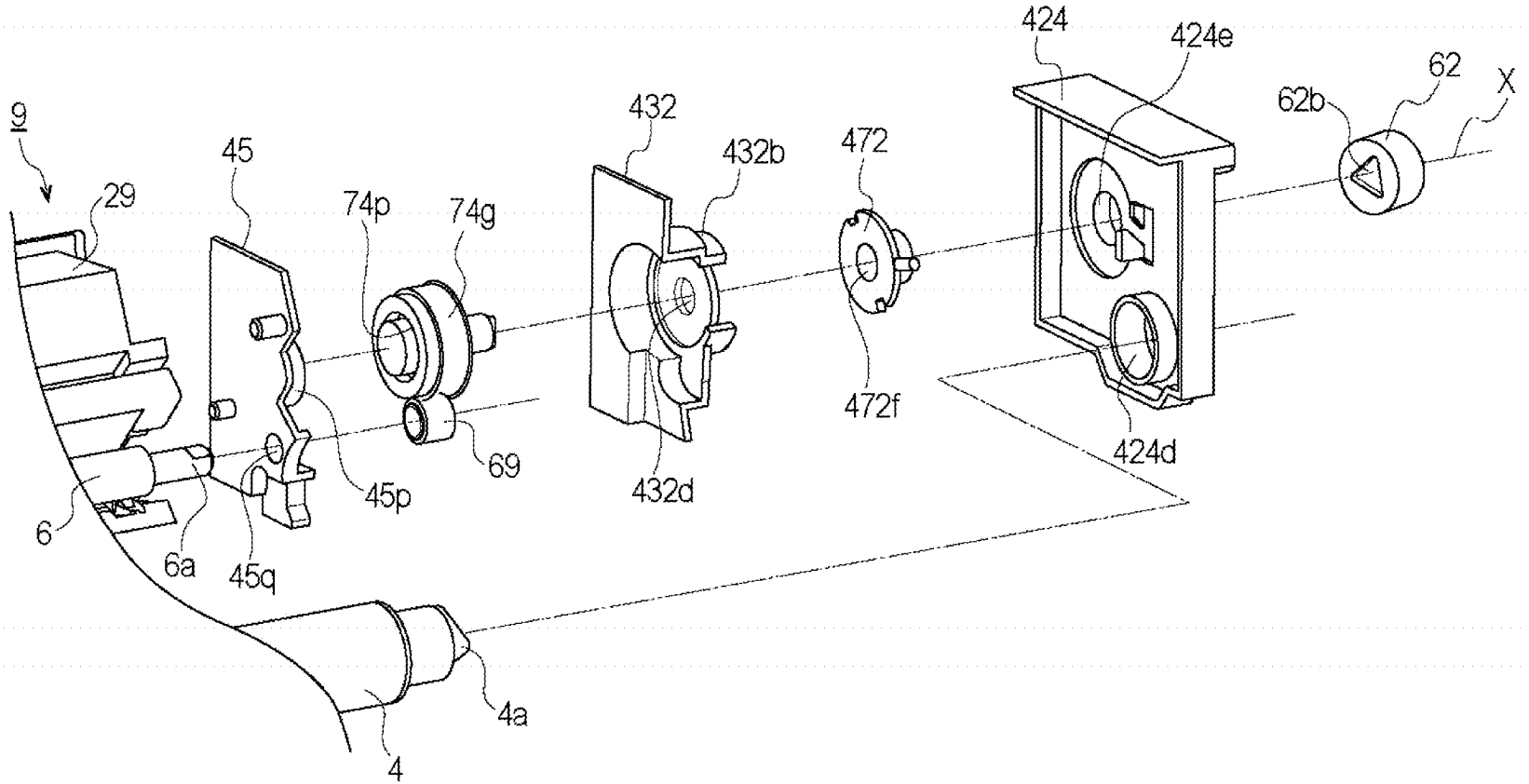

FIG. 47 is an exploded perspective view of and adjacent the drive connecting portion of the process cartridge according to the fifth embodiment, as seen from a non-driving side.

Figure 48:
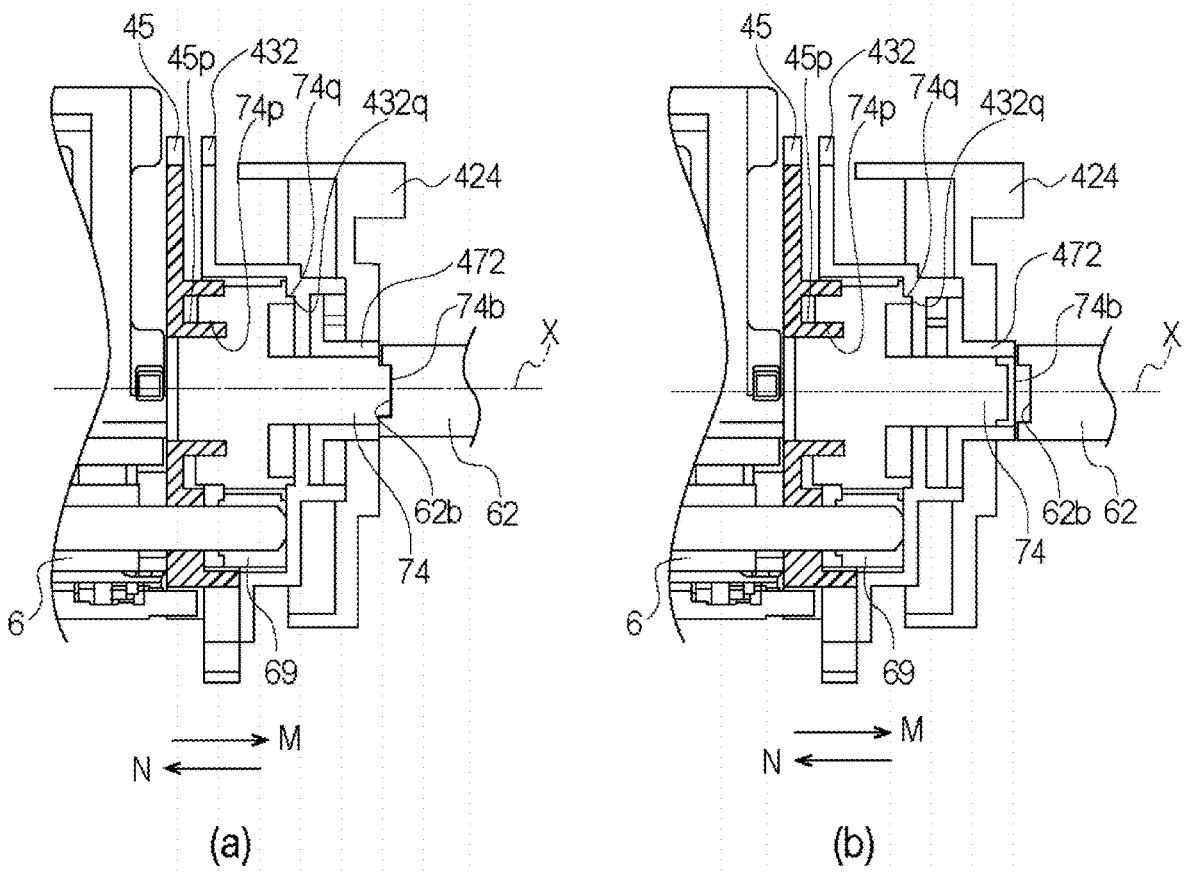

Parts (a) and (b) of FIG. 48 are schematic sectional views of and adjacent the cartridge side drive transmission member according to the fifth embodiment, in which (a) shows a drive transmission state, and (b) shows a drive disconnection state.

Figure 49:
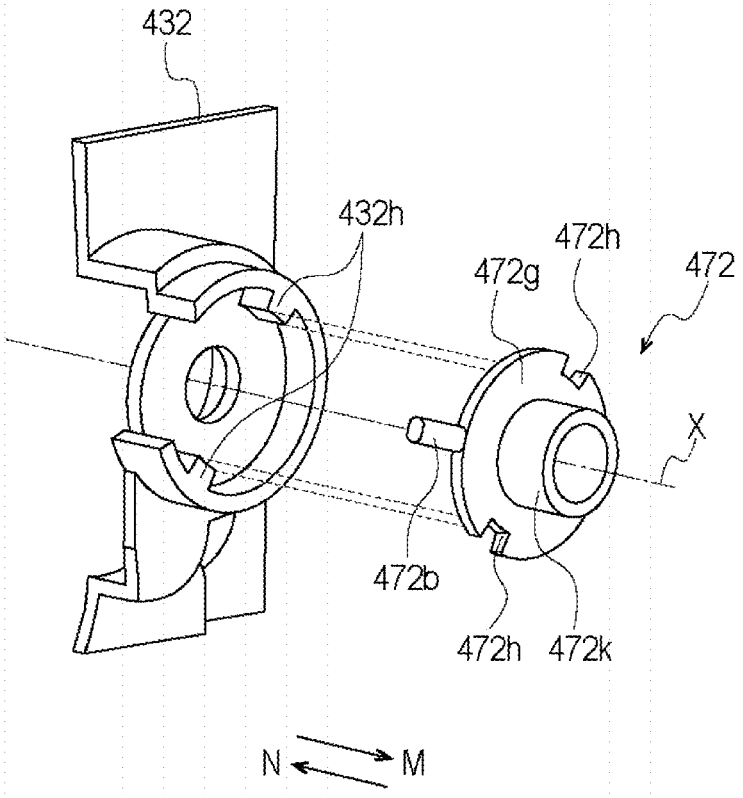

FIG. 49 is schematic exploded views of a release cam and a developing device covering member in the fifth embodiment.

Figure 50:
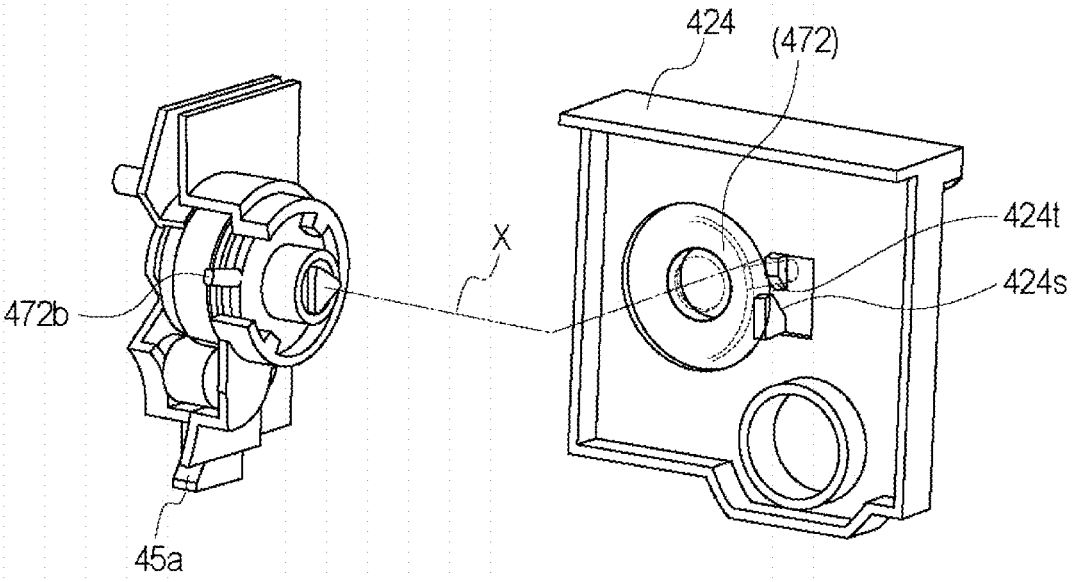

FIG. 50 is a schematic view of the cartridge side drive transmission member and releasing member, a peripheral parts thereof, and a driving side cartridge cover member, in the fifth embodiment.

Figure 51:
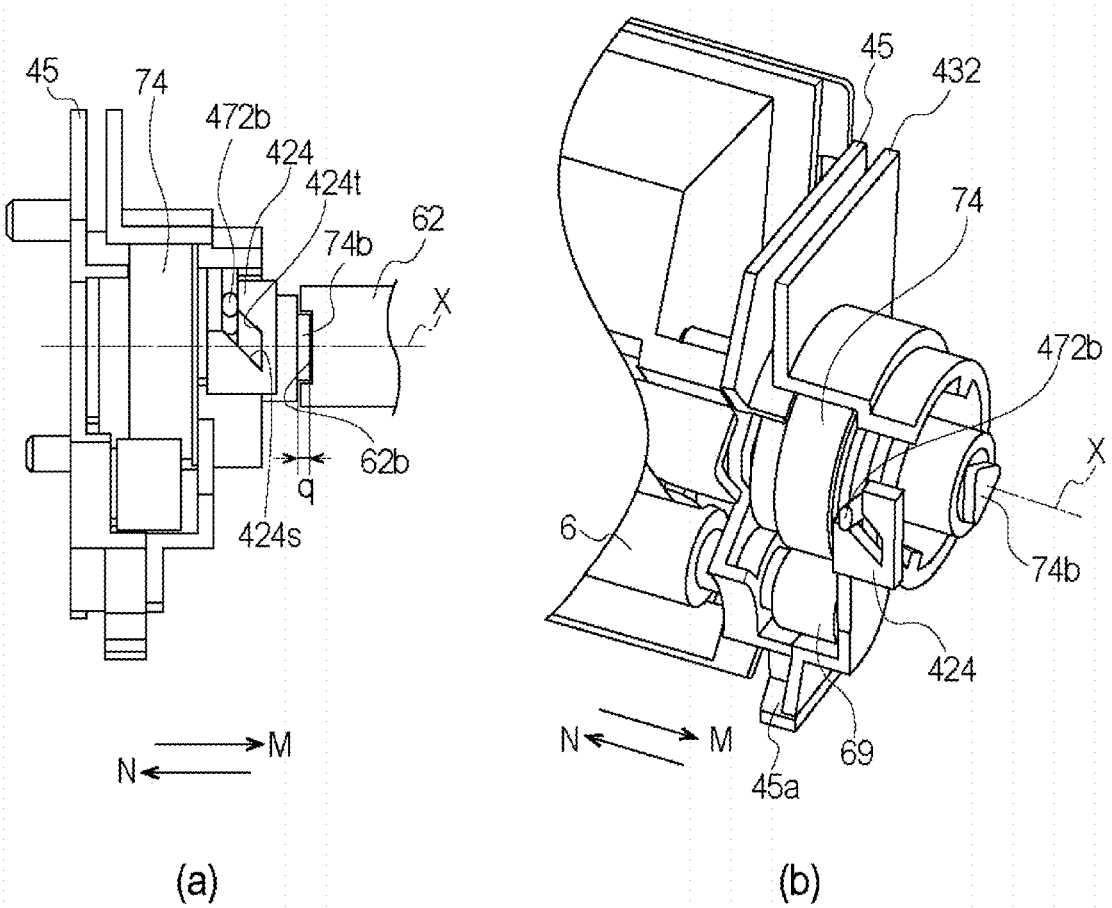

Parts (a) and (b) of FIG. 51 are schematic views of and adjacent the cartridge side drive transmission member in the contact and drive transmission state in the fifth embodiment, in which (a) is a schematic sectional view of the drive connecting portion, and (b) is a perspective view of the drive connecting portion.

Figure 52:
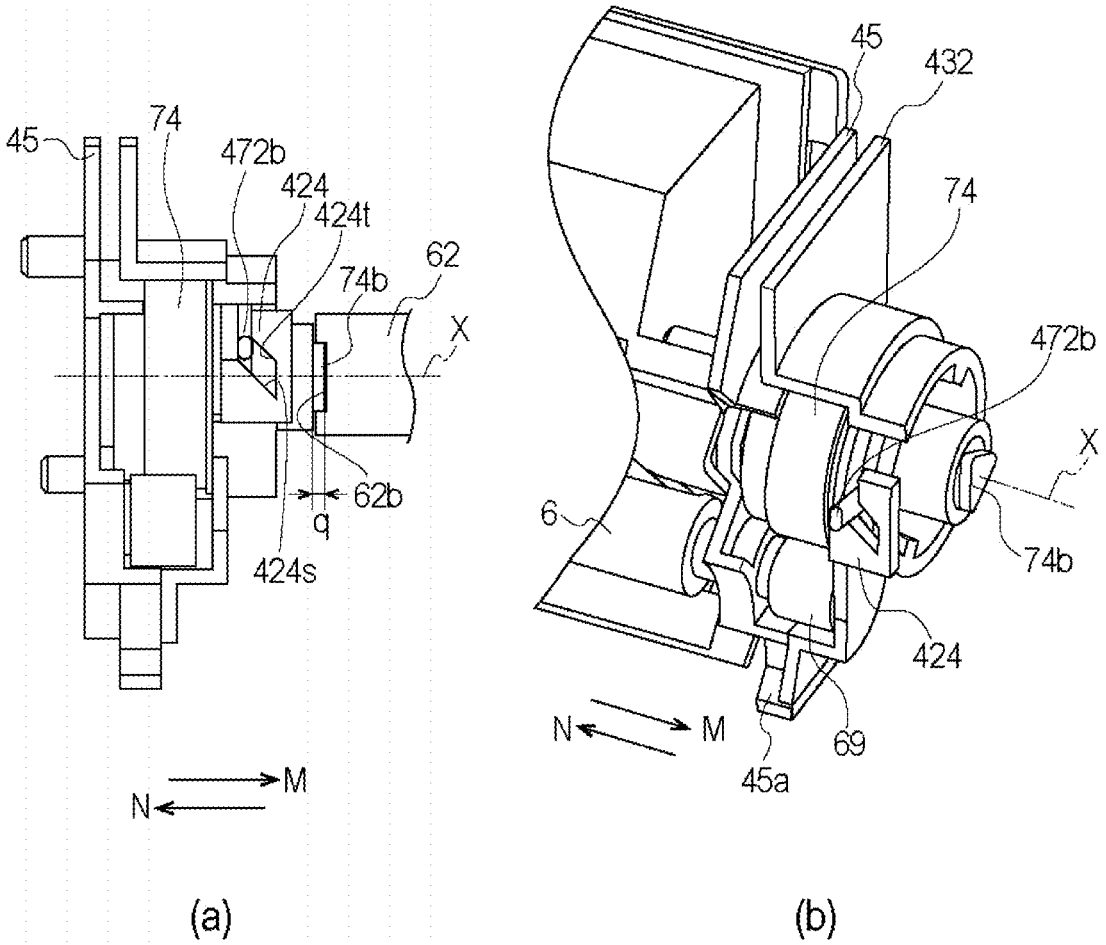

Parts (a) and (b) of FIG. 52 are schematic views of and adjacent the cartridge side drive transmission member in the developing device separation and drive transmission state in the fifth embodiment, in which (a) is a schematic sectional view of the drive connecting portion, and (b) is a perspective view of the drive connecting portion.

Figure 53:
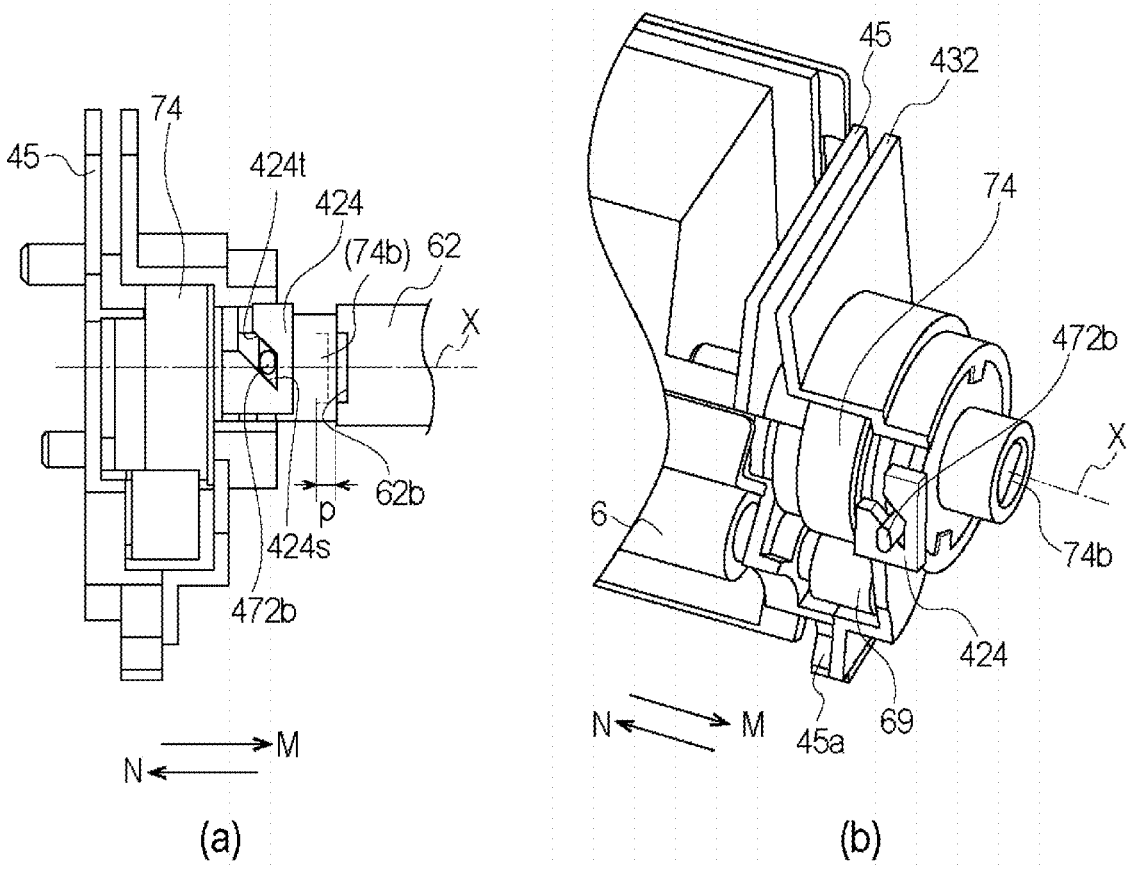

Parts (a) and (b) of FIG. 53 are schematic views of and adjacent the cartridge side drive transmission member in the developing device separation and drive disconnection state in the fifth embodiment, in which (a) is a schematic sectional view of the drive connecting portion, and (b) is a perspective view of the drive connecting portion.

Figure 54:
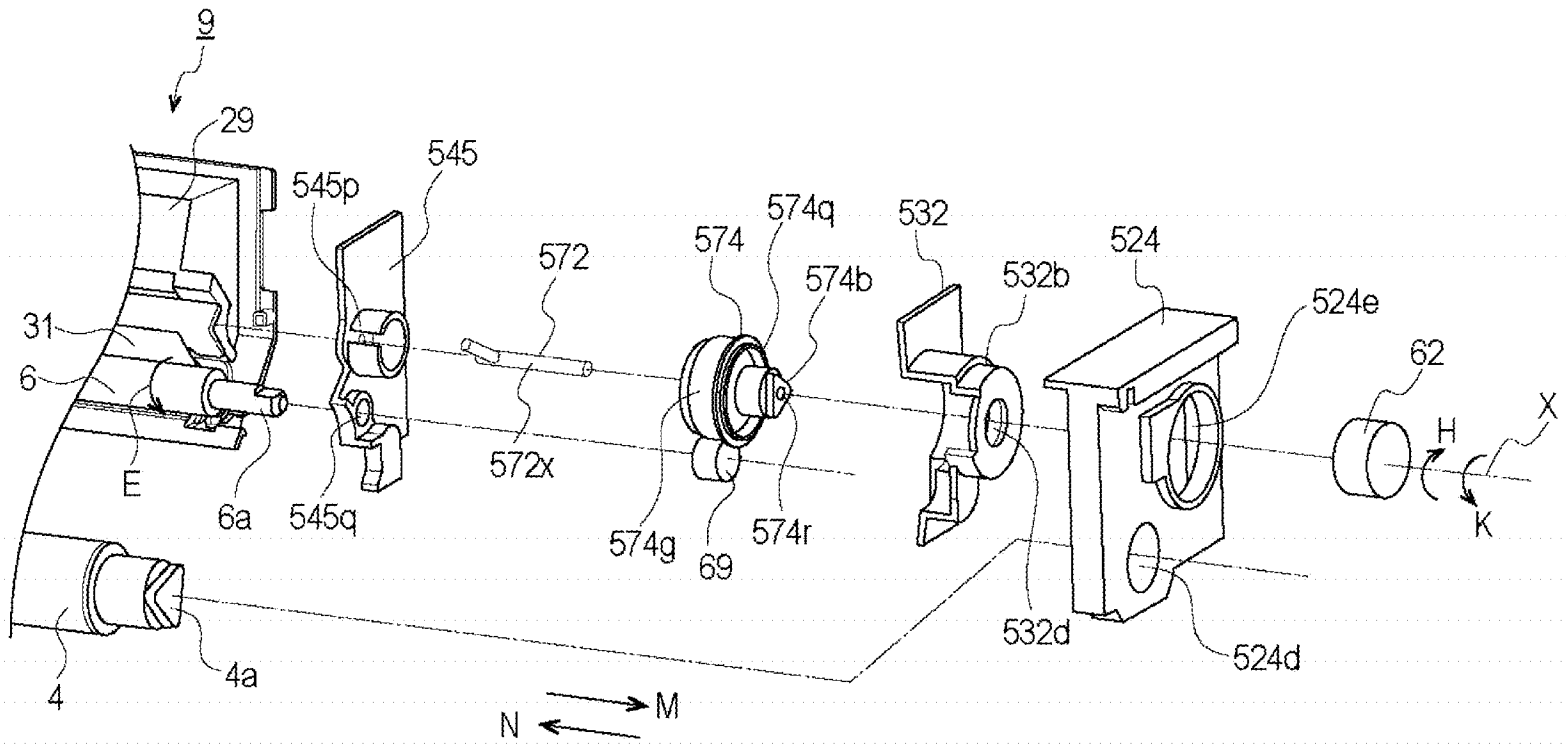

FIG. 54 is an exploded perspective view of and adjacent a drive connecting portion of a process cartridge according to a sixth embodiment, as seen from a driving side.

Figure 55:
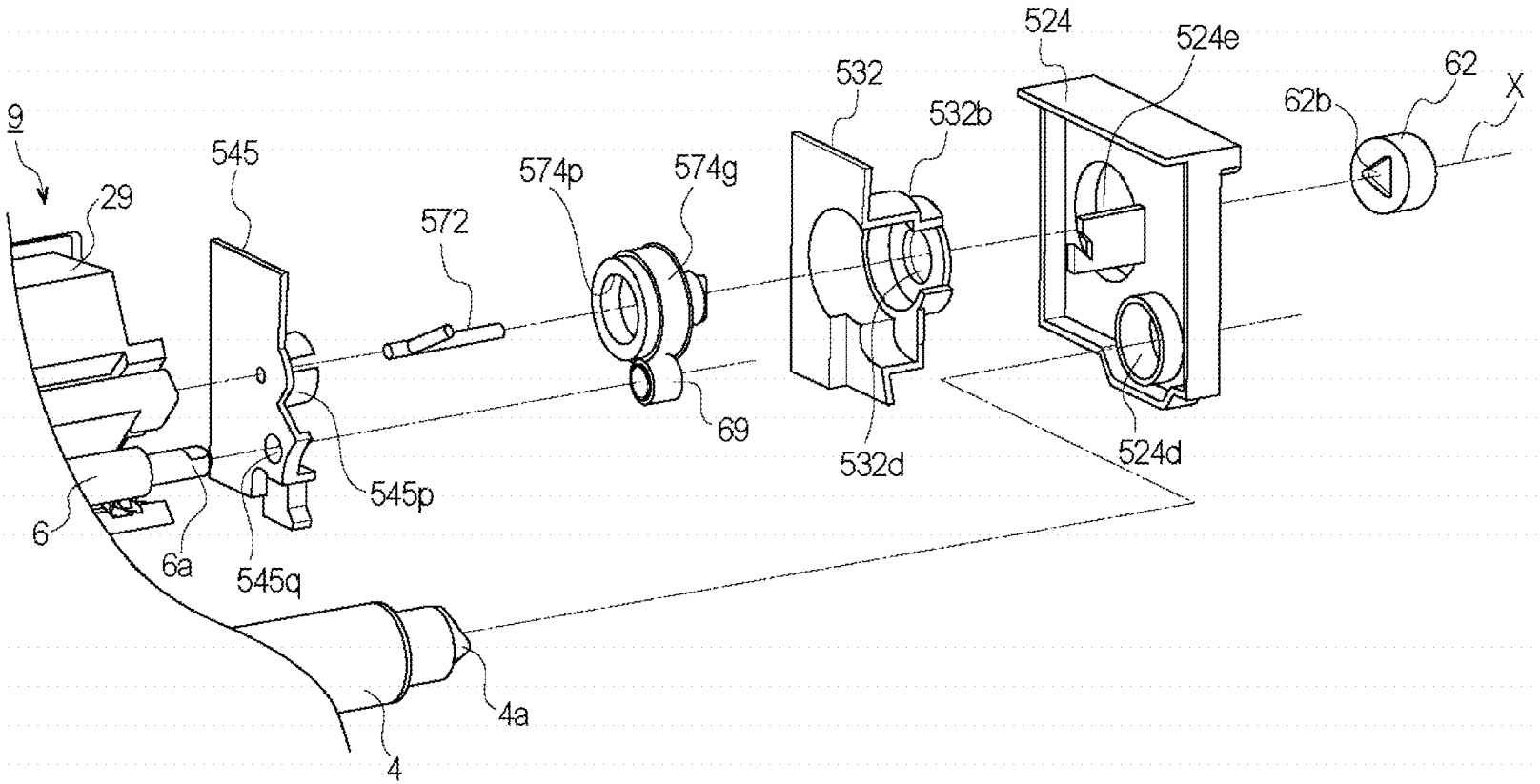

FIG. 55 is an exploded perspective view of and adjacent the drive connecting portion of the process cartridge according to the sixth embodiment, as seen from a non-driving side.

Figure 56:
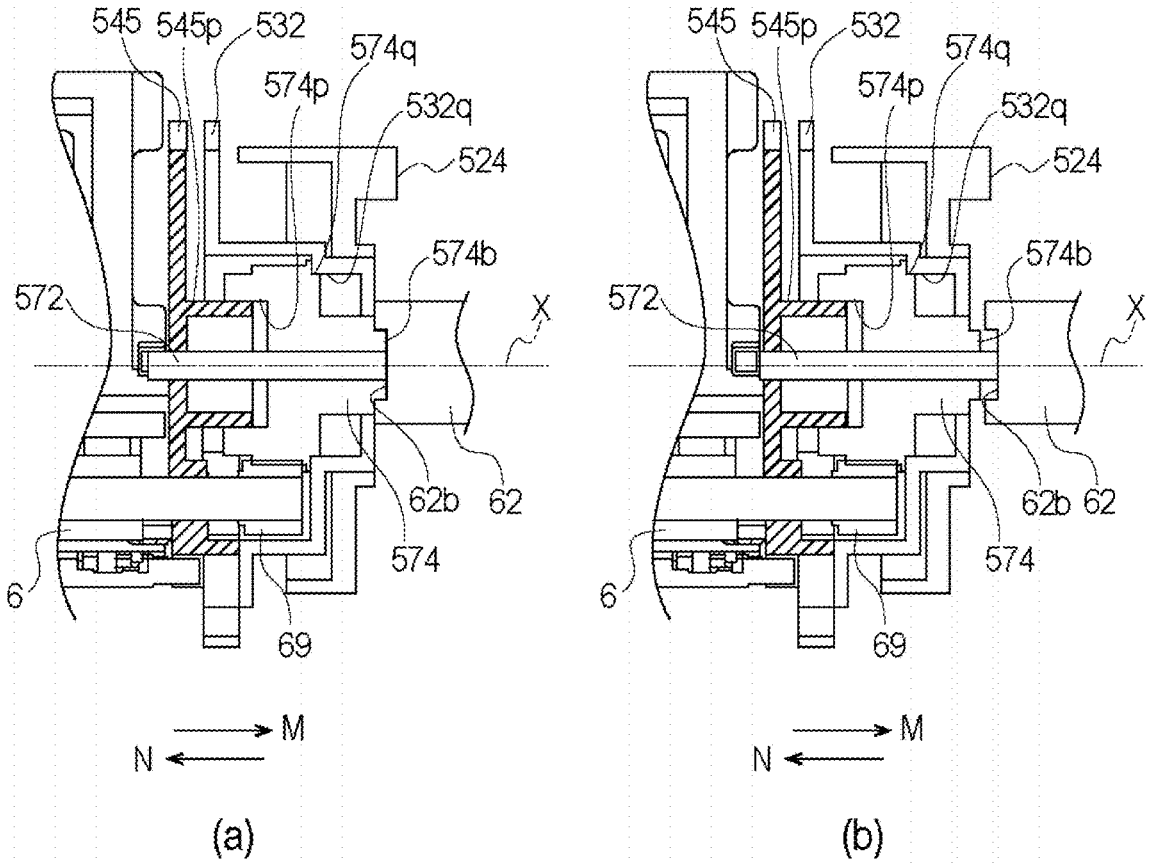

Parts (a) and (b) of FIG. 56 are schematic sectional views of and adjacent the cartridge side drive transmission member according to the sixth embodiment, in which (a) shows a drive transmission state, and (b) shows a drive disconnection state.

Figure 57:
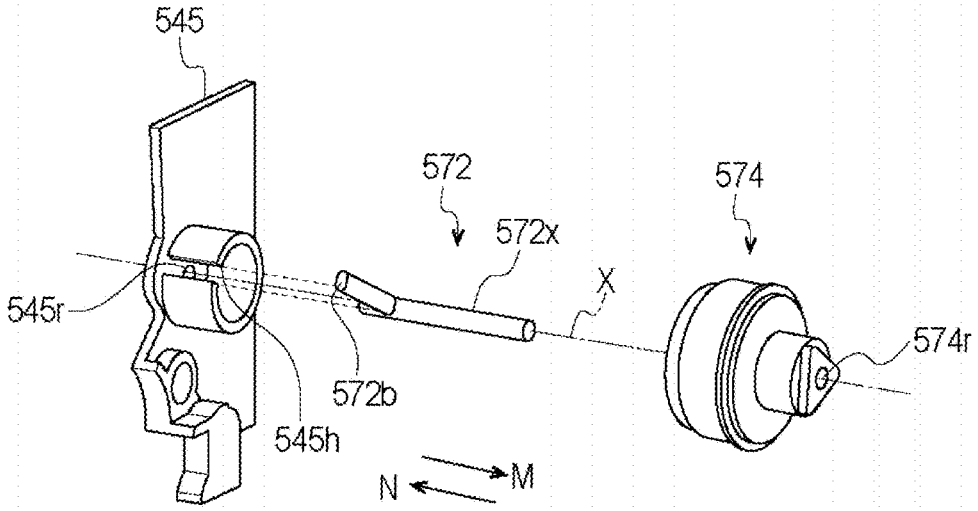

FIG. 57 is a schematic exploded view of a bearing member, a releasing member and a drive input member in the sixth embodiment.

Figure 58:
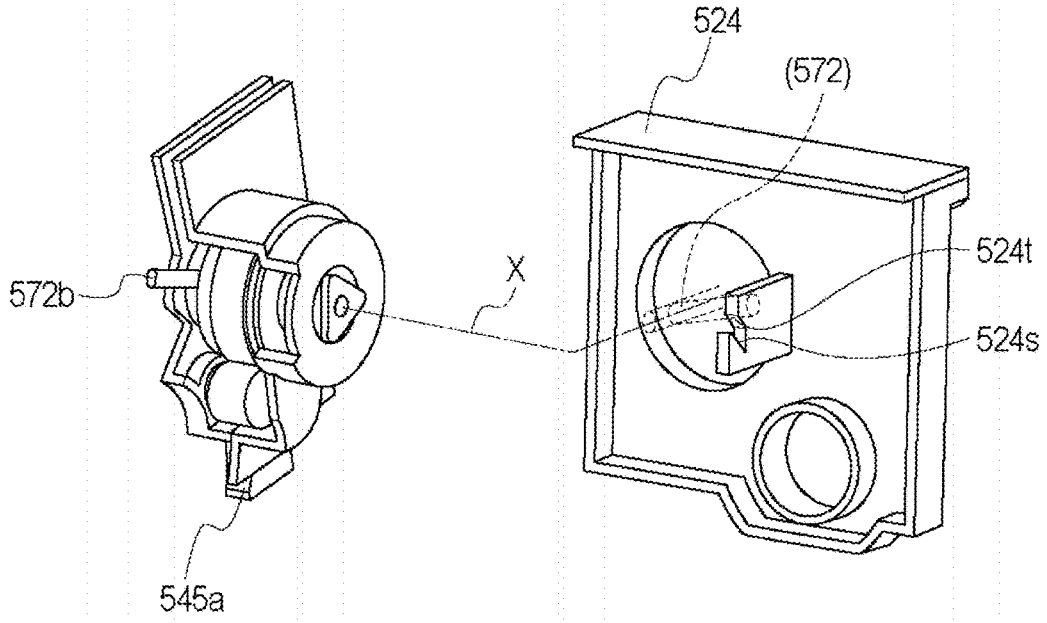

FIG. 58 is a schematic view of the cartridge side drive transmission member and releasing member, a peripheral parts thereof, and a driving side cartridge cover member, in the sixth embodiment.

Figure 59:
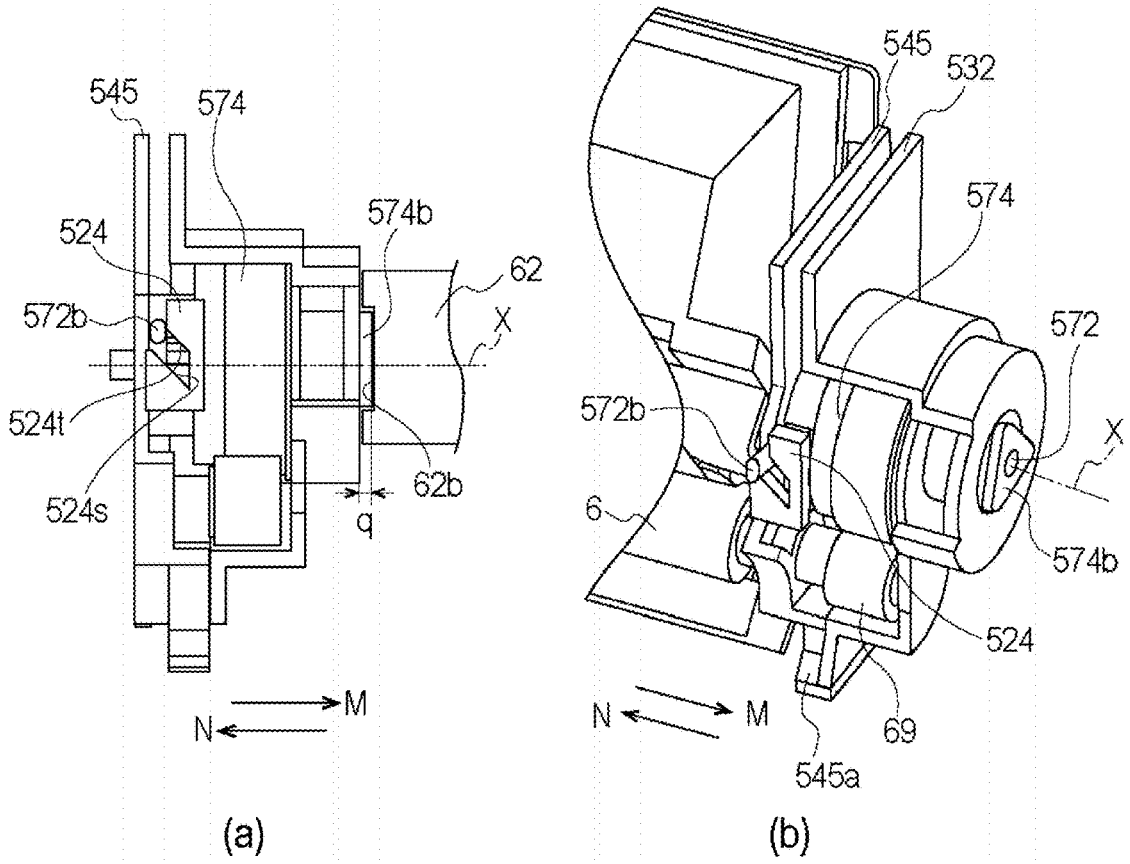

Parts (a) and (b) of FIG. 59 are schematic views of and adjacent the cartridge side drive transmission member in the contact and drive transmission state in the sixth embodiment, in which (a) is a schematic sectional view of the drive connecting portion, and (b) is a perspective view of the drive connecting portion.

Figure 60:
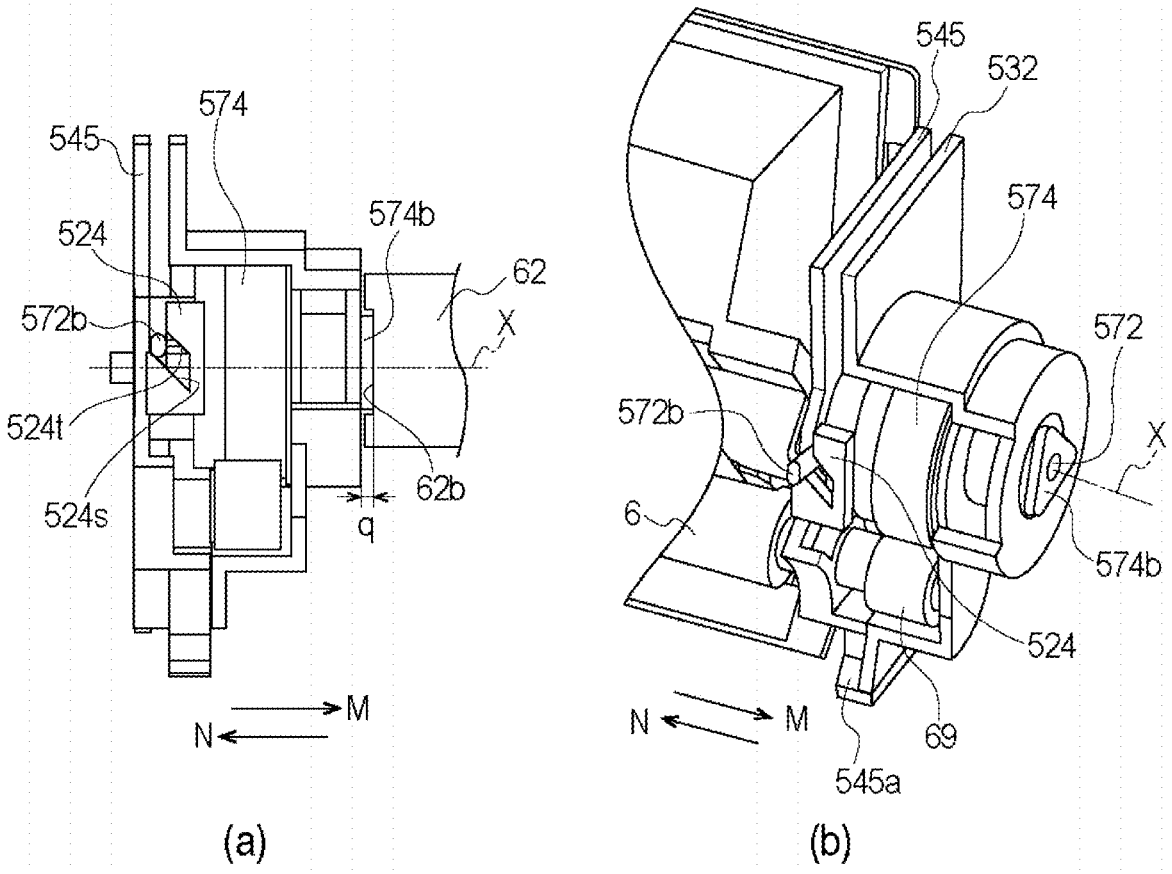

Parts (a) and (b) of FIG. 60 are schematic views of and adjacent the cartridge side drive transmission member in the developing device separation and drive transmission state in the sixth embodiment, in which (a) is a schematic sectional view of the drive connecting portion, and (b) is a perspective view of the drive connecting portion.

Figure 61:
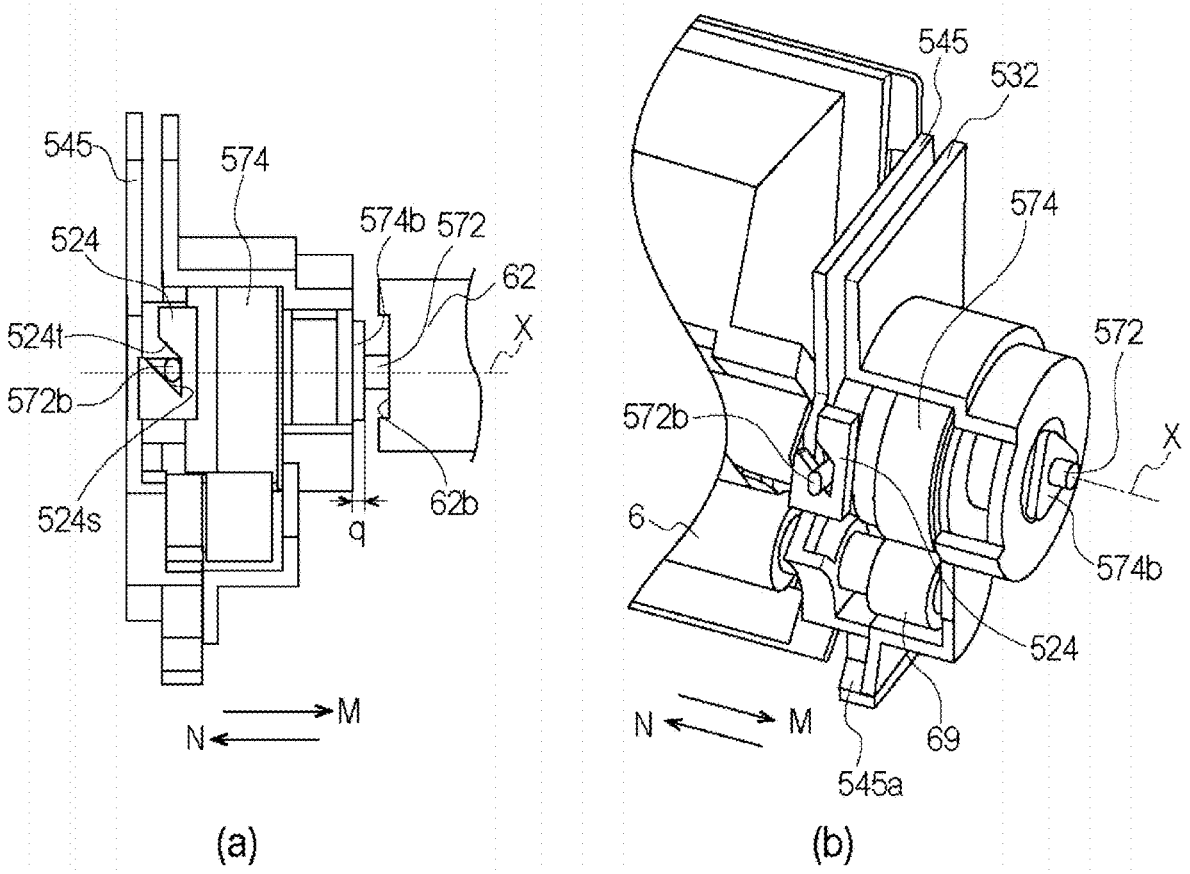

Parts (a) and (b) of FIG. 61 are schematic views of and adjacent the cartridge side drive transmission member in the developing device separation and drive disconnection state in the sixth embodiment, in which (a) is a schematic sectional view of the drive connecting portion, and (b) is a perspective view of the drive connecting portion.

Figure 62:
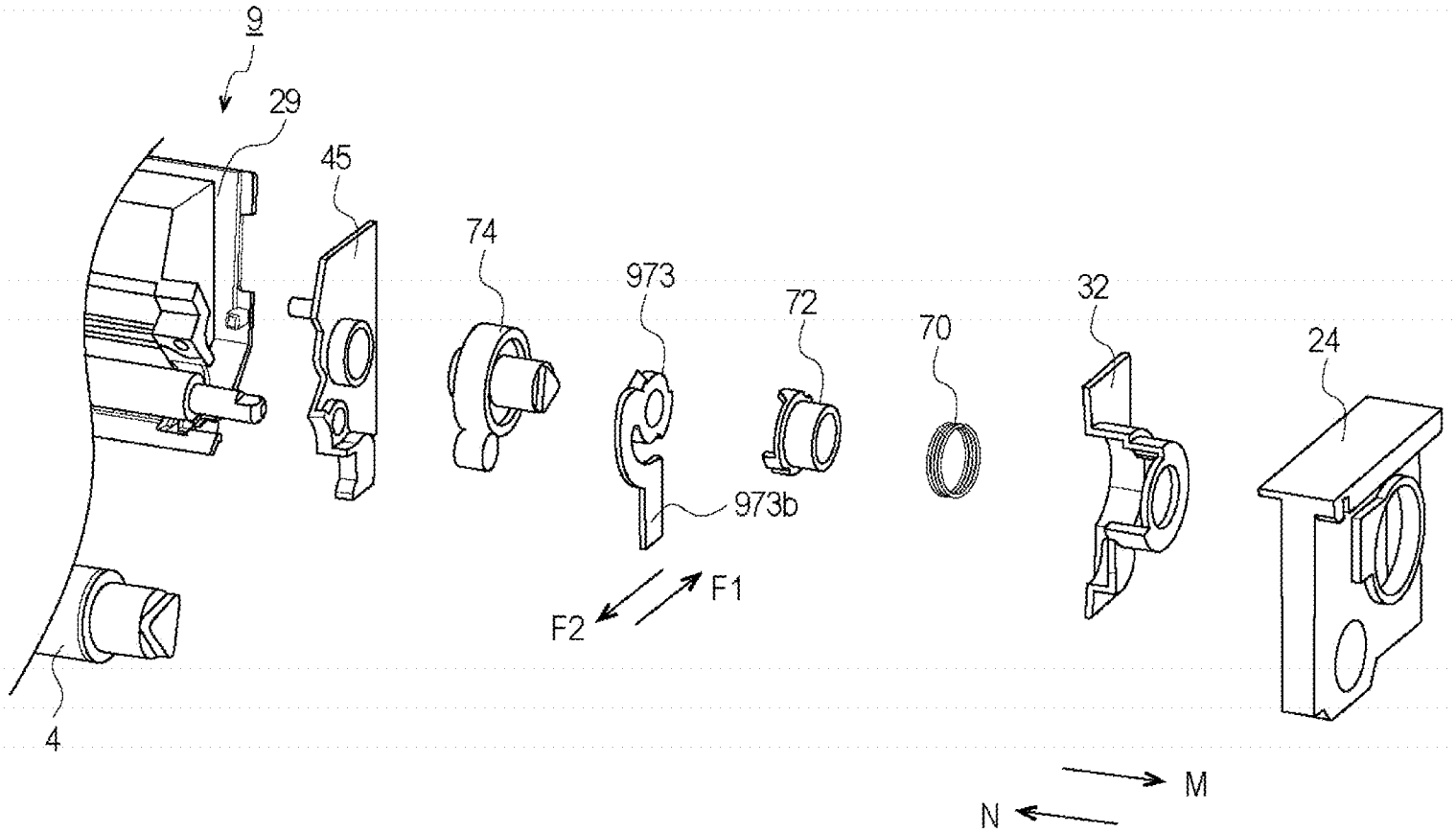

FIG. 62 is an exploded perspective view of a drive connecting portion of a process cartridge according to a seventh embodiment.

Figure 63:
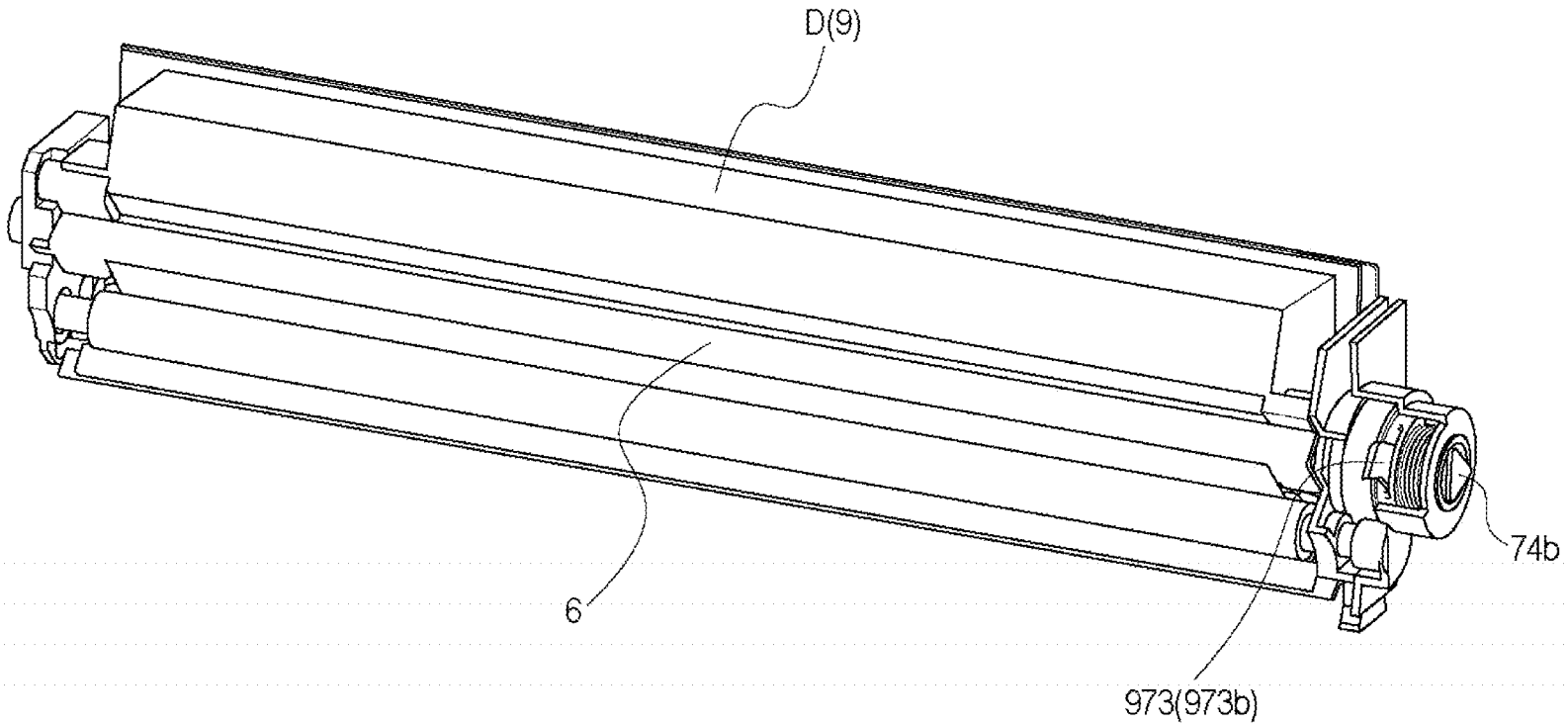

FIG. 63 is a perspective view of a developing cartridge according to an eighth embodiment.

DESCRIPTION OF THE EMBODIMENTS

Embodiment 1

[General Arrangement of Electrophotographic Image Forming Apparatus]

A first embodiment of the present invention will be described referring to the accompanying drawing.

The example of the image forming apparatuses of the following embodiments is a full-color image forming apparatus to which four process cartridges are detachably mountable. The number of the process cartridges mountable to the image forming apparatus is not limited to this example. It is properly selected as desired. For example, in the case of a monochromatic image forming apparatus, the number of the process cartridges mounted to the image forming apparatus is one. The examples of the image forming apparatuses of the following embodiments are printers.

[General Arrangement of the Image Forming Apparatus]

Figure 2:
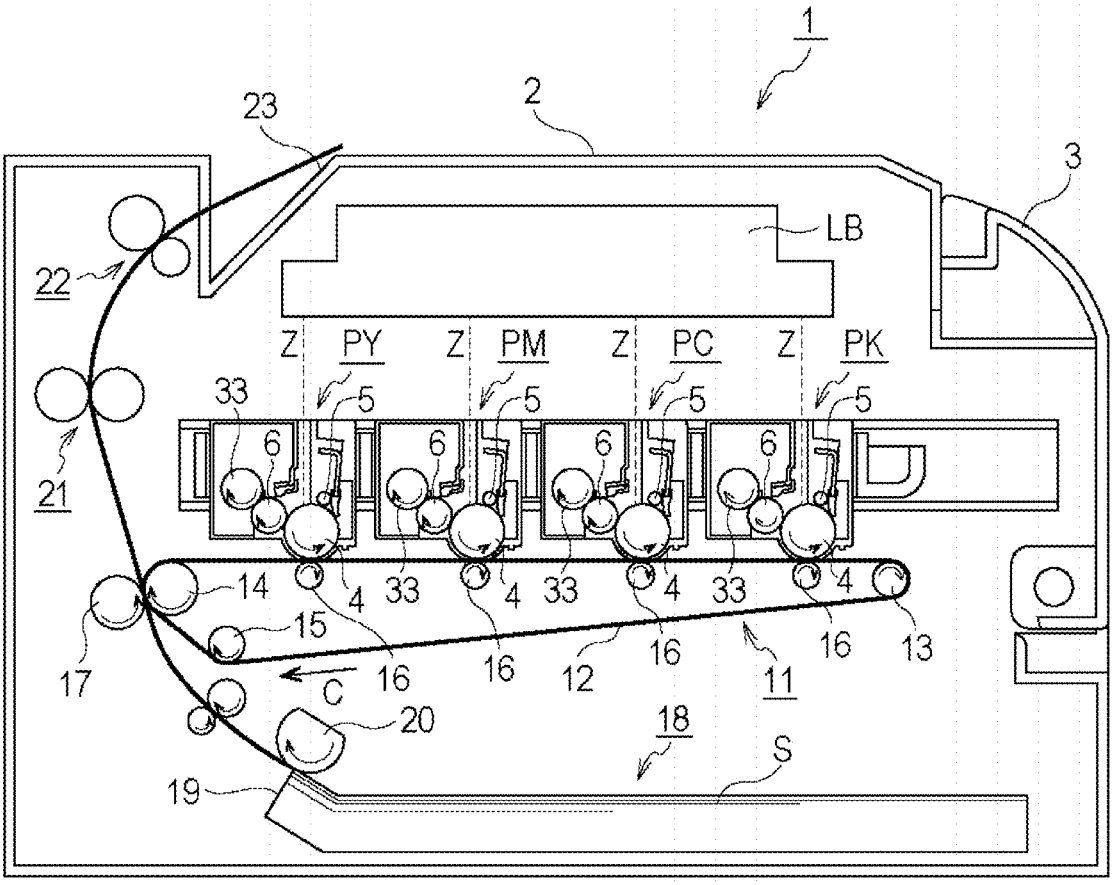
FIG. 2 is a sectional view of an image forming apparatus according to the first embodiment.
Figure 3:
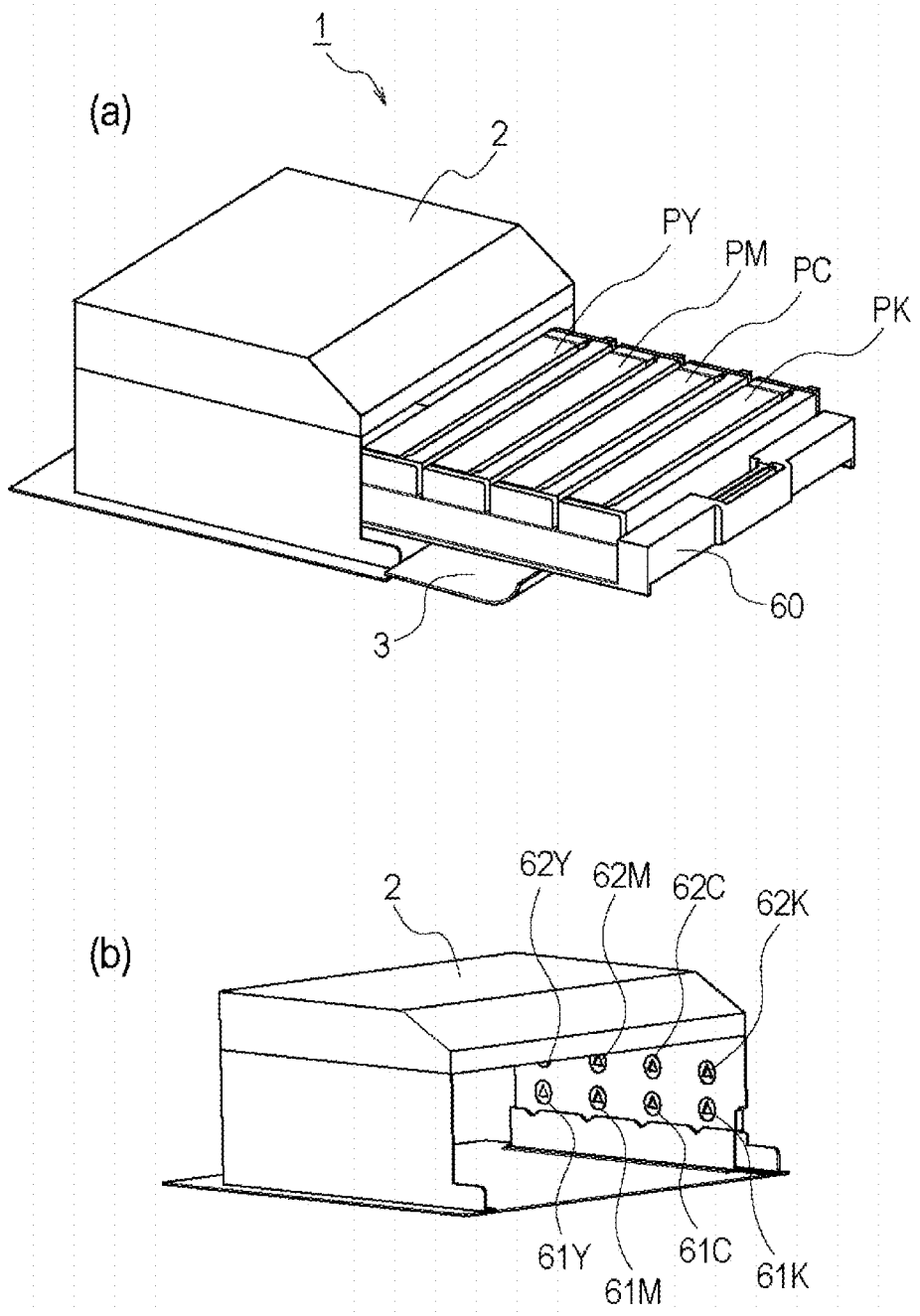
FIG. 3 is a perspective view of the image forming apparatus according to the first embodiment.
Figure 4:
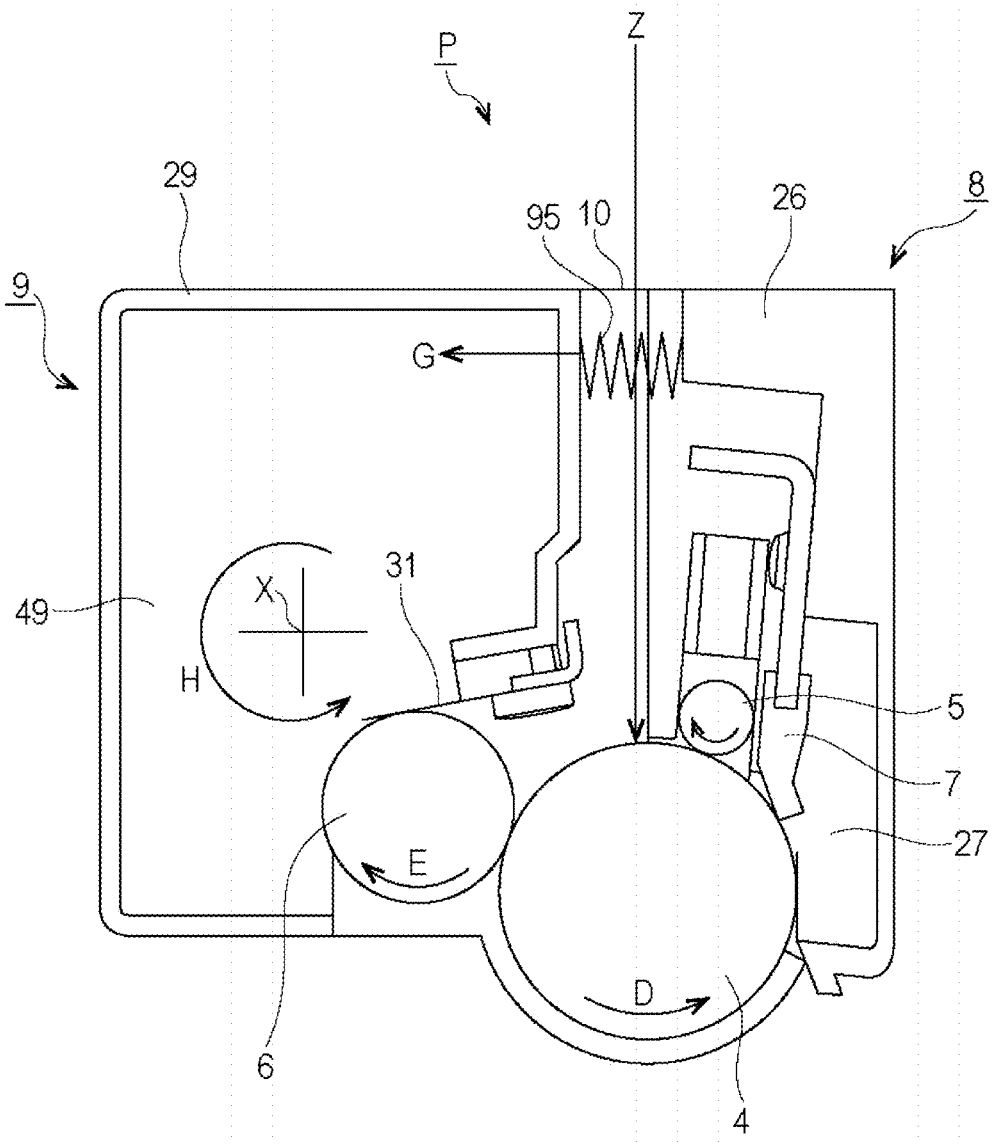
FIG. 4 is a sectional view of the process cartridge according to the first embodiment.
Figure 5:
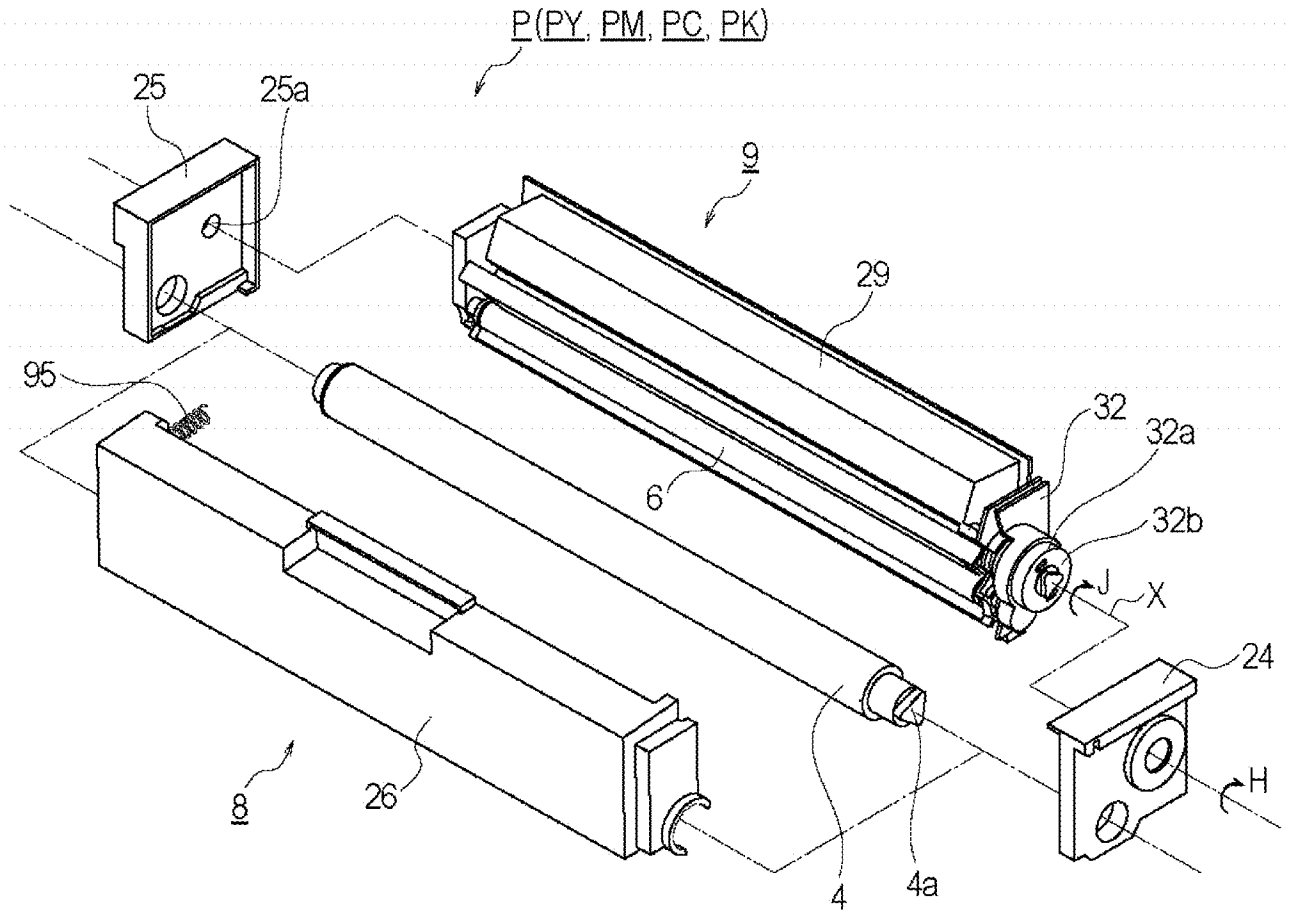
FIG. 5 is an exploded perspective view of the process cartridge according to the first embodiment, as seen from the driving side.
Figure 6:
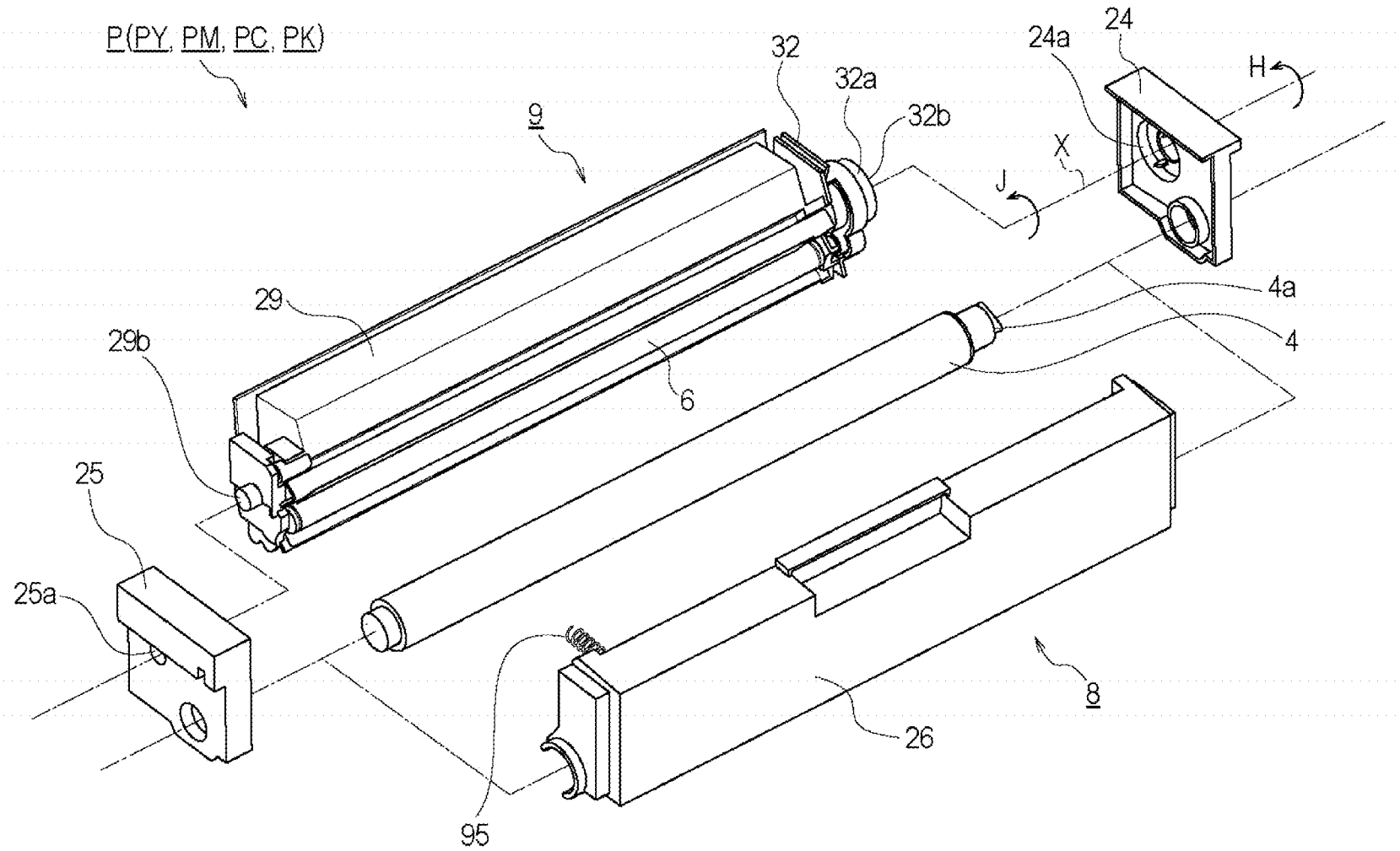
FIG. 6 is an exploded perspective view of the process cartridge according to the first embodiment, as seen from a non-driving side.

FIG. 2 is a schematic section of the electrophotographic image forming apparatus of this embodiment, which can form an image on a recording material. Part (a) of FIG. 3 is a perspective view of the image forming apparatus of this embodiment. FIG. 4 is a sectional view of a process cartridge P of this embodiment. FIG. 5 is a perspective view of the process cartridge P of this embodiment as seen from a driving side, and FIG. 6 is a perspective view of the process cartridge P of this embodiment as seen from a non-driving side.

As shown in FIG. 2, the image forming apparatus 1 is a (four) full-color laser beam printer using an electrophotographic image forming process for forming a color image on a recording material S. The image forming apparatus 1 is of a process cartridge type, in which the process cartridges are dismountably mounted to a main assembly 2 of the electrophotographic image forming apparatus to form the color image on the recording material S. The process cartridge is a cartridge for electrophotographic image formation.

Here, a side of the image forming apparatus 1 that is provided with a front door 3 is a front side, and a side opposite from the front side is a rear side. In addition, a right side of the image forming apparatus 1 as seen from the front side is a driving side, and a left side is a non-driving side. FIG. 2 is a sectional view of the image forming apparatus 1 as seen from the non-driving side, in which a front side of the sheet of the drawing is the non-driving side of the image forming apparatus 1, the right side of the sheet of the drawing is the front side of the image forming apparatus 1, and the rear side of the sheet of the drawing is the driving side of the image forming apparatus 1.

In the main assembly 2 of the image forming apparatus, there are provided process cartridges P (PY, PM, PC, PK) including a first process cartridge PY (yellow), a second process cartridge PM (magenta), a third process cartridge PC (cyan), and a fourth process cartridge PK (black), which are arranged in the horizontal direction.

The first-fourth process cartridges P (PY, PM, PC, PK) include similar electrophotographic image forming process mechanisms, although the colors of the developers contained therein are different. To the first-fourth process cartridges P (PY, PM, PC, PK), rotational forces are transmitted from drive outputting portions of the main assembly 2 of the image forming apparatus. This will be described in detail hereinafter.

In addition, the first-fourth each process cartridges P (PY, PM, PC, PK) are supplied with bias voltages (charging bias voltages, developing bias voltages and so on) (unshown), from the main assembly 2 of the image forming apparatus.

As shown in FIG. 4, each of the first-fourth process cartridges P (PY, PM, PC, PK) includes a photosensitive drum unit 8. The photosensitive drum unit 8 is provided with a drum (photosensitive drum) 4, a charging means and a cleaning means as process means actable on the drum 4.

In addition, each of the first-fourth process cartridges P (PY, PM, PC, PK) includes a developing unit 9 provided with a developing means for developing an electrostatic latent image on the drum 4.

The first process cartridge PY accommodates a yellow (Y) developer in a developing device frame 29 thereof to form a yellow color developer image on the surface of the drum 4. Thus, the drum 4 is an image bearing member for carrying a developed image (toner image).

The second process cartridge PM accommodates a magenta (M) developer in the developing device frame 29 thereof to form a magenta color developer image on the surface of the drum 4.

The third process cartridge PC accommodates a cyan (C) developer in the developing device frame 29 thereof to form a cyan color developer image on the surface of the drum 4.

The fourth process cartridge PK accommodates a black (K) developer in the developing device frame 29 thereof to form a black color developer image on the surface of the drum 4.

Above the first-fourth process cartridges P (PY, PM, PC, PK), there is provided a laser scanner unit LB as an exposure means. The laser scanner unit LB outputs a laser beam in accordance with image information. The laser beam Z is scanningly projected onto the surface of the drum 4 through an exposure window 10 of the cartridge P.

Below the first-fourth cartridges P (PY, PM, PC, PK), there is provided an intermediary transfer belt unit 11 as a transfer member. The intermediary transfer belt unit 11 includes a driving roller 13, tension rollers 14 and 15, around which a transfer belt 12 having flexibility is extended.

The drum 4 of each of the first-fourth cartridges P (PY, PM, PC, PK) contacts, at the bottom surface portion, an upper surface of the transfer belt 12. The contact portion is a primary transfer portion. Inside the transfer belt 12, there is provided a primary transfer roller 16 opposed to the drum 4.

In addition, there is provided a secondary transfer roller 17 at a position opposed to the tension roller 14 with the transfer belt 12 interposed therebetween. The contact portion between the transfer belt 12 and the secondary transfer roller 17 is a secondary transfer portion.

Below the intermediary transfer belt unit 11, a feeding unit 18 is provided. The feeding unit 18 includes a sheet feeding tray 19 accommodating a stack of recording materials S, and a sheet feeding roller 20.

Below an upper left portion in the main assembly 2 of the apparatus in FIG. 2, a fixing unit 21 and a discharging unit 22 are provided. An upper surface of the main assembly 2 of the apparatus functions as a discharging tray 23.

The recording material S having a developer image transferred thereto is subjected to a fixing operation by a fixing means provided in the fixing unit 21, and thereafter, it is discharged to the discharging tray 23.

The cartridge P is detachably mountable to the main assembly 2 of the apparatus through a drawable cartridge tray 60. Part (a) of FIG. 3 shows a state in which the cartridge tray 60 and the cartridges P are drawn out of the main assembly 2 of the apparatus.

[Image Forming Operation]

Operations for forming a full-color image will be described.

The drums 4 of the first-fourth cartridges P (PY, PM, PC, PK) are rotated at a predetermined speed (counterclockwise direction in FIG. 2, a direction indicated by arrow D in FIG. 4). The transfer belt 12 is also rotated at the speed corresponding to the speed of the drum 4 codirectionally with the rotation of the drums (the direction indicated by an arrow C in FIG. 2). Also, the laser scanner unit LB is driven. In synchronism with the drive of the scanner unit LB, the surface of the drums 4 are charged by the charging rollers 5 to a predetermined polarity and potential uniformly. The laser scanner unit LB scans and exposes the surfaces of the drums 4 with the laser beams Z in accordance with the image signal off the respective colors. By this, the electrostatic latent images are formed on the surfaces of the drums 4 in accordance with the corresponding color image signal, respectively. The electrostatic latent images are developed by the respective developing rollers 6 rotated at a predetermined speed (clockwisely in FIG. 2, the direction indicated by an arrow E in FIG. 4). The developing roller 6 is a developer carrying member for carrying the developer (toner) to develop a latent image on the drum 4.

Through such an electrophotographic image forming process operation, a yellow color developer image corresponding to the yellow component of the full-color image is formed on the drum 4 of the first cartridge PY. Then, the developer image is transferred (primary transfer) onto the transfer belt 12.

Similarly, a magenta developer image corresponding to the magenta component of the full-color image is formed on the drum 4 of the second cartridge PM. The developer image is transferred (primary transfer) superimposedly onto the yellow color developer image already transferred onto the transfer belt 12.

Similarly, a cyan developer image corresponding to the cyan component of the full-color image is formed on the drum 4 of the third cartridge PC. Then, the developer image is transferred (primary transfer) superimposedly onto the yellow color and magenta color developer images already transferred onto the transfer belt 12.

Similarly, a black developer image corresponding to the black component of the full-color image is formed on the drum 4 of the fourth cartridge PK. Then, the developer image is transferred (primary transfer) superimposedly on the yellow color, magenta color and cyan color developer images already transferred onto the transfer belt 12.

In this manner, a (four) full-color comprising yellow color, magenta color, cyan color and black color is formed on the transfer belt 12 (unfixed developer image).

On the other hand, a recording material S is singled out and fed at predetermined control timing. The recording material S is introduced at predetermined control timing to the secondary transfer portion which is the contact portion between the secondary transfer roller 17 and the transfer belt 12. The recording material S is introduced at predetermined control timing to the secondary transfer portion which is the contact portion between the secondary transfer roller 17 and the transfer belt 12. By this, the four color superimposed developer image is all together transferred sequentially onto the surface of the recording material S from the transfer belt 12 while the recording material S is being fed to the secondary transfer portion.

[General Arrangement of the Process Cartridge]

The structure of the process cartridge for electrophotographic image formation will be described. In this embodiment, the first-fourth cartridges P (PY, PM, PC, PK) have similar electrophotographic image forming process mechanisms, although the colors and/or the filled amounts of the developers accommodated therein are different.

The cartridge P is provided with the drum 4 as the photosensitive member, and the process means actable on the drum 4. The process means includes the charging roller 5 as the charging means for charging the drum 4, a developing roller 6 as the developing means for developing the latent image formed on the drum 4, a cleaning blade 7 as the cleaning means for removing a residual developer remaining on the surface of the drum 4, and so on. The cartridge P is divided into the drum unit 8 and the developing unit 9.

[Structure of the Drum Unit]

As shown in FIGS. 4, 5 and 6, the drum unit 8 comprises the drum 4 as the photosensitive member, the charging roller 5, the cleaning blade 7, a cleaner container 26 as a photosensitive member frame, a residual developer accommodating portion 27, cartridge cover members (a cartridge cover member 24 in the driving side, and a cartridge cover member 25 in the non-driving side in FIGS. 5 and 6). The photosensitive member frame in a broad sense comprises the cleaner container 26 which is the photosensitive member frame in a narrow sense, and the residual developer accommodating portion 27, the driving side cartridge cover member 24, the non-driving side cartridge cover member 25 as well (this applies to the embodiments described hereinafter). The photosensitive member frame is a frame for rotatably supporting the photosensitive drum 4. When the cartridge P is mounted to the main assembly 2 of the apparatus, the photosensitive member frame is fixed to the main assembly 2 of the apparatus.

The drum 4 is rotatably supported by the cartridge cover members 24 and 25 provided at the longitudinal opposite end portions of the cartridge P. Here, an axial direction of the drum 4 is the longitudinal direction.

The cartridge cover members 24 and 25 are fixed to the cleaner container 26 at the opposite longitudinal end portions of the cleaner container 26.

As shown in FIG. 5, a coupling member or a drive inputting portion (photosensitive member drive transmitting portion) 4*a* for transmitting a driving force to the drum 4 is provided at one longitudinal end portion of the drum 4. Part (b) of FIG. 3 is a perspective view of the main assembly 2 of the apparatus, in which the cartridge tray 60 and the cartridge P are not shown. The coupling members 4*a* of the cartridges P (PY, PM, PC, PK) are engaged with drum-driving-force-outputting members 61 (61Y, 61M, 61C, 61K) as main assembly side drive transmission members of the main assembly of the apparatus 2 shown in part (b) of FIG. 3 so that the driving force of a driving motor (unshown) of the main assembly of the apparatus is transmitted to the drums 4.

The charging roller 5 is supported by the cleaner container 26 and is contacted to the drum 4 so as to be driven thereby.

The cleaning blade 7 is supported by the cleaner container 26 so as to be contacted to the circumferential surface of the drum 4 at a predetermined pressure.

An untransferred residual developer removed from the peripheral surface of the drum 4 by the cleaning means 7 is accommodated in the residual developer accommodating portion 27 in the cleaner container 26.

In addition, the driving side cartridge cover member 24 and the non-driving side cartridge cover member 25 are provided with supporting portions 24*a*, 25*a* as sliding portion for rotatably supporting the developing unit 9 (FIG. 6).

[Structure of the Developing Unit]

Figure 1:
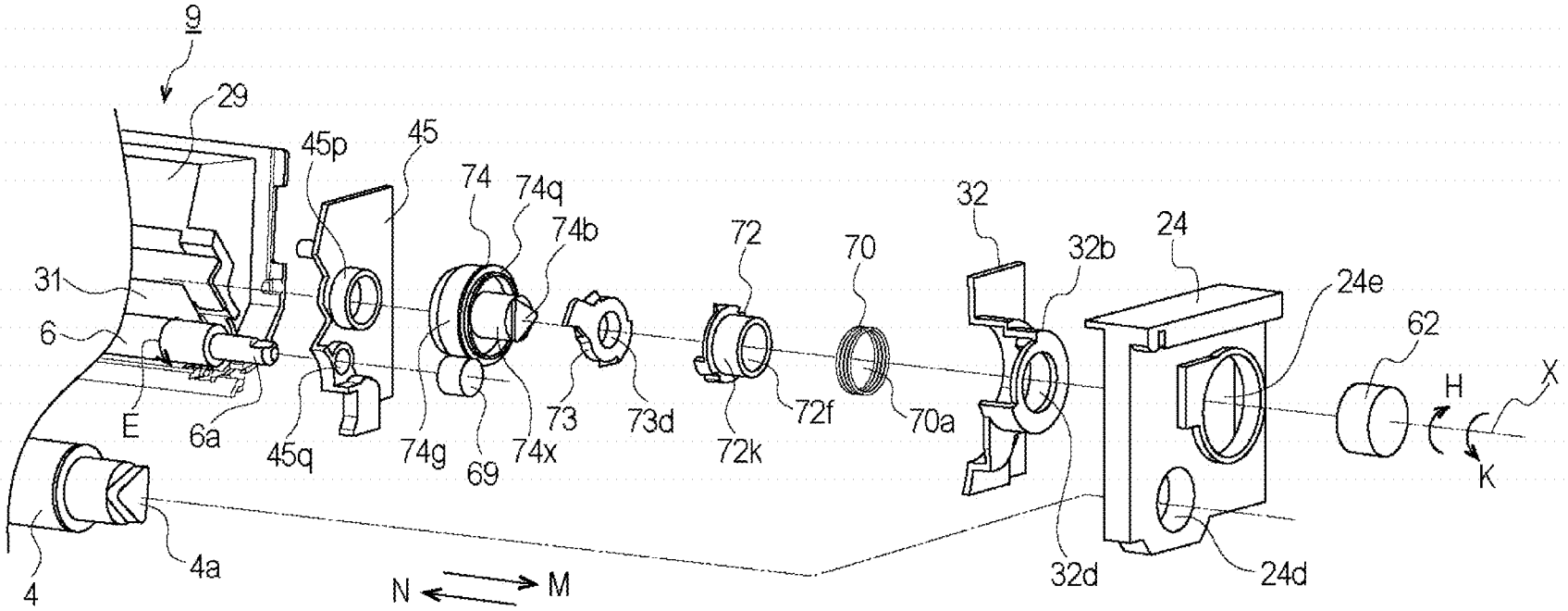
FIG. 1 is an exploded perspective view of a structure of and adjacent a drive connecting portion of a process cartridge according to a first embodiment, as seen from a driving side.

As shown in FIGS. 1 and 8, the developing unit 9 comprises the developing roller 6, a developing blade 31, the developing device frame 29, a bearing member 45, a developing device covering member 32 and so on. The developing device frame in a broad sense comprises the bearing member 45 and the developing device covering member 32 and so on as well as the developing device frame 29 (this applies to the embodiments which will be described hereinafter). The developing device frame is a frame rotatably supporting the developing roller. When the cartridge P is mounted to the main assembly 2 of the apparatus, the developing device frame 29 is movable relative to the main assembly 2 of the apparatus.

The cartridge frame (frame of cartridge P) in a broad sense comprises the photosensitive member frame in the above-described broad sense and the developing device frame in the above-described broad sense (the same applies to the embodiments which will be described hereinafter).

The developing device frame 29 includes the developer accommodating portion 49 (FIG. 4) accommodating the developer to be supplied to the developing roller 6, and the developing blade 31 for regulating a layer thickness of the developer on the peripheral surface of the developing roller 6.

In addition, as shown in FIG. 1, the bearing member 45 is fixed to one longitudinal end portion of the developing device frame 29. The bearing member 45 rotatably supports the developing roller 6. The developing roller 6 is provided with a developing roller gear 69 as a developing roller drive transmission member at a longitudinal end portion. The developing roller gear 69 is a member (gear) for transmitting the driving force to the developing roller 6, and the outer periphery thereof is formed into a gear portion for receiving the driving force.

The bearing member 45 also rotatably supports the cartridge side drive transmission member (drive input member) 74 for transmitting the driving force to the developing roller gear 69. The cartridge side drive transmission member (drive input member) 74 is provided at an end portion with a drive inputting portion 74*b*. The drive inputting portion 74*b* is capable of coupling with a developing device drive output member 62 (62Y, 62M, 62C, 62K) as the main assembly side drive transmission member of the main assembly 2 shown in part (b) of FIG. 3. That is, by the coupling engagement between the cartridge side drive transmission member and the developing device drive output member, the driving force is transmitted from the driving motor (unshown) provided in the main assembly 2 to the cartridge. This will be described in detail hereinafter.

The developing device covering member 32 is fixed to an outside of the bearing member 45 with respect to the longitudinal direction of the cartridge P. The developing device covering member 32 cover is a part of the developing roller gear 69, the cartridge side drive transmission member 74 and so on.

[Assembling of the Drum Unit and the Developing Unit]

FIGS. 5 and 6 show connection between the developing unit 9 and the drum unit 8. At one longitudinal end portion side of the cartridge P, an outside circumference 32*a* of a cylindrical portion 32*b* of the developing device covering member 32 is fitted in the supporting portion 24*a* of the driving side cartridge cover member 24. In addition, at the other longitudinal end portion side of the cartridge P, a projected portion 29*b* projected from the developing device frame 29 is fitted in a supporting hole portion 25*a* of the non-driving side cartridge cover member 25. By this, the developing unit 9 is supported rotatably relative to the drum unit 8. Here, a rotational center (rotation axis) of the developing unit 9 relative to the drum unit is called "rotational center (rotation axis) X". The rotational axis X is an axis connecting the center of the supporting hole portion 24*a* and the center of the supporting hole portion 25*a*. The rotation axis X is substantially in parallel with the rotational axes of the drum 4 and the developing roller 6.

[Contact Between the Developing Roller and the Drum]

As shown in FIGS. 4, 5 and 6, developing unit 9 is urged by an urging spring 95 which is an elastic member as an urging member so that the developing roller 6 is contacted to the drum 4 about the rotational axis X. That is, the developing unit 9 is pressed in the direction indicated by an arrow G in FIG. 4 by an urging force of the urging spring 95 which produces a moment in the direction indicated by an arrow H about the rotational axis X.

The urging spring 95 applies the urging force for urging the developing roller 6 toward the drum 4 to the photosensitive member frame and the developing device frame. By this, the developing roller 6 is contacted to the drum 4 at a predetermined pressure. The position of the developing unit 9 relative to the drum unit 8 at this time is a contacting position.

When the developing unit 9 is moved in the direction opposite the direction of the arrow G against the urging force of the urging spring 95, the developing roller 6 is spaced from the drum 4. The position of the developing unit 9 at this time is a spacing position. In this manner, the developing roller 6 is movable toward and away from the drum 4.

[Spacing Between the Developing Roller and the Drum]

FIG. 7 is a schematic side view of the cartridge P as seen along the rotational axis of the developing roller 6 from the driving side. In this Figure, some parts are omitted for better illustration. When the cartridge P is mounted in the main assembly 2, the drum unit 8 is positioned in place in the main assembly 2 of the apparatus.

In this embodiment, an urging force receiving portion (spacing force receiving portion) 45*a* is provided on the bearing member 45. The urging force receiving portion 45*a* may be provided on any portion of the cartridge P (developing device frame, for example) in place of the bearing member 45. The urging force receiving portion 45*a* is engageable with a (the main assembly side urging member of) spacing force urging member as the main assembly side urging member provided in the main assembly 2. The spacing force urging member 80 as the main assembly side urging member receives the driving force from a motor (unshown) and is movable along a rail 81 in the directions indicated by arrows F1 and F2.

The spacing operation between the developing roller and the photosensitive member (drum) will be described.

Part (a) of FIG. 7 illustrates the state in which the drum 4 and the developing roller 6 are contacted with each other. At this time, there is a gap d between the urging force receiving portion 45*a* and the spacing force urging member 80.

Part (b) of FIG. 7 shows the state in which the spacing force urging member 80 has moved in the direction of the arrow F1 by the distance δ1 from the position shown in part (a) of FIG. 7. At this time, the urging force receiving portion 45*a* is engaged with the spacing force urging member 80. As described hereinbefore, the developing unit 9 is rotatable relative to the drum unit 8, and in part (b) of FIG. 7, the developing unit 9 has rotated by an angle θ1 in the direction of the arrow K about the rotation axis X. At this time, the developing roller 6 is spaced from the drum 4 by a distance ε1.

Part (c) of FIG. 7 illustrates the state in which the spacing force urging member 80 has moved by δ2 (>δ1) in the direction of the arrow F1 from the position shown in part (a) of FIG. 7. The developing unit 9 is rotated by the angle θ2 in the direction of the arrow K about the rotation axis X. At this time, the developing roller 6 is spaced from the drum 4 by a distance ε2.

[Positional Relation Between Developing Roller, Drive Input Member and Urging Force Receiving Portion]

As shown in parts (a)-(c) of FIG. 7, the developing roller 6 is provided between the urging force receiving portion 45*a* and a drive input member 74, as seen in the direction of the rotational axis of the developing roller from the driving side. That is, as seen in the direction of the rotational axis of the developing roller, the urging force receiving portion 45*a* is projected substantially opposite from the drive input member 74 with respect to the developing roller 6.

More in detail, the line connecting a rotational axis 6*z* of the developing roller 6 and a contact portion 45*b* of the urging force receiving portion 45*a* for receiving the force from the main assembly side urging member 80 and the line connecting the rotational axis 6*z* of the developing roller 6 and the rotational axis of the drive input member 74 crosses with each other at a certain angle. The contact portion 45*b*, the rotational axis 6*z* of the developing roller 6, and the rotational axis of the drive input member 74 and not coaxial with one another.

On the other hand, as seen in the direction of the rotational axis of the developing roller 6, the line connecting the contact portion 45*b* and the rotational axis of the drive input member 74 may pass through the developing roller 6. Such an arrangement is covered by the expression of disposing the developing roller 6 between the drive input member 74 and the urging force receiving portion 45*a*.

In this embodiment, the rotation axis X of the developing unit 9 relative to the drum unit is substantially coaxial with the rotational axis of the drive input member 74.

In addition, between the rotational axis 4*z* of the photosensitive member 4, the rotational axis X of the drive input member 74 and the contact portion 45*b* of the urging force receiving portion 45*a*, the rotational axis 6*z* of the developing roller 6 is disposed. As seen in the direction of the rotational axis of the developing roller 6 from the driving side, the three lines connecting the rotational axis 4*z* of the photosensitive member 4, the rotational axis of the cartridge side drive transmission member 74 and the contact portion 45*b* form a triangle. Then, the rotational axis 6*z* of the developing roller 6 is disposed in the triangle.

Because the developing unit 9 rotates relative to the drum unit 8, the positional relationships of the cartridge side drive transmission member 74 and the urging force receiving portion 45*a* relative to the photosensitive member 4 change. However, in any case, the rotational axis 6*z* of the developing roller 6 is disposed between the rotational axis 4*z* of the photosensitive member 4, the rotational axis (X) of the cartridge side drive transmission member 74 and the contact portion 45*b*.

By disposing the developing roller 6 between the contact portion 45*b* and the rotation axis X, the accuracy of the spacing and the contacting of the developing roller can be improved, as compared with the structure in which the developing roller 6 is away from between the contact portion 45*b* and the rotation axis X. As seen in the direction of the rotational axis 6*z* of the developing roller 6 from the driving side, the distance between the rotation axis X and the contact portion 45*b* is longer than the distance between the rotational axis 6*z* of the developing roller 6 and the rotation axis X. With this arrangement, the timing of the spacing and the contacting of the developing roller can be controlled with high precision.

In this embodiment and in the embodiments which will be described hereinafter, the distance between the rotational axis of the drum 4 and the portion where the urging force receiving portion 45*a* contacts the main assembly side urging member 80 is in the range of 13 mm-33 mm. In this embodiment and in the embodiments which will be described hereinafter, the distance between the rotation axis X and the portion where the force receiving portion 45*a* contacts the main assembly side urging member 80 is in the range of 27 mm-32 mm.

In this embodiment, by the rotational movement of the developing unit 9 (developing device frame) relative to the drum unit 8 (photosensitive member frame), the developing roller 6 is contacted to and spaced away from the photosensitive member 4. By the simple structure of connecting the developing unit 9 and the drum unit 8 with a shaft, the contact state and the spaced state between the photosensitive member 4 and the developing roller 6 can be easily switched to each other.

However, the movement of the developing unit 9 (developing device frame) is not limited to a rotational movement, in this invention. Another motion other than the rotational movement such as translation between the developing unit 9 and the drum unit 8 is usable if the distance between the photosensitive member 4 and the developing roller 6 changes by the movement of the developing unit 9 (developing device frame) relative to the drum unit 8 (photosensitive member frame).

[Drive Transmission to Photosensitive Drum]

The drive transmission to the photosensitive drum 4 will be described.

As described in the foregoing, and as shown in part (b) of FIG. 3, the drive inputting portion (photosensitive member drive transmitting portion) 4*a* for the photosensitive member, which is the coupling member provided at the end portion of the drum 4 as the photosensitive member is engaged with the drum-driving-force-outputting member 61 (61Y•61M•61C•61K) of the main assembly 2. The photosensitive member drive inputting portion (photosensitive member drive transmitting portion) 4*a* receives the driving force from the driving motor (unshown) of the main assembly. By this, the driving force is transmitted from the main assembly to the drum 4.

As shown in FIG. 1, the photosensitive member drive inputting portion (photosensitive member drive transmitting portion) 4*a* which is coupling member provided at the end portion of the photosensitive drum 4 is exposed through an opening 24*d* of the driving side cartridge cover member 24 which is a frame provided at the longitudinal end portion of the cartridge P. More particularly, the photosensitive member drive inputting portion 4*a* is projected toward an outside beyond an opening plane in which the opening 24*d* of the driving side cartridge cover member 24 is provided. Here, the photosensitive member drive inputting portion 4*a* is not movable in the direction of the rotational axis of the photosensitive member. That is, the photosensitive member drive inputting portion 4*a* is fixed relative to the drum 4.

[Drive Transmission to Developing Roller]

(Principle of Drive Connecting Portion and Releasing Mechanism)

Referring to FIGS. 1 and 8, the structure of the drive connecting portion will be described. Here, the drive connecting portion functions to receive the driving force from the developing device drive output member 62 as the main assembly side drive transmission member provided in the main assembly 2 and to transmit or not to transmit the driving force to the developing roller 6.

The drive connecting portion in this embodiment comprises drive input member 74, a release lever 73, a release cam 72, a spring 70, the developing device covering member 32 and the driving side cartridge cover member 24.

As shown in FIGS. 1 and 8, the drive input member 74 penetrates the opening 24*e* of the driving side cartridge cover member 24, an opening 32*d* Of the developing device covering member 32, an opening 70*a* of the spring 70, an opening 72*f* of the release cam 72 and an opening 73*d* of the release lever 73. That is, the drive input member 74 is engaged with the developing device drive output member 62. The drive input member 74 is provided in the cartridge P and functions as a cartridge side drive transmission member for receiving the driving force from the main assembly 2. The developing device drive output member 62 is provided in the main assembly 2 and functions as a main assembly side driving force transmission member for supplying the driving force to the cartridge P.

As shown in FIG. 1, the driving side cartridge cover member 24 which is the frame provided at the longitudinal end portion of the cartridge is provided with the opening 24*e* and in the opening 24*d* which are through-openings. The developing device covering member 32 connected with the driving side cartridge cover member 24 is provided with a substantially cylindrical portion 32*b*, and the cylindrical portion 32*b* is provided with the opening 32*d* which is a through-opening.

The drive input member 74 is provided with a shaft portion 74*x*, and is provided with the drive inputting portion 74*b* at the end portion thereof. The drive inputting portion 74*b* is in the form of a projection projecting from a free end (end portion, end surface) of the drive input member 74 toward the outside with respect to the longitudinal direction of the developing roller.

The shaft portion 74*x* is assembled so as to penetrate the opening 73*d* of the release lever 73, the opening 72*f* of the release cam, the opening 70*a* of the spring 70, the opening 32*d* of the developing device covering member 32 and the opening 24*e* of the driving side cartridge cover member 24.

The drive inputting portion 74*b* provided at the free end of the shaft portion 74*x* is exposed outwardly of the cartridge. By the exposure of the drive inputting portion 74*b*, the drive inputting portion 74*b* is visible from an outside of the cartridge P. In this embodiment, as seen in the rotational axis of the developing roller 6, the drive inputting portion 74*b* is visible.

The drive inputting portion 74*b* projects outwardly of the cartridge beyond an opening plane of the opening 24*e* of the driving side cartridge cover member 24. By the coupling engagement between a projection which is the drive inputting portion 74*b* and a recess 62*b* of the developing device drive output member 62, the driving force is transmittable from the main assembly side to the drive inputting portion 74*b*. The drive inputting portion 74*b* is in the form of a substantially triangular prism which is slightly twisted (FIG. 1).

The gear portion 74*g* provided on the outer peripheral surface of the drive input member 74 is engaged with the developing roller gear 69. The developing roller gear 69 is provided with a gear portion on the outer peripheral surface, and the gear portion is engaged with the gear portion 74*g*. The developing roller gear 69 is fixed on the shaft portion of the developing roller 6.

By this, the driving force transmitted to the drive inputting portion 74*b* of the cartridge side drive transmission member (drive input member) 74 is transmitted to the developing roller 6 through the gear portion 74*g* of the drive input member 74 and the developing roller gear 69. Among the elements constituting the drive connecting portion, the drive input member 74 (drive inputting portion 74*b*, gear portion 74*g*) and the developing roller gear 69 provides a drive transmission mechanism provided in the cartridge P. The drive transmission mechanism functions to transmit the driving force (rotational force) received from the outside of the cartridge P (developing device drive output member 62 of the main assembly 2) to the developing roller 6.

In the driving force transmitting path through which the driving force received from the outside of the cartridge P is transmitted to the developing roller 6 in the cartridge P, the drive input member 74 (drive inputting portion 74*b*) is disposed in the upstreammost position of the drive transmission mechanism with respect to the direction of the force transmission. That is, the drive inputting portion 74*b* is exposed out of the cartridge P and first receives the driving force from the main assembly.

In other words, the drive inputting portion 74*b* directly coupled with the recess 62*b* (rotational force applying portion, drive outputting portion) of the main assembly side drive transmission member (developing device drive output member 62) provided in the main assembly 2 to directly receive the driving force from the main assembly 2. More particularly, the drive inputting portion 74*b* includes a rotational force receiving portion 74*b*3 (FIG. 17) for contacting portion defining the recess 62*b* to receive the rotational force from the recess 62*b*.

(Structure of Drive Connecting Portion)

Referring to FIGS. 1, 8 and 9, the drive connecting portion will be described in more detail.

In the description of this embodiment and the embodiments which will be described hereinafter, the direction outward of the cartridge is in the direction indicated by an arrow M in FIG. 1. The direction inward of the cartridge is the direction indicated by an arrow N in FIG. 1.

The directions indicated by the arrows M and N are along the rotation axis X. However, even if it is inclined relative to the rotational axis X, it is deemed as being the direction outward of the cartridge if it is the direction approaching to the side indicated by the arrow M. Similarly, even if it is inclined relative to the rotational axis X, it is deemed as being the direction inward of the cartridge if it is the direction approaching to the side indicated by the arrow N. The direction of the arrow M is outward in the longitudinal direction of the developing roller 6, and the direction of the arrow N is inward in the longitudinal direction of the developing roller 6.

At the longitudinal end portion of the cartridge P, the driving side cartridge cover member 24 is provided as a part of the cartridge frame (developing device frame). The shaft of the developing roller is supported by the bearing member 45. Between the driving side cartridge cover member 24 and the bearing member 45, provided are the drive input member 74, the release lever 73, the release cam 72, the spring 70 and the developing device covering member 32 in the order named from the bearing member 45 toward the driving side cartridge cover member 24. That is, the drive input member 74, the release lever 73, the release cam 72, the spring 70 and the developing device covering member 32 are provided in the order named from the inside toward the outside in the longitudinal direction of the developing roller 6.

The rotational axes of these members are coaxial with the rotational axis (rotation axis X) of the drive input member 74. The "coaxial" is not limited to the strict "coaxial" but includes a deviated stated within a dimensional tolerances of the parts, and this applies to the embodiments which will be described hereinafter. That is, the "coaxial" means a substantially "coaxial".

Parts (a) and (b) of FIG. 9 are schematic sectional views of the drive connecting portion.

As described hereinbefore, a portion to be born 74*p* (inner surface of the cylindrical portion) of the drive input member 74 and the first bearing portion 45*p* (outer surface of the cylindrical portion) of the bearing member 45 are engaged with each other. In addition, the cylindrical portion 74*q* of the drive input member 74 and the inside circumference 32*q* of the developing device covering member 32 are engaged with each other. That is, the drive input member 74 is rotatably supported by the bearing member 45 and the developing device covering member 32 at each of the opposite end portions.

Furthermore, the bearing member 45 rotatably supports the developing roller 6. Referring to FIGS. 1 and 8, the second bearing portion 45*q* (inner surface of the cylindrical portion) of the bearing member 45 rotatably supports the shaft portion 6*a* of the developing roller 6. The developing roller gear 69 is engaged with the shaft portion 6*a* of the developing roller 6. As described hereinbefore, the outer peripheral surface of the drive input member 74 is formed into a gear portion 74*g* engaged with the developing roller gear 69. By this, the rotational force can be transmitted from the drive input member 74 to the developing roller 6 through the developing roller gear 69.

In addition, the centers of the first bearing portion 45*p* (outer surface of the cylindrical portion) of the bearing member 45 and the inside circumference 32*q* of the developing device covering member 32 are coaxial with the rotation axis X of the developing unit 9. Thus, the drive input member 74 is supported rotatably about the rotation axis X of the developing unit 9.

Outside the developing device covering member 32 with respect to the longitudinal direction of the cartridge P, the driving side cartridge cover member 24 is provided.

Part (a) of FIG. 9 is a schematic sectional view illustrating an engaged state (coupled state) between the drive inputting portion 74*b* of the drive input member 74 and the recess 62*b* of the developing device drive output member 62 of the main assembly.

The drive inputting portion 74*b* is provisioned on the drive input member 74 and is directly engaged with the recess 62*b* of the developing device drive output member 62 to receive the rotational force from the recess 62*b*.

The drive input member 74 receives the driving force (rotational force) through the drive inputting portion 74*b* to rotate. The recess 62*b* is the drive outputting portion (rotational force applying portion) which directly engages with the drive inputting portion 74*b* to apply the driving force (rotational force) of the drive inputting portion 74*b*.

As shown in part (a) of FIG. 9, the drive inputting portion 74*b* projects outwardly of the cartridge beyond the opening plane of the opening 24*e* Of the driving side cartridge cover member 24.

In the state shown in part (a) of FIG. 9, the rotational force is capable of being transmitted to the drive inputting portion 74*b* from the developing device drive output member 62. The position of the developing device drive output member 62 in this state is called "second position" of the developing device drive output member 62. Between the developing device covering member 32 and the release cam 72, the spring 70 which is an elastic member as an urging member is provided to urge the release cam 72 in the direction indicated by the arrow N.

Part (b) of FIG. 9 is a schematic sectional view of the state in which the drive inputting portion 74*b* is decoupled from the recess 62*b* of the developing device drive output member 62. The release cam 72 is movable in the direction indicated by the arrow M (outward of the cartridge) against the urging force of the spring 70, by being urged by the release lever 73 which is an urging mechanism. By the movement of the release cam 72 in the direction of the arrow M, the developing device drive output member 62 is urged to move in the direction of the arrow M to space the developing device drive output member 62 from the drive inputting portion 74*b*. By this, the coupling between the drive inputting portion 74 and the developing device drive output member 62 is broken so that the rotational force is not transmitted from the developing device drive output member 62 to the drive inputting portion 74*b*.

As shown in part (b) of FIG. 9, the position of the developing device drive output member 62 in the state in which the rotational force is not transmitted from the recess 62*b* of the developing device drive output member 62 to the drive inputting portion 74*b* is called "first position". The first position is downstream of the second position with respect to the moving direction M of the developing device drive output member 62 (retracted from the cartridge P).

In the first position, the drive inputting portion 74*b* and the developing device drive output member 62 are preferably not overlapped with each other with respect to the rotation axis X. However, the end surface of the developing device drive output member 62 and the end surface of the drive inputting portion 74*b* may be substantially in the same plane, and the drive inputting portion 74*b* may be slightly overlapped with the end surface of the developing device drive output member 62. In any case, if the developing device drive output member 62 has moved in the direction of the arrow M to the downstream of the second position, and the coupling of the drive input member 74 (drive inputting portion 74*b*) with the developing device drive output member 62 (recess 62*b*) is broken, it is called the first position.

(Releasing Mechanism)

The drive disconnecting mechanism (releasing mechanism) will be described. The releasing mechanism breaks the coupling between the drive inputting portion 74*b* of the drive input member 74 and the recess 62*b* of the developing device drive output member 62 to stop the drive transmission from the main assembly 2 to the developing roller 6.

FIG. 10 shows a relationship between the release cam 72, the spring 70 and the developing device covering member 32. The release cam one releasing member) 72 comprises a cylindrical portion (releasing member side cylindrical portion) 72*k* which has a substantially cylindrical shape, a disk portion 72*g* provided at the inner end surface of the cylindrical portion 72*k* and expanding outwardly of the cylindrical portion, and a projected portion 72*i* projected from the disk portion 72*g*. In this embodiment, the projected portion 72*i* projects inwardly of the cartridge (arrow N direction) along the rotational axis of the developing roller. The developing device covering member 32 is provided with an abutment surface 32*e* having the opening 32*d*. The cylindrical portion 72*k* of the release cam 72 penetrates the opening 70*a* of the spring 70 and is supported so as to be slidable relative to the opening 32*d* of the developing device covering member 32 in the direction along the rotation axis X. In other words, the release cam 72 is movable substantially in parallel with the rotational axis of the developing roller 6 relative to the developing device covering member 32.

The spring 70 is provided between the disk portion 72*g* of the release cam 72 and the abutment surface 32*e* of the developing device covering member 32. The disk portion 72*g* is a portion-to-be-urged (elastic force receiving portion) to be urged by the spring 70. By the disk portion 72*g* receiving an elastic force from the spring 70, the release cam 72 is urged into the cartridge P in the direction indicated by the arrow N (to an inside position in part (a) of FIG. 9, which will be described hereinafter). The disk portion 72*g* functions as a force receiving portion (a second releasing member side force receiving portion, an inward force receiving portion).

The centers of the cylindrical portion 72*k* of the release cam 72 and the opening 32*d* of the developing device covering member 32 are on the same axis.

The developing device covering member 32 is provided with a guide 32*h* as a guide portion, and the release cam 72 is provided with a guide groove 72*h* as a portion-to-be-guided. The guide 32*h* and the guide groove 72*h* are extended in parallel with the axial direction. The guide 32*h* of the developing device covering member 32 is engaged with the guide groove 72*h* of the release cam 72. By the engagement between the guide 32*h* and the guide groove 72*h*, the release cam 72 is capable of moving (sliding) only in the direction parallel with the rotation axis X (arrows M and N) relative to the developing device covering member 32.

It is not necessary that both of the guide 32*h* and the guide groove 72 are parallel with the rotational axis X, only one of them (contacting with each other) may be parallel with the rotational axis X, by which the release cam 72 can be moved in parallel with the rotation axis X.

It is not absolutely necessary that the release cam 72 move in parallel with the rotation axis X, and the release cam 72 may move in a direction inclined relative to the rotation axis X.

FIG. 11 shows the structures of the release lever 73 and the release cam 72.

The release cam 72 as the decoupling member is provided with a contact portion (inclined surface, contact surface) 72*a*. The contact portion 72*a* functions as a force receiving portion (first releasing member side force receiving portion) for receiving the force produced by the main assembly 2 through the release lever 73. The release cam 72 is capable of urging the drive output member 62 by the force received by the contact portion 72*a*, as will be described in detail hereinafter.

The release lever 73 is a substantially ring configuration rotatable member which is rotatable relative to the developing device frame (bearing member 45, developing device covering member 32) and the release cam 72. The release lever 73 is an operating member for moving the release cam 72 by acting on the release cam 72.

The release lever 73 is provided with a contact portion (inclined surface, contact surface) 73*a* as an operating portion (rotatable member side urging portion, operating member side urging portion) acting on the contact portion 72*a* of the release cam 72.

The contact portion 73*a* of the release lever 73 and the contact portion 72*a* of the release cam 72 are contactable with each other.

In FIG. 11, the numbers of the contact portions 73*a* of the release lever 73 and the contact portions 72*a* of the release cam 72 are two, respectively, but the numbers are not restricted to two. For example, the numbers may be one, three or more, respectively.

[Drive Disconnecting Operation]

Referring to FIG. 7 and FIGS. 12-15, the operation of the drive connecting portion when the state thereof changes from the state in which the developing roller 6 and the drum 4 contact with each other to the state in which they are spaced from each other will be described. For better illustration, FIGS. 12-15 omit some parts, and the release lever and the release cam are partly schematically shown. In the Figure, the arrow M along the rotation axis X indicates the direction outward of the cartridge, and the arrow N along the rotation axis X indicates the direction inward of the cartridge.

[State 1]

As shown in part (a) of FIG. 7, the spacing force urging member 80 and the urging force receiving portion 45*a* of the bearing member 45 are spaced from each other by a gap d. In this case, the drum 4 and the developing roller 6 contact with each other. This state is called "state 1" of the spacing force urging member 80.

The state of the drive connecting portion is as shown in FIG. 13. In part (a) of FIG. 13, a pair of the drive input member 74 and the developing device drive output member 62 and the pair of the release cam 72 and the release lever 73 are separately and schematically shown. Part (b) of FIG. 13 is a perspective view illustrating a structure of the drive connecting portion. Between the contact portion 72*a* of the release cam 72 and the contact portion 73*a* of the release lever 73, there is a gap e. At this time, the drive inputting portion 74*b* of the drive input member 74 and the recess 62*b* of the developing device drive output member 62 are engaged with each other by an engaging amount q, so that the drive transmission can be carried out.

As described hereinbefore, the drive input member 74 is engaged with the developing roller gear 69. Therefore, the driving force received by the drive input member 74 from the main assembly 2 is transmitted to the developing roller gear 69 to rotate the developing roller 6. This state is called "development-contact and drive-transmission state". In addition the position of the developing device drive output member 62 is the above-described second position. In the second position of the developing device drive output member 62, the recess (rotational force applying portion) 62*b* is in coupling engagement with the drive inputting portion 74*b* such that the drive transmission can be effected (drive transmission position). The position of the drive input member 74 (drive inputting portion 74*b*) at this time is called the second position of the drive input member 74 (drive inputting portion 74*b*).

[State 2]

Part (a) of FIG. 14 and part (b) of FIG. 14 illustrate the drive connecting portion at the time when the main assembly side urging member of the spacing force urging member 80 is moved from the development contact drive transmission position by δ1 in the direction indicated by an arrow F1 in the Figure as shown in part (b) of FIG. 7.

As shown in part (b) of FIG. 7, when the spacing force urging member 80 move by δ1, the urging force receiving portion 45*a* receives the force from the spacing force urging member 80, by which the developing unit 9 is rotated by an angle θ1 in the direction indicated by an arrow K about the rotation axis X. As a result, the developing roller 6 spaces from the drum 4 by a distance ε1. The release cam 72 and the developing device covering member 32 of the developing unit 9 rotate in interrelation with the rotation of the developing unit 9 by the angle θ1 in the direction indicated by an arrow K.

On the other hand, when the cartridge P is mounted in the main assembly 2, the drum unit 8, the driving side cartridge cover member 24 and the non-driving side cartridge cover member 25 are fixed in place relative to the main assembly 2.

As shown in FIG. 12, the release lever 73 of the developing unit 9 is provided with the force receiving portion (projected portion, portion-to-be-engaged) 73*b* projected from a ring configuration portion of the release lever 73 in a direction of a line perpendicular to the rotation axis X. The force receiving portion 73*b* is engaged with an engaging portion 24*s* provided on the driving side cartridge cover member 24. By this, the rotation of the release lever 73 is limited. Even if the rotation of the release lever 73 is limited, the developing unit 9 is capable of rotating because the developing device covering member 32 is provided with an opening 32*c*.

The contact portion 72*a* of the release cam 72 rotates in the direction indicated by the arrow K (part (b) of FIG. 7) in interrelation with the rotation of the developing unit 9, relative to the contact portion 73*a* of the release lever 73 which is limited in the rotation thereof. As a result, the contact portion 72*a* of the release cam 72 starts to contact the contact portion 73*a* of the release lever 73. At this time, the drive input member 74 and the developing device drive output member 62 keep contacting each other (part (a) of FIG. 14).

Therefore, the driving force inputted to the drive input member 74 from the main assembly 2 is being transmitted to the developing roller 6 through the developing roller gear 69. The state of these parts is a "developing-device-separation and drive-transmission state". The position of the developing device drive output member 62 at this time is also the second position.

[State 3]

Part (a) of FIG. 15 and part (b) of FIG. 15 illustrate the drive connecting portion at the time when the main assembly side urging member of the spacing force urging member 80 move from the developing device separation drive transmission position in the direction indicated by the arrow F1 in the Figure by δ2 as shown in part (c) of FIG. 7. As shown in part (c) of FIG. 7, by the spacing force urging member 80 moving by δ2, the developing unit 9 is rotated by a angle θ2 (>θ1) by the urging force receiving portion 45*a* receiving the force from the spacing force urging member 80.

In interrelation with the rotation of the developing unit 9 through the angle θ2 by the spacing force urging member 80, the release cam 72 and the developing device frame (developing device frame 29, bearing member 45 and developing device covering member 32) are rotated in the direction indicated by the arrow K in the Figure. On the other hand, the state of the release lever 73 remains unchanged, similarly to the foregoing, because of the engagement with the engaging portion 24*s* (FIG. 12) provided on the driving side cartridge cover member 24. That is, the release lever 73 rotates in the direction indicated by the arrow H (part (c) of FIG. 7) relative to the developing device frame and the release cam 72.

At this time, the contact portion 72*a* of the release cam 72 receives a reaction force from the contact portion 73*a* of the release lever 73. That is, the contact portion (rotatable member side urging portion) 73*a* of the release lever 73 urges the contact portion 72*a* of the release cam 72 in the direction indicated by the arrow M. The contact portion 72*a* is the outward force receiving portion (first releasing member side force receiving portion) for receiving the force directed outwardly of the cartridge P from the contact portion 73*a*.

Here, as described hereinbefore, the release cam 72 is capable of the sliding movement in the axial direction (arrows M and N directions) by the guide groove 72*h* of the release cam 72 engaging with the guide 32*h* of the developing device covering member 32 (FIG. 10). Therefore, by the contact portion 72*a* receiving the force, the release cam 72 slides in the direction indicated by the arrow M by a movement distance p relative to the release lever 73.

By this, in interrelation with the movement of the release cam 72 in the direction indicated by an arrow M, the cylindrical portion 72*k* of the release cam 72 overlaps with the drive inputting portion 74*b* of the drive input member 74 in the axis X direction. That is, the free end of the cylindrical portion 72*k* of the release cam 72 makes a sliding movement of the developing device drive output member 62 in the direction indicated by the arrow M by the movement distance p. In this embodiment, the developing device drive output member 62 moves in parallel with the rotation axis X.

In summary, the urging force provided by the main assembly 2 is transmitted to the bearing member 45 (urging force receiving portion 45*a*) of the cartridge P through the spacing force urging member 80.

By this, the developing unit 9 (developing device frame and release cam 72) rotates in the direction indicated by the arrow K by θ2 (part (c) of FIG. 7). At this time, the release lever 73 engaged with the driving side cartridge cover member 24 is rotated relative to the developing device frame and the release cam 72. Thus, the urging force received by the urging force receiving portion 45*a* is transmitted to the contact portion 72*a* of the release cam 72 through the contact portion 73*a* of the release lever 73 (FIGS. 11 and 12).

The release cam 72 urges the developing device drive output member 62 by the free end (urging portion) of the cylindrical portion 72*k* to move the developing device drive output member 62 in the direction of the arrow M (part (b) of FIG. 9, FIG. 15), using the force received by the contact portion 72*a*.

At this time, as shown in FIGS. 14 and 15, the movement distance p of the developing device drive output member 62 is larger than the engagement amount q between the drive input member 74 and the developing device drive output member 62, and therefore, the engagement between the drive input member 74 and the developing device drive output member 62 is broken. Although the developing device drive output member 62 of the main assembly 2 continues to rotate, the drive input member 74 stops. As a result, the rotation of the developing roller gear 69 and therefore the rotation of the developing roller 6 stop.

The state of the parts is called "developing-device-separation and drive-disconnection state". The position of the drive output member 62 at this time is the first position.

As shown in FIG. 15, the position of the release cam 72 at the time when the developing device drive output member 62 is in the first position is the first position of the release cam 72. The first position of the release cam 72 is away from the second position of the release cam 72 shown in FIG. 14 in the outward direction along the axis of the developing roller, and is called "outside position". In addition, the release cam 72 in the outside position is projected (projected position) outwardly of the process cartridge as compared with the second position of the release cam 72 (FIG. 14). In the outside position, the release cam 72 urges (urging position) the developing device drive output member 62 by the free end of the cylindrical portion 72*k* to move it. The outside position is also a coupling release position (connection release position) for releasing (breaking) the coupling between the drive inputting portion 74*b* of the drive input member 74 and the recess 62*b* of the developing device drive output member 62, and is also a blocking position and a non-drive transmission position for disconnecting the drive transmission to the drive inputting portion 74*b*.

On the other hand, as shown in FIG. 14, the position of the release cam 72 at the time when the developing device drive output member 62 is in the second position is the second position of the release cam 72. In the second position of the release cam 72, the release cam 72 is inward (inside position) of the cartridge in the longitudinal direction of the developing roller as compared with the outside position shown in FIG. 15. In the inside position, the release cam 72 is retracted (retracted position) inwardly of the cartridge P from the outside position. The inside position of the release cam 72 is a permitting position for permitting the coupling between the drive inputting portion 74*b* and the recess 62*b*, in which the developing device drive output member 62 is in the second position. The inside position of the release cam 72 is a drive connecting position (drive transmission position) in which the drive transmission path is connected to the drive inputting portion 74*b* to permit the drive transmission thereto.

In summary, as shown in part (c) of FIG. 7, the urging force receiving portion 45*a* receive the urging force from the main assembly 2 (spacing force urging member 80). Using the urging force, the developing unit 4 (developing device frame) is rotated, and the release cam 72 is moved from the inside position (FIG. 14) to the outside position (FIG. 15). By this, the release cam 72 retracts the developing device drive output member 74 in parallel with the rotation axis X from the second position (FIG. 14) to the first position (FIG. 15). By this, the release cam 72 breaks the coupling between the drive input member 74 (drive inputting portion 74*b*) and the developing device drive output member 62 (recess 62*b*) to disconnect the drive transmission.

By the movement of the release cam 72 from the outside position to the inside position, the developing device drive output member 74 is permitted to move from the first position to the second position. By this, the drive inputting portion 74*b* and the developing device drive output member 74 are coupled with each other to enable the drive transmission to the drive inputting portion 74*b*. The description will be made in more detail hereinafter.

The release cam 72 is a movable member movable between the inside position and the outside position by the sliding movement in the longitudinal direction of the developing roller 6. That is, the release cam 72 is movably supported by the developing device frame (guide portion 32*h* of the developing device covering member 32, FIG. 10) and the shaft portion 74*x* (FIG. 1) of the drive input member 74. The release cam 72 is reciprocal between the inside position and the outside position by the sliding movement with the shaft portion 74*x* being in the cylindrical portion 72*k* (FIG. 1).

The release cam 72 is a decoupling member for decoupling the drive inputting portion 74*b* and the recess 62*b* of the developing device drive output member 62 from each other by the release cam 72 moving to the outside position and urging the developing device drive output member 62.

A surface 72*k*1 of the free end of the cylindrical portion 72*k* (part (b) of FIG. 15) of the release cam 72 is an urging portion (releasing member side urging portion) contactable to the developing device drive output member 62 to urge it toward the retracted position. That is, the urging portion 72*k*1 is annular (ring-like) surface (FIG. 14). The urging portion 72*k*1 is a surface substantially perpendicular to the rotation axis X.

As described hereinbefore, the movement distance p through which the developing device drive output member 62 is moved from the second position to the first position by the sliding of the release cam 72 is preferably larger than the engagement amount q between the drive input member 74 and the developing device drive output member 62. That is, in the state that the release cam 72 is in the outside position (FIG. 15), the urging portion (free end of the release cam 72)

of the release cam 72 is preferably outside as compared with the free end of the drive inputting portion 74*b* in the longitudinal direction of the developing roller 6. The free end of the drive inputting portion 74*b* is in the outside end of the drive inputting portion 74*b* with respect to the longitudinal direction of the developing roller.

The rotational axis of the developing roller 6 is substantially parallel with the rotation axis X1. Therefore, in the description in conjunction with FIGS. 9, 13-15 and 16, the longitudinal direction of the developing roller 4 is in parallel with the rotation axis X, and the outside with respect to the longitudinal direction is the side indicated by the arrow M, and the inside is the site indicated by the arrow N.

As shown in part (b) of FIG. 9, when the release cam 72 is moved to the outside position, the developing device drive output member 62 urged by the release cam 72 retracts to the position more outside than the free end of the drive inputting portion 74*b* in the longitudinal direction of the developing roller, that is, to the first position (coupling release position). The drive inputting portion 74*b* and the developing device drive output member 62 are out of contact from each other so that the drive transmission to the drive inputting portion 74*b* can be assuredly stopped.

Referring to FIG. 16, the positional relation between the release cam 72 and the drive inputting portion 74*b* will be described in detail. FIG. 16 shows the release cam 72 and the drive inputting portion 74*b* projected onto a phantom line X1 parallel with the rotational axis of the developing roller 6. Part (a) of FIG. 16 shows the state in which the release cam 72 is in the inside position. Part (b) of FIG. 16 shows the state in which the release cam 72 is in the outside position.

When the release cam 72 is in the outside position, at least the free end of the release cam 72 is exposed toward the outside of the cartridge P through the opening 24*e* of the driving side side-cover member 24 and through the opening 32*b* of the developing device covering member 32 (FIG. 1).

As shown in part (b) of FIG. 16, when the release cam 72 is in the outside position, an area A1 of the drive inputting portion 74*b* projected on the phantom line X1 is overlapped with an area A2 of the release cam 72 projected thereon. More particularly, the entirety of the area A1 is in the area A2 (the area A2 contains all the area A1). A range A3 where the area A1 and the area A2 are overlapped with each other on the phantom line X1 has the same width as that of the area A1.

By the movement of the release cam 72 from the inside position to the outside position, that is, by the state change from that shown in part (a) of FIG. 16 to that shown in part (b) of FIG. 16, the range A3 increases. That is, the projection amount of the free end portion of the release cam 72 beyond the driving side side-cover member 24 and the developing device covering member 32 (FIG. 1) increases.

When the release cam 72 is in the inside position, the area A1 of the drive inputting portion 74*b* and the area A2 of the release cam 72 does not overlap with each other, as shown in part (a) of FIG. 16. In other words, the width of the range A3 is 0 mm. On the other hand, when the release cam 73 moves to the outside position, the width of the range A3 becomes equal to the width (height, projection) of the drive inputting portion 74*b*, which is approx. 2.0 mm in this embodiment, as shown in part (b) of FIG. 16.

When the release cam 72 is in the outside position (part (b) of FIG. 16), it is not always necessary that the free end of the release cam 72 (urging portion of the release cam 72) is in a position outside of the free end of the drive inputting portion 74*b* in the longitudinal direction of the developing roller. For example, it may be that case that the free end of the release cam 72 and the end surface 74*b*1 of the drive inputting portion 74*b* are substantially in the same plane. Also at this time, the end surface (free end) of the drive inputting portion 74*b* and the end surface of the developing device drive output member 62 are substantially in the same plane, and therefore, the developing device drive output member 62 is not coupled with the drive inputting portion 74*b*, and the drive transmission is disconnected.

In addition, even if the free end of the drive inputting portion 74*b* is slightly overlapped with the developing device drive output member 62, the drive transmission from the drive input member 74 to the developing device drive output member 62 can be broken, depending on the structure. Such a structure will be described hereinafter as a modified example of this embodiment.

In the foregoing, the description has been made as to the operation of the releasing mechanism for stopping the drive transmission to the developing roller 6 in interrelation with the rotation of the developing unit 9 in the direction of the arrow K. By employing such a structure, the developing roller 6 can be spaced from the drum 4 while rotating. As a result, the drive transmission to the developing roller 6 can be stopped depending on the spacing distance between the developing roller 6 and the drum 4.

The release cam 72 and the release lever 73 actable on the release cam 72 and so on constitute a part of the releasing mechanism for breaking the coupling between the recess 62*b* of the developing device drive output member 62 and the drive inputting portion 74*b*. By the mechanism, the coupling is disconnected, and the drive transmission to the developing roller 6 is stopped.

[Drive Connecting Operation]

The description will be made as to the operation of the drive connecting portion when the state change from the state in which the developing roller 6 is spaced from the drum 4 to the state in which they are contacted with each other. This operation is opposite from the operation from the contact state to the spaced-developing-device-state described in the foregoing.

In the spaced-developing-device-state (the developing unit 9 is in the angle θ2 position, as shown in part (c) of FIG. 7), the drive connecting portion is in the state that the drive input member 74 and the developing device drive output member 62 are disconnected from each other, as shown in FIG. 15. That is, the developing device drive output member 62 is in the first position.

When the spacing force urging member 80 is moved in the direction indicated by an arrow F2 from this state, the force received by the urging force receiving portion 45*a* from the spacing force urging member 80 decreases. As a result, the developing unit 9 rotates in the direction of the arrow H (opposite to the K direction) shown in part (c) of FIG. 7 by the urging force of the urging spring 95 (FIG. 4).

When the developing unit 9 is rotated in the direction indicated by the arrow H shown in FIG. 7, the release lever 73 makes the force receiving portion 73*b* engage with an engaging portion 24*t* provided on the driving side cartridge cover member 24. Therefore, the release lever 73 does not rotate together with the developing unit 9. The release cam 72 rotating together with the developing unit 9 rotates relative to the release lever 73. In other words, the release lever 73 rotates in the direction of the arrow K relative to the developing device frame and to the release cam 72.

With the rotation of the release lever 73, the contact portion 73*a* of the release lever 73 starts to retract from the contact portion 72*a* of the release cam 72. Corresponding to the amount of the retraction of the contact portion 73*a*, the release cam 72 moves in the direction of the arrow N by the force of the spring 70.

In the state that the developing unit 9 is rotated by the angle θ1 (the state shown in part (b) of FIG. 7 and FIG. 14), the release cam 72 & is moved to the inside position by the urging force of the spring 70.

With the separation of the release cam 72 from the developing device drive output member 62 by the movement to the inside position, the developing device drive output member 62 is moved to the second position by being urged in the direction of the arrow N by the spring (unshown) of the main assembly 2. Then, the drive input member 74 is engaged with the developing device drive output member 62, as shown in FIG. 14.

By this, the driving force is transmitted from the main assembly 2 to the developing roller 6, thus rotating the developing roller 6. That is, the developing device drive output member 62 is in the second position. At this time, the developing roller 6 and the drum 4 are kept spaced from each other.

Further, from this state, the spacing force urging member 80 is moved in the direction of the arrow F2 to separate the spacing force urging member 80 from the urging force receiving portion 45*a*, by which the developing unit 9 gradually rotates in the direction of the arrow H shown in FIG. 7 by the force of the urging spring (FIG. 4). As a result, the developing roller 6 and the drum 4 can be contacted to the other finally (part (a) of FIG. 7). Also in this state, the developing device drive output member 62 is in the second position. In this embodiment, in the state in which the developing roller 6 and the drum 4 are in contact with each other, the force received by the spacing force urging member 80 from the urging force receiving portion 45*a* is zero, because the urging force receiving portion 45*a* is not contacted by the spacing force urging member 80. However, the urging force receiving portion 45*a* may be contacted with the spacing force urging member 80, if the developing roller 6 and the drum 4 are in contact with each other.

In summary, in the state that the force received by the urging force receiving portion 45*a* from the spacing force urging member 80 is decreased (part (b) of FIG. 7) or is zero (part (c) of FIG. 7), the developing unit 4 is rotated in the direction of the arrow H by the force of the urging spring 95 (FIG. 4). By the rotation of the developing unit 4, the developing roller 6 approaches to the drum 4, and the release cam 72 moves toward the inside position (FIGS. 13, 14) using the force of the spring 70. With the movement of the release cam 72 to the inside position, a driving force transmission path from an outside of the cartridge P to the developing roller 6 is established.

In the foregoing, the drive transmission operation to the developing roller 6 in interrelation with the rotation of the developing unit 9 in the direction of the arrow H has been described With this structure described above, the developing roller 6 is brought into contact to the drum 4 while rotating, and the driving force can be transmitted to the developing roller 6 depending on the spacing distance between the developing roller 6 and the drum 4.

The cartridge P is provided with the release cam 73 as the operating member actable on the release cam 72, and the release cam 72 is moved from the outside position (FIG. 15) to the inside position (FIG. 14) by the release cam 73 moving (rotating) relative to the release cam 72.

The release lever 73 functions as a switching member for switching the moving direction of the release cam 72 by changing the moving direction (rotational direction) relative to the release cam 72. As described in the foregoing, when the release lever 73 is moved (rotated) in the direction of the arrow H indicated in part (b) of FIG. 7 relative to the release cam 72, that is, when the release cam 72 is moved in the direction of the arrow K relative to the release lever 73, the release lever 73 moves the release cam 72 from the inside position to the outside position. On the other hand, when the release lever 73 moves (rotates) in the direction of the arrow K (opposite from the arrow H) relative to the release cam 72, that is, when the release cam 72 moves in the direction of the arrow H relative to the release lever 73, the release lever 73 moves the release cam 72 from the outside position to the inside position.

The release cam 72 functions as a movable member movable relative to the drive input member 74 (drive inputting portion 74*b*) by the reciprocation of the release cam 72 between the inside position and the outside position.

The release cam 72 engages (couples) the drive inputting portion 74*b* with the recess (rotational force applying portion) 62*b* and disengages (decouples) them by the movement relative to the drive inputting portion 74*b*. More particularly, the release cam 72 moves relative to the drive inputting portion 74*b* (rotational force receiving portion 74*b*3) by the displacement at least in the longitudinal direction of the developing roller. By the release cam 72 moving toward the outside in the longitudinal direction relative to the drive inputting portion 74*b*, the engagement (coupling) between the drive inputting portion 74*b* and the recess 62*b* is broken. By the release cam 72 moving toward the inside in the longitudinal direction relative to the drive inputting portion 74*b*, the engagement between the drive inputting portion 74*b* and the recess 62*b* is permitted.

In this embodiment, the release lever 73 which is the operating member is a rotatable member rotatable relative to the release cam 72. However, the operating member is not limited to a rotatable member. The operating member may be in another form if it is movable relative to the release cam 72 and actable on the release cam 72 in interrelation with the rotation of the developing unit 9. In this embodiment, the release lever 72 as the operating member moves the release cam 72 by moving in the direction crossing with the rotation axis X, more particularly, perpendicular to the rotation axis X.

When the release cam 72 is in the inside position, the free end of the release cam 72 is substantially in the same position as a rear end 74*b*2 of the drive inputting portion 74*b* with respect to the longitudinal direction of the developing roller, as shown in part (a) of FIG. 16. At this time, the free end of the release cam 72 does not contact the developing device drive output member 62. Therefore, the drive inputting portion 74*b* is permitted to be in the second position, and is capable of assuredly coupling with the developing device drive output member 62. In addition, the release cam 72 does not influence the rotation of the developing device drive output member 62.

The rear end 74*b*2 of the drive inputting portion 74*b* is a bottom portion of the drive inputting portion 74*b* which is in the form of a projection. The position of the rear end of the drive inputting portion 74*b* corresponds to the position of the end surface of the drive input member 74 provided with the drive inputting portion 74*b*.

In addition, the free end of the release cam 72 may be disposed inside the rear end 74*b*2 of the drive inputting portion 74*b* with respect to the longitudinal direction of the developing roller when the release cam 72 is in the inside position. Also in this case, the free end of the release cam 72 does not contact to the developing device drive output member 62, and therefore, the same effects can be provided.

On the other hand, the free end of the release cam 72 may be disposed slightly outside of the rear end 74*b*2 of the drive inputting portion 74*b* with respect to the longitudinal direction of the developing roller when the release cam 72 is in the inside position. That is, the free end of the release cam 72 may be contacted to the developing device drive output member 62 if the drive inputting portion 74*b* is coupled with the recess 62*b* of the developing device drive output member 62 to effect that the drive transmission. At this time, also when the release cam 72 is in the inside position, the area A1 and the area A2 are partly overlapped with each other on the phantom line X1 shown in part (a) of FIG. 16.

As described in the foregoing, with the above-described structure, the switching between the drive disconnection and the drive transmission to the developing roller 6 can be definitely determined on the basis of the angle of rotation of the developing unit 9.

In the foregoing, the contact portion 72*a* of the release cam 72 and the contact portion 73*a* of the release lever 73 make face-to-face contact, but this is not limiting to the present invention. For example, the contact may be in the form of a face-to-line contact, a face-to-point contact, a line-to-line contact or a line-to-point contact.

Additionally, the release cam 72 has been described as being movable substantially in parallel with the rotation axis X, but it may be movable in a direction inclined relative to the rotation axis X. In other words, the moving direction of the release cam 72 is not limited to a particular direction if the developing device drive output member 62 can be urged.

In this embodiment, the release cam 72 is constituted such that even if the moving direction of the release cam 72 is inclined relative to the rotational axis X, the vector along the moving direction has at least a component in parallel with the rotational axis X. That is, even when the moving direction of the release cam 72 is not parallel with the rotational axis X, the release cam 72 moves at least in the direction of the rotational axis X (longitudinal direction of the developing roller).

In addition, in this embodiment, the elastic member (spring 70) actable on the release cam 72 is a pushing spring for pushing the release cam 72 inwardly of the cartridge P (toward the inside position) (FIG. 10). However, the elastic member may be a tension spring which pulls the release cam 72 toward the inside position, by changing the position of the elastic member. Additionally, the spring 70 has been described as a coil spring, but it may be another elastic member such as a leaf spring.

The release cam 72 is disposed adjacent to the drive input member 74 (FIG. 1), so that it can urge the drive output member 62 assuredly. In this embodiment a diameter of the drive output member 62 is approx. 15 mm. Therefore, the release cam 72 is capable of urging the drive output member 62 if at least a part of the release cam 72 is disposed within the range of approx. 7.5 mm (radius) from the rotation axis (rotational center X) of the drive input member 74 (drive inputting portion 74*b*).

Modified Example

FIG. 17 illustrates a modified example which is different from the above-described embodiment in the movement distance p at the time when the release cam 72 moves from the inside position to the outside position. In the foregoing embodiment, the movement distance p of the release cam 72 is larger than the projection amount of the drive inputting portion 74*b* (engagement amount q of approx. 2.0 mm between the drive inputting portion 74*b* and the developing device drive output member 62). In this modified example, the movement distance p of the release cam 72 is smaller than the projection amount (engagement amount q) of the drive inputting portion 74*b*. As a result, even when the release cam 72 is in the outside position, the free end of the developing device drive output member 72 is disposed inside the end surface 74*b*1 of the drive inputting portion 74*b* with respect to the longitudinal direction of the developing roller. Even when the release cam 72 is in the outside position, a part of the free end side of the drive inputting portion 74*b* is overlapped with the developing device drive output member 62.

With such a structure, the drive transmission from the developing device drive output member 62 to the drive inputting portion 74*b* can be stopped. This is because in the free end side of the drive inputting portion 74*b*, an inclined portion 74*b*3 is provided, and when the developing device drive output member 62 contacts only to the inclined portion 74*b*3, the developing device drive output member 62 rotates idly.

The inclined portion 74*b*3 is provided adjacent to the end surface 74*b*1 of the drive inputting portion 74*b* and is in the form of a beveling portion of the corner of the drive inputting portion 74*b*.

In addition, adjacent to the base portion (rear end, bottom portion) 74*b*2 of the drive inputting portion 74*b*, there is provided a rotational force receiving portion 74*b*4 adjacent to which the rotational force receiving portion 74*b*4 and the inclined portion 74*b*3 are disposed.

The rear end 74*b*2 of the drive inputting portion 74 corresponds to the rear end of the rotational force receiving portion 74*b*4. A boundary portion between the rotational force receiving portion 74*b*4 and the inclined portion 74*b*3 corresponds to the free end of the rotational force receiving portion 74*b*4.

The rotational force receiving portion 74*b*4 is the portion (surface) which contacts the recess 62*b* to directly receive the driving force from the recess 62*b* when the drive inputting portion 74*b* is coupled with the recess 62*b* of the developing device drive output member 62. The rotational force receiving portion 74*b*4 has a width (dimension occupied by the developing roller in the longitudinal direction) of approx. 1.7 mm.

The inclined portion 74*b*3 is inclined relative to the rotational axis of the drive inputting portion 74*b* and the rotational force receiving portion 74*b*4, and the angle formed between the rotation axis X and the inclined portion 74*b*3 is larger than the angle formed between the rotation axis X and the rotational force receiving portion 74*b*4. The inclined surface 74*b*3 is a smooth curved surface (having a radius of curvature of approx. 0.3 mm) connecting the free end of the rotational force receiving portion 74*b*4 and the end surface 74*b*1, but it may be in the form of a flat surface. A width of the inclined surface 74*b*3 (width occupied by the developing roller in the longitudinal direction) is approx. 0.3 mm.

In this embodiment, the movement distance p of the release cam 72 is between 1.7 mm and 2.0 mm. When the release cam 72 is in the outside position, the free end of the release cam 72 (urging portion of the release cam 72) is in the same position as the free end of the rotational force receiving portion 74*b*4 or in the position outside thereof.

On the other hand, the free end of the release cam 72 is inside the end surface 74*b*1 of the drive inputting portion 74*b* with respect to the longitudinal direction of the developing roller. That is, the free end of the release cam 72 is partly overlapped with the inclined portion 74*b*3 of the drive inputting portion 74*b* with respect to the longitudinal direction of the developing roller.

In this modified example, the drive inputting portion 74*b* and the developing device drive output member 72 are projected onto a phantom line (parallel with the axis of the developing roller) X1. Then, when the drive inputting portion 74*b* is in the outside position, an area A1 of the drive inputting portion 74*b* and an area A2 of the release cam are partly overlapped with each other on the phantom line X1, but not all of the area A1 is within the area A2. That is, all of an area A11 of the area A1 which corresponds to the rotational force receiving portion 74*b*4 overlaps with a part A121 of the area A12 corresponding to the inclined portion 74*b*3. However, the rest portion A122 of the area A12 corresponding to the inclined portion 74*b*3 is outside of the area A2 in the longitudinal direction.

Therefore, also when the release cam 72 is in the outside position, the inclined portion 74*b*3 of the drive inputting portion 74*b* is in contact with the developing device drive output member 62. However, because the inclined portion 74*b*3 is inclined relative to the rotation axis X, a part of the force received by the inclined portion 74*b*3 from the developing device drive output member 62 acts in the longitudinal direction of the developing roller toward the inside.

The drive input member 74 is supported with a play in the longitudinal direction of the developing roller 6. Therefore, when the inclined portion 74*b*3 receives the force from the developing device drive output member 62, the drive input member 74 tends to retract in the direction of the arrow N by the received force. Because of the tendency of the drive inputting portion 74*b* separating from the developing device drive output member 62, the coupling between the drive inputting portion 74*b* and the developing device drive output member 62 is prevented although they are contacted with each other. The inclined portion 74*b*3 does not engage with the recess 62*b* of the developing device drive output member 62. The driving force transmission to the drive inputting portion 74*b* is limited.

As a result, even if the developing device drive output member 62 is rotated, the drive inputting portion 74*b* does not rotate. Or, even if the drive inputting portion 74*b* is rotated, the rotational frequency (rotational speed) is greatly limited.

By the movement in the direction of the separation between the drive input member 74 and the developing device drive output member 62, the drive transmission is stopped (decoupled). In summary, the drive inputting portion 74*b* is provided with a portion (rotational force receiving portion 74*b*4) for transmitting the driving force from the recess 62*b* of the developing device drive output member 62 and a portion (inclined portion 74*b*3) for not transmitting it.

In this modified example, when the release cam 72 is in the outside position, it is projected beyond the free end of the rotational force receiving portion 74*b*4, by which the contact between the rotational force receiving portion 74*b*4 and the developing device drive output member 62 is prevented. Therefore, even if the contact between the inclined portion 74*b*3 of the drive inputting portion 74*b* and the developing device drive output member 62 is permitted, the drive transmission is stopped.

At this time, when the release cam 72 and the rotational force receiving portion 74*b*1 are projected onto the phantom line X1, the area A2 of the release cam 72 and an area A111 of the rotational force receiving portion 74*b*4 are overlapped with each other on the phantom line X1. By the movement of the release cam 72 from the inside position (FIG. 14) to the outside position (FIG. 17), the range in which the area A2 of the release cam 72 and the area A11 of the rotational force receiving portion 74*b*4 on the phantom line X1 increases.

It will suffice if the free end of the release cam 72 this is substantially in the same position as the free end of the rotational force receiving portion 74*b*4 (boundary between the rotational force receiving portion 74*b* and the inclined portion 74*b*3) or in the position outside thereof with respect to the longitudinal direction.

In this modified example, the rotational force receiving portion 74*b*4 has a width of approx. 1.7 mm. Therefore, the release cam 72 moves until the free end of the release cam 72 becomes beyond rear end 74*b*2 by at least 1.7 mm outwardly in the longitudinal direction.

However, the width of the rotational force receiving portion 74*b*4 can be made smaller than 1.7 mm, and in such a case, the movement distance of the release cam 72 can be further reduced.

In this modified example, the drive inputting portion 74*b* is provided with a portion (inclined portion 74*b*3) which cannot transmit the driving force, but is considered that the developing device drive output member 62 is provided with a portion not transmitting the driving force. In such a case, the drive transmission can be stopped if when the release cam 72 causes the developing device drive output member 62 to retract (when the release cam 72 is in the outside position), the drive inputting portion 74*b* contacts only to the developing device drive output member 62.

This modified example has been described as a modification of Embodiment 1, but it is applicable also to the other embodiments which will be described hereinafter.

FIG. 18 shows another modified example. Part (a) of FIG. 18 is a sectional view in which the release cam 72 is in the outside position, and part (b) of FIG. 18 is a perspective view.

With this structure described in the foregoing, the surface (end surface) 72*k*1 of the free end of cylindrical portion 72*k* of the release cam 72 functions as an urging portion for urging the developing device drive output member 62 (FIG. 15). That is, the urging portion for urging the developing device drive output member 62 has an annular shape (ring-like).

In this modified example, three projections 72*k*2 are provided in the free end side of the cylindrical portion 72*k* as the urging portion. These projections 72*k*2 are effective to urge the developing device drive output member 62 to make it retracted to the first position (coupling release position). In other words, a plurality of urging portions for urging the developing device drive output member 62 are provided. The number of the urging portions is not limited to three. It may be two, four or more.

When employing a plurality of urging portions, they are preferably arranged at regular intervals with respect to the rotational axis, since then the developing device drive output member 62 can be stably urged and retracted by the plurality of the urging portions. In this embodiment, two adjacent ones of the three projections 72*k*2 are all the same (at regular intervals). When the number of the projections 72*k*2 is two, the projections 72*k*2 are provided at diametrically opposite positions.

In addition, the configurations and the sizes of the projections 72*k*2 are the same, so that the projection amounts of the projections 72*k*2 (the positions of the free ends of the projection 72*k*2 with respect to the longitudinal direction of the developing roller) are all the same. By this, the developing device drive output member 62 can be stably urged.

FIG. 19 shows a further modified example. Part (a) of FIG. 19 is a sectional view in which the release cam 72 is in the outside position, and part (b) of FIG. 19 is a perspective view.

In the above-described examples, the drive inputting portion 74*b* has a twisted triangular shape, but in the modified example of FIG. 20, three projections are provided as the drive inputting portion 974*b*. The shapes of the drive inputting portions 974*b* are the same, and the shapes and the sizes thereof may be any if the driving force from the developing device drive output member 62 can be received.

This modified example has been described as a modification of Embodiment 1, but it is applicable also to the other embodiments which will be described hereinafter.

Difference from Conventional Examples

Here, the description will be made as to the difference of this embodiment from conventional examples.

In Japanese Laid-open Patent Application 2001-337511, the developing roller is provided at the end portion with a coupling for receiving the driving force from the main assembly of the image forming apparatus and a spring clutch for switching the drive transmission. In addition, there is provided a link interrelated with rotation of the developing unit in the process cartridge. When the developing roller is spaced from the drum by the rotation of the developing unit, the link acts on the spring clutch provided at the end portion of the developing roller to stop the drive transmission to the developing roller.

The spring clutch per se involves variations. More particularly, there is a time lug from the actuation of the spring clutch to the actual stop of the drive transmission. In addition, by the dimension variations of the link mechanism and the variation in the angle of rotation of the developing unit, the timing at which the link mechanism acts on the spring clutch may vary. The link mechanism actable on the spring clutch is disposed not on the rotational center of the developing unit and the drum unit.

In this embodiment, on the other hand, the structure for switching the drive transmission to the developing roller (contact portion 72*a* of the release cam 72, contact portion 73*a* as the operating portion of the release lever 73 actable thereon) is employed, so that the control variation of the rotation period of the developing roller can be reduced.

Furthermore, these structural elements are disposed coaxially with the rotational center at which the developing unit is rotatably supported by the drum unit. At the position of the rotational axis, the relative position error between the drum unit and the developing unit is minimum. Therefore, by placing the structure for switching the drive transmission to the developing roller at the rotational axis or center, the switching timing of the drive transmission responsive to the angle of the rotation of the developing unit can be most accurately control. As a result, the rotation period of the developing roller can be controlled with high precision, and therefore, the deterioration of the developer and/or the developing roller can be suppressed.

In addition, in some conventional image forming apparatus and process cartridge, the clutch for switching the drive transmission to the developing roller is provided in the main assembly of the image forming apparatus.

For example, when a monochromatic printing is carried out in a full-color image forming apparatus, the driving of the developing devices containing non-black developers is prevented using the clutch. In addition, also in a monochromatic image forming apparatus, when an electrostatic latent image on the drum is being developed by the developing device, the drive is transmitted to the developing device, but when the developing operation is not carried out, the drive to the developing device is prevented using a clutch. By controlling the rotational period of the developing roller by stopping the drive transmission to the developing device during the non-image forming operation, the rotation period of the developing roller is reduced, and therefore, the deterioration of the developer and/or the developing roller can be suppressed.

As compared with the case that the clutch for switching the drive transmission to the developing roller is provided in the main assembly of the image forming operation, the structure of this embodiment effective to downsize the clutch (releasing mechanism including release cam 72 and so on in this embodiment) for switching the drive transmission. FIG. 20 is a block diagram chewing an example of a gear arrangement in the main assembly of an image forming apparatus in the case that the driving force is transmitted from a motor (driving source) provided in the main assembly of the image forming apparatus. When the driving force is transmitted from a motor 83 to a process cartridge P (PK), it is transmitted through an idler gear 84 (K), a clutch 85 (K) and an idler gear 86 (K). When the driving force is transmitted from a motor 83 to a process cartridge P (PY, PM, PC), it is transmitted through an idler gear 84 (YMC), a clutch 85 (YMC) and an idler gear 86 (YMC). The drive of the motor 83 is divided into the driving force to the idler gear 84 (K) and the driving force to the idler gear 84, and the drive from the clutch 85 (YMC) is divided into the driving forces to the idler gear 86 (Y), to the idler gear 86 (M) and to the idler gear 86 (C).

When, for example, the monochromatic printing is carried out in the full-color image forming apparatus, the drive transmissions to the developing devices containing non-black developers is stopped using the clutch 85 (YMC). When the full-color printing is carried out, the drive from the motor 83 is transmitted to the respective process cartridges P through the clutch 85 (YMC). At this time, the load is concentrated on the clutch 85 (YMC) to drive the respective process cartridges P. Particularly, the clutch 85 (YMC) is given the load which is 3-times the load applied to the clutch 85. The load variations of the respective color developing devices are applied also to the single clutch 85 (YMC). In order to accomplish drive transmission while keeping the rotational accuracy of the developing roller even in the case of the load concentration and variations, the stiffness of the clutch has to be enhanced. Therefore, the clutch is upsized, or a high stiffness material such as sintered metal has to be used. On the other hand, when the clutches are provided for respective process cartridges (releasing mechanism including release cam 72 and so on in this embodiment), the load and the load variation is only that provided by the associated developing device. For this reason, it is not necessary to enhance the stiffness, and therefore, the clutch can be downsized.

In addition, in the gear arrangement for the drive transmission to the black color process cartridge P (PK), the load applied to the drive switching clutch 85 (K) is reduced as much as possible. In a gear arrangement four drive transmission to a process cartridge P, a load applied to a gear shaft is lower when it is closer to the process cartridge P (driven member) in view of a drive transmission efficiency of the gear. Therefore, the clutch can be downsized by placing the clutch between the cartridge and the main assembly as compared with the case in which the clutch is placed in the main assembly of the image forming apparatus.

Embodiment 2

Referring FIG. 21-FIG. 29, Embodiment 2 of the present invention will be described. A release cam 172, a spring 170 and a release lever 173 of this embodiment correspond to the release cam 72, the spring 70 in the release lever 73 of above-described Embodiment 1. On the other hand, the positions, the structures and functions of the release cam 172, the spring 170 and the release lever 173 are partly different from those of the release cam 72, the spring 70 and the release lever 73. The description will be made as to Embodiment 2. In the following, the description may be omitted for the portions for which the description in Embodiment 1 applies.

[Drive Transmission to Developing Roller]

Referring to FIGS. 21 and 22, the structure of the drive connecting portion will be described.

The drive connecting portion of this embodiment includes a drive input member 74, the release lever 173, the release cam (releasing member, movable member) 172, the spring 170 a developing device covering member 32 and a driving side cartridge cover member 24.

As shown in FIGS. 21 and 22, a shaft portion 74*x* of the drive input member 74 penetrates an opening 170*a* of the spring 170, an opening 172*f* of the release cam, an opening 173*d* of the release lever 173, an opening 32*d* of the developing device covering member 32 and an opening 24*e* of the driving side cartridge cover member 24. A drive inputting portion 74*b* at the free end of the shaft portion 74*x* is exposed outwardly of the cartridge.

(Structure of Drive Connecting Portion)

Referring to FIGS. 21, 22 and 23, the drive connecting portion will be described in more detail.

Between the driving side cartridge cover member 24 and a bearing member 45, provided are the drive input member 74, the spring 170, the release cam 172, the release lever 173 in the developing device covering member 32 in the order named from the bearing member 45 toward the driving side cartridge cover member 24. That is, the drive input member 74, the spring 170, the release cam 172, the release lever 173 and the developing device covering member 32 are disposed in the order named from the inside toward the outside in the longitudinal direction of the developing roller. The rotational axes of these members are coaxial with the rotational axis (rotation axis X) of the drive input member 74.

Parts (a) and (b) of FIG. 23 are schematic sectional views of the drive connecting portion.

As described hereinbefore, a portion to be born 74*p* (inner surface of the cylindrical portion) of the drive input member 74 and the first bearing portion 45*p* (outer surface of the cylindrical portion) of the bearing member 45 are engaged with each other. In addition, the cylindrical portion 74*q* of the drive input member 74 and the inside circumference 32*q* of the developing device covering member 32 are engaged with each other. That is, the drive input member 74 is rotatably supported by the bearing member 45 and the developing device covering member 32 at each of the opposite end portions.

Outside the developing device covering member 32 with respect to the longitudinal direction of the cartridge P, the driving side cartridge cover member 24 is provided. Part (a) of FIG. 23 is a schematic sectional view illustrating an engaged state (coupled state) between the drive inputting portion 74*b* of the drive input member 74 and the recess 62*b* of the developing device drive output member 62 of the main assembly. In this manner, the drive inputting portion 74*b* is projected outwardly of the cartridge beyond an opening plane of the opening 24*e* of the driving side cartridge cover member 24.

Between the drive input member 74 and the release cam 172, the spring 170 (elastic member) as an urging member is provided so as to urge the release cam 172 in the direction indicated by an arrow M (outwardly of the cartridge in the longitudinal direction of the developing roller).

Between the developing device covering member 32 and the release cam 172, the release lever 173 is provided as an urging mechanism for urging the release cam 172 in the direction of an arrow N (inwardly of the cartridge in the longitudinal direction of the developing roller) against an urging force of the spring 170. The release lever 173 is a rotatable member rotatable relative to the release cam 172 and the developing device frame and is an operating member for moving the release cam 172 by acting on the release cam 172.

Part (b) of FIG. 23 is a schematic sectional view of the state in which the drive inputting portion 74*b* is decoupled from the recess 62*b* of the developing device drive output member 62. The release cam 172 is movable in the direction of the arrow M (outward of the cartridge) by being urged by the spring 170. By the movement of the release cam 172 in the direction of the arrow M, the developing device drive output member 62 is urged to move in the direction of the arrow M to space the developing device drive output member 62 from the drive inputting portion 74*b*. By this, the drive input member 74 (drive inputting portion 74*b*) and the developing device drive output member 62 (recess 62*b*) are disengaged from each other, so that the rotational force is not transmitted from the recess 62*b* to the drive inputting portion 74*b*.

(Releasing Mechanism)

The releasing mechanism (drive disconnecting mechanism) will be described.

FIG. 24 shows a relationship between the release cam 172, the release lever 173 and the developing device covering member 32. The release cam 172 includes a substantially cylindrical portion 172*k*, a disk portion 172*g* provided at the end surface of the cylindrical portion 172*k* and expanding outwardly of the cylindrical portion, a guide groove 172*h* provided on the disk portion 172*g*. In this embodiment, the guide groove 172*h* is a recess of the disk portion 172 which is radially recessed.

The cylindrical portion 172*k* of the release cam 172 penetrates the opening 173*d* of the release lever 173, and the slidably (along the rotation axis X) supported in the opening 32*d* of the developing device covering member 32. In other words, the release cam 172 is movable substantially in parallel with the rotational axis of the developing roller 6 relative to the developing device covering member 32.

The release lever 173 is provided between the disk portion 172*g* of the release cam 172 and the developing device covering member 32. The disk portion 172*g* is a portion-to-be-urged (elastic force receiving portion) to be urged by the spring 170. By the disk portion 172*g* receiving the elastic force from the spring 170, the release cam 172 is urged outwardly of the cartridge P (to the outside position which will be described hereinafter in conjunction with FIG. 29). That is, the disk portion 172*g* is a releasing member side force receiving portion (outward force receiving portion) for receiving, from the spring 170, the force for moving the release cam 172 to the outside position. As will be described in detail hereinafter, the release cam 172 urges a drive output member 62 by the force received by the disk portion 172*g*.

The centers of the cylindrical portion 172*k* of the release cam 72 and the opening 32*d* of the developing device covering member 32 are on the same axis.

The developing device covering member 32 is provided with a guide 32*h* as a guide portion, and the release cam 172 is provided with a guide groove 172*h* as a portion-to-be-guided. The guide 32*h* extends in parallel with the axial direction. The guide 32*h* of the developing device covering member 32 is engaged with the guide groove 172*h* provided in the release cam 172 as the decoupling member. By the engagement between the guide 32*h* and the guide groove 172*h*, the release cam 172 is slidable only in the axial direction (arrows M and N) relative to the developing device covering member 32.

The guide groove 172 rather than the guide 32*h* may be extended in parallel with the rotational axis X. That is, the thickness of the disk portion 172*g* is made larger so that the guide groove has a constant width along the rotation axis X.

The guide 32*h* is a projection in the guide groove 172 is a recess, but the guide portion of the developing device covering member 32 may be a recess, and the portion-to-be-guided of the release cam 172 may be a projection, for example. The configurations are not limiting to the present invention.

FIG. 25 shows the structures of the release lever 173 and the release cam 172.

The decoupling member and the release cam 172 as the movable member are provided with a contact portion (inclined surface) 172*a* and a contact portion 172*c*, respectively. The release lever 173 is provided with a contact portion (inclined surface) 173*a* as an operating portion actable on the contact portion 172*a* of the release cam 172, and a contact portion 173*c* as an operating portion actable on the contact portion 172*c* of the release cam 172.

The contact portion 172*a* and the contact portion 173*a* are inclined relative to the rotation axis X. The contact portion 173*a* of the release lever 173 and the contact portion 172*a* of the release cam 172 are contactable with each other.

The contact portion 173*c* and the contact portion 172*c* are surfaces substantially perpendicular to the rotation axis X. The contact portion 173*a* of the release lever 173 and the contact portion 172*a* of the release cam 172 are contactable with each other.

The release lever 173 is a rotatable member rotatable about the rotation axis X relative to the developing device frame (bearing member 45, developing device covering member 32).

FIG. 25 shows a example in which two of the contact portions 173*a* of the release lever 173, two of the contact portions 173*c* of the release lever 173, two of the contact portions 172*a* of the release cam 172, and two of the contact portions 172*c* of the release cam 172 are provided, but the numbers of these elements are is not limited to two. For example, the numbers may be three.

[Drive Disconnecting Operation]

Referring to FIG. 7 and FIGS. 26-29, the operation of the drive connecting portion when the state thereof change from the state in which the developing roller 6 and the drum 4 contact with each other to the state in which they are spaced from each other will be described. For better illustration, FIGS. 26-29 omit some parts, and the release lever and the release cam are partly schematically shown.

[State 1]

As shown in part (a) of FIG. 7, the spacing force urging member 80 and the urging force receiving portion 45*a* of the bearing member 45 are spaced from each other by a gap d. In this case, the drum 4 and the developing roller 6 contact with each other. This state is called "state 1" of the spacing force urging member 80. The state of the drive connecting portion is as shown in FIG. 27.

In part (a) of FIG. 27, a pair of the drive input member 74 and the developing device drive output member 62 and the pair of the release cam 72 and the release lever 73 are separately and schematically shown. Part (b) of FIG. 27 is a perspective view illustrating a structure of the drive connecting portion.

The contact portion 172*a* of the release cam 172 and the contact portion 173*a* of the release lever 173 are not contacted with each other. On the other hand, the contact portion 172*c* of the release cam 172 and the contact portion 173*c* of the release lever 173 contacts with each other. The contact portion 172*c* receives a reaction force from the contact portion 173*c* in the direction of the arrow N. By this, the release lever 173 urges the release cam 172 inwardly of the cartridge P (inward in the longitudinal direction of the developing roller, arrow N) against the force of the spring 170 (FIG. 22) urging the release cam 172 in the direction of the arrow M. Therefore, the release lever 173 prevents the movement of the release cam 172 outward of the cartridge P (outward in the longitudinal direction) to keep it in the inside position retracted in the cartridge (inside in the longitudinal direction).

That is, the contact portion 173*c* of the release lever functions as a limiting portion for limiting outward movement of the release cam 172 by the contact with the limited portion (contact portion 172*c*) of the release cam 172.

At this time, the developing device drive output member 62 is in the second position, and the drive inputting portion 74*b* of the drive inputting portion 74 and the developing device drive output member 62 are engaged with each other by an engagement amount q, and therefore, the drive transmission is possible.

[State 2]

When the spacing force urging member 80 move from the development-contact-and-drive-transmission position in the direction of an arrow F1 in the Figure by δ1, as shown in part (b) of FIG. 7, the developing unit 9 rotates by an angle θ1 about the rotation axis X in the direction of the arrow K. As a result, the developing roller 6 spaces from the drum 4 by a distance ε1. The release cam 172 and the developing device covering member 32 of the developing unit 9 rotate in interrelation with the rotation of the developing unit 9 by the angle θ1 in the direction indicated by an arrow K. On the other hand, when the cartridge P is mounted in the main assembly 2, the drum unit 8, the driving side cartridge cover member 24 and the non-driving side cartridge cover member 25 are fixed in place relative to the main assembly 2.

As shown in FIG. 26, the release lever 173 of the developing unit 9 is provided with the force receiving portion (projected portion, portion-to-be-engaged) 173*b* projected from a ring configuration portion of the release lever 173 in a direction of a line perpendicular to the rotation axis X. The force receiving portion 173*b* is engaged with an engaging portion 24*s* provided on the driving side cartridge cover member 24, by which the rotation of the release lever 73 is limited. Even if the rotation of the release lever 173 is limited, the developing unit 9 is capable of rotating because the developing device covering member 32 is provided with an opening 32*c*.

The release cam 172 is rotated in interrelation with the rotation of the developing unit 9 in the direction indicated by the arrow K in the Figure relative to the release lever 173 which is limited in the rotation. However, a part of the contact portion 172*c* of the release cam 172 and a part of the contact portion 173*c* of the release lever are in contact with each other, and therefore, the movement of the release cam 172 in the direction of the arrow M is still limited by the release lever 173. That is, the release cam 172 is kept in the inside position. At this time, the developing device drive output member 62 is in the second position, in which the drive inputting portion 74*b* of the drive input member 74 and the developing device drive output member 62 keep in engagement with each other (part (a) of FIG. 28).

Therefore, the driving force inputted to the drive input member 74 from the main assembly 2 is being transmitted to the developing roller 6 through the developing roller gear 69.

[State 3]

Part (a) of FIG. 29 and part (b) of FIG. 29 illustrate the drive connecting portion at the time when the main assembly side urging member of the spacing force urging member 80 move from the developing device separation drive transmission position in the direction indicated by the arrow F1 in the Figure by δ2 as shown in part (c) of FIG. 7. By the spacing force urging member 80 moving by δ2, the developing unit 9 is rotated by a angle θ2 (>1) by the urging force receiving portion 45*a* receiving the force from the spacing force urging member 80.

In interrelation with the rotation of the developing unit 9 through the angle θ2 by the spacing force urging member 80, the release cam 172 and the developing device frame (developing device frame 29, bearing member 45 and developing device covering member 32) are rotated in the direction indicated by the arrow K in the Figure. On the other hand, the release lever 173 does not change its position from the state 2 position because of the engagement with the engaging portion 24*s* provided on the cartridge cover member 24, similarly to the foregoing example. That is, the release lever 173 rotates relative to the developing device frame and the release cam 172.

At this time, the contact surface 172*c* of the release cam 172 and in the contact portion (limiting portion) 173*c* of the release lever 173 is broken. That is, the release cam 172 becomes not restricted in its movement by the contact portion 173*c* of the release lever.

Here, as described hereinbefore, the release cam 172 is capable of the sliding movement in the axial direction (arrows M and N directions) by the guide groove 172*h* of the release cam 172 engaging with the guide 32*h* of the developing device covering member 32 (FIG. 24). Therefore, the release cam 172 moves in the direction of the arrow M outwardly of the cartridge P (outwardly in the longitudinal direction of the developing roller) by the force of the spring 170, while the contact portion 172*a* thereof is sliding on the contact portion 173*a* of the release lever 173.

That is, the release cam 172 slides relative to the release lever 173 in the direction of the arrow M by movement distance p. By this, in interrelation with the movement of the release cam 172 in the direction indicated by an arrow M, the cylindrical portion 172*k* of the release cam 172 overlaps with the drive inputting portion 74*b* of the drive input member 74 in the axis X direction. The free end of the cylindrical portion 172*k* of the release cam 172 slides the developing device drive output member 62 in the direction of the arrow M by the movement distance p.

In summary, the urging force produced by the main assembly 2 is transmitted to the bearing member 45 (urging force receiving portion 45*a*) of the cartridge P through the spacing force urging member 80. By this, the developing unit 9 (developing device frame, release cam 172) rotates by the angle 2 (part (c) of FIG. 7). By the release lever 173 engaged with the driving side cartridge cover member 24 moving relative to the developing device frame and the release cam 172, the prevention of the movement of the release cam 172 is released. As a result, the release cam 172 is moved to the outside position, and urges the developing device drive output member 62 the free end of the cylindrical portion 172*k* (urging portion), using the elastic force (urging force) received by the disk portion 172*g* (FIG. 24) from the spring 170 (FIG. 21). And, the release cam 172 moves the developing device drive output member 62 in the direction of the arrow M to retract it to the first position (part (b) of FIG. 23, FIG. 29).

At this time, as shown in FIGS. 28 and 29, the movement distance p of the developing device drive output member 62 is larger than the engagement amount q between the drive input member 74 and the developing device drive output member 62, and therefore, the engagement between the drive input member 74 and the developing device drive output member 62 is broken. Although the developing device drive output member 62 of the main assembly 2 continues to rotate, the drive input member 74 stops. As a result, the rotation of the developing roller gear 69 and therefore the rotation of the developing roller 6 stop.

As the release cam 172 and the drive inputting portion 74*b* are projected on a phantom line parallel with the rotational axis of the developing roller 6, an area of the release cam 172 and an area of the drive inputting portion 74*b* (rotational force receiving portion 74*b*4, FIG. 17) overlap at least partly with each other, when the release cam 172 moved to the outside position. In this embodiment, the area of the drive inputting portion 74*b* is within the area of the release cam 172.

As described hereinbefore, the movement distance p through which the developing device drive output member 62 is moved from the second position to the first position by the sliding of the release cam 172 is preferably larger than the engagement amount q between the drive input member 74 and the developing device drive output member 62. That is, in the state that the release cam 172 is in the outside position (FIG. 29), the urging portion (free end of the release cam 172) of the release cam 172 is preferably outside as compared with the free end of the drive inputting portion 74*b* in the longitudinal direction of the developing roller 6.

However, the end surface (free end) of the drive inputting portion 74*b* and the end surface of the release cam 172 may be substantially in the same plane. In addition, the position of the free end of the release cam 172 may be inside the position of the free end of the drive inputting portion 74*b*, if the drive transmission to the rotational force receiving portion 74*b*4 (FIG. 17) 2 of the drive input member 74 is not effected.

In the foregoing, the operation of the drive disconnection to the developing roller 6 in interrelation with the rotation of the developing unit 9 in the direction of the arrow K has been described. By employing such a structure, the developing roller 6 can be spaced from the drum 4 while rotating. As a result, the drive transmission to the developing roller 6 can be stopped depending on the spacing distance between the developing roller 6 and the drum 4.

[Drive Connecting Operation]

The description will be made as to the operation of the drive connecting portion when the state changes from the state in which the developing roller 6 is spaced from the drum 4 to the state in which the are contacted with each other. This operation is opposite from the operation from the contact state to the spaced-developing-device-state described in the foregoing.

In the spaced-developing-device-state (the developing unit 9 is in the angle θ2 position, as shown in part (c) of FIG. 7), the drive connecting portion is in the state that the drive input member 74 and the developing device drive output member 62 are disconnected from each other, as shown in FIG. 15. That is, the developing device drive output member 62 is in the first position.

When the spacing force receiving member 145 is retracted gradually from the urging force receiving portion 45*a* in the direction of an arrow F2, the developing unit 9 is rotated by the force of an urging spring 95 (FIG. 4) in the direction of an arrow H shown in FIG. 7 (reverse rotation as compared with the K direction described above).

At this time, as shown in FIG. 26, the release lever 173 does not rotate because the force receiving portion 173*b* is in engagement with an engaging portion 24*t* which is the limiting portion for the cartridge cover member 24. As a result, the release cam 172 rotating with the developing unit 9 rotates relative to the release lever 173. That is, the release lever 173 rotates relative to the release cam 172.

By the rotation of the release lever 173 relative to the release cam 172, the contact portion 173*a* (rotatable member side urging portion, operating member side urging portion) of the release lever 173 applies a force to the contact portion 172*a* of the release cam 172 in the direction of the arrow N. The contact portion 172*a* functions as a force receiving portion (second releasing member side force receiving portion, inward force receiving portion) for receiving from the release lever 173 the force in the direction of the arrow N (inward of the cartridge P).

With the rotation of the release lever 173, the release cam 172 moves in the direction of the arrow N against the force of the spring 170, while the contact portion 172*a* is sliding on the contact portion 173*a*.

When the developing unit 9 rotates by the angle θ1 (to the state shown in part (b) of FIG. 7 and FIG. 28), the contact portion 172*c* of the release cam 172 contacts the contact portion 173*c* of the release lever 173 to receive a reaction force. The contact portion 173*c* of the release lever 173 keeps the release cam 172 in the inside position by the urging it in the direction of the arrow N against the urging force of the spring 170.

With this, the developing device drive output member 62 is also urged to the second position in the direction of the arrow N by a spring (unshown) from the main assembly 2. Then, the drive input member 74 is engaged with the developing device drive output member 62, as shown in FIG. 28.

By this, the driving force is transmitted from the main assembly 2 to the developing roller 6, thus rotating the developing roller 6. At this time, the developing roller 6 and the drum 4 are kept spaced from each other.

From this state, the spacing force urging member 80 is further rotated in the direction of the arrow F2 to gradually rotate the developing unit 9 in the direction of the arrow H as shown in FIG. 7, by which the developing roller 6 can be brought into contact to the drum 4 (part (a) of FIG. 7). Also in this state, the developing device drive output member 62 is in the second position.

In the foregoing, the drive transmission operation to the developing roller 6 in interrelation with the rotation of the developing unit 9 in the direction of the arrow H has been described.

In summary, when the force received by the urging force receiving portion 45*a* decreases by the spacing force urging member 80 separating from the urging force receiving portion 45*a*, the developing unit 9 rotate in the direction of the arrow H by the force of the urging spring 95 (FIG. 4). By this, the release lever 173 rotates relative to the release cam 172 and the developing device frame.

Using the force of the urging spring 95, the release lever 173 applies of the force to the contact portion of the release cam 172 (second releasing member side force receiving portion) 172*a* at the contact portion 173*a* (rotatable member side urging portion, operating member side urging portion) in the direction of the arrow N. That is, the release lever 173 moves the release cam 172 in the direction of the arrow N using the force of the urging spring 95.

When the release cam 172 moves to the inside position, the release lever 173 prevents the movement of the contact portion (limited portion) 172*c* of the release cam 172 in the direction of the arrow M by the contact portion (limiting portion) 173*c*. By this, the release cam 172 is kept in the inside position.

With this structure described above, the developing roller 6 is brought into contact to the drum 4 while rotating, and the driving force can be transmitted to the developing roller 6 depending on the spacing distance between the developing roller 6 and the drum 4.

As described in the foregoing, with the above-described structure, the switching between the drive disconnection and the drive transmission to the developing roller 6 can be definitely determined on the basis of the angle of rotation of the developing unit 9.

Embodiment 3

Referring FIG. 30-FIG. 37, Embodiment 3 of the present invention will be described. A release cam 272, a spring 270, a driving side cartridge cover 224 and a developing device covering member 232 correspond to the release cam 72, the spring 70, the release lever 73, the driving side cartridge cover 24 and the developing device covering member 32 of Embodiment 1, respectively.

On the other hand, the positions, the structures and the functions of the release cam 272, the spring 270, the driving side cartridge cover 224 and the developing device covering member 232 are partly different from those of the release cam 72, the spring 70, the driving side cartridge cover 24 and the developing device covering member 32, respectively. In this embodiment, no release lever 73 is provided. In addition, the release cam (releasing member, movable member) 272 is rotatable relative to the developing device frame. In the following, the detailed description will be made particularly on the points different from the foregoing embodiments. In the description of this embodiment, the same reference numerals as in Embodiments 1 and 2 are assigned to the elements having the corresponding functions in this embodiment, and the detailed description thereof is omitted for simplicity.

[Drive Transmission to Developing Roller].

Referring to FIGS. 30 and 31, the structure of the drive connecting portion will be described.

In this embodiment, the drive connecting portion includes a drive input member 74, the release cam 272, the spring 270, the developing device covering member 232 and the driving side cartridge cover member 224.

As shown in FIGS. 30, 31, the cartridge side drive transmission member 74 extends through an opening 224*e* of the driving side cartridge cover member 224, an opening 232*d* of the developing device covering member 232, an opening 270*a* of the spring 270 and an opening 272*f* of the cartridge cover member 224 to engage with a developing device drive output member 62. More particularly, as shown in FIG. 30, the driving side cartridge cover member 224 which is a frame provided at a longitudinal end portion of the cartridge is provided with the openings 224*e* and 224*d* which are through-openings. The developing device covering member 232 connected with the driving side cartridge cover member 224 includes a cylindrical portion 232*b* which is provided with the opening 232*d* which is a through-opening.

A shaft portion 74*x* of the drive input member 74 extends through the opening 270*a* of the spring 270, the opening 272*f* of the release cam 272, the opening 232*d* of the developing device covering member 232 and the opening 224*e* of the driving side cartridge cover member 224. A drive inputting portion 74*b* at the free end of the shaft portion 74*x* is exposed outwardly of the cartridge.

(Structure of Drive Connecting Portion)

Referring to FIGS. 30, 31 and 32, the drive connecting portion will be described in more detail.

The driving side cartridge cover member 224 is a part of the frame at the longitudinal end portion of the cartridge P. Between the development cartridge cover member 224 and a bearing member 45, the drive input member 74, the spring 270, the release cam 272 and the developing device covering member 232 are arranged in the direction from the bearing member 45 toward the driving side cartridge cover member 224. That is, in the direction from the inside toward the outside in the longitudinal direction of the developing roller, the drive input member 74, the spring 270, The release cam 272 and the developing device covering member 232 are disposed in the order named. The rotational axes of these members are coaxial with the rotational axis (rotation axis X) of the drive input member 74.

Parts (a) and (b) of FIG. 32 are schematic sectional views of the drive connecting portion.

As described hereinbefore, a portion to be born 74*p* (inner surface of the cylindrical portion) of the drive input member 74 and the first bearing portion 45*p* (outer surface of the cylindrical portion) of the bearing member 45 are engaged with each other. In addition, the cylindrical portion 74*q* of the drive input member 74 and the inside circumference 232*q* of the developing device covering member 232 are engaged with each other. That is, the drive input member 74 is rotatably supported by the bearing member 45 and the developing device covering member 232 at each of the opposite end portions.

In addition, the centers of the first bearing portion 45*p* (outer surface of the cylindrical portion) of the bearing member 45 and the inside circumference 232*q* of the developing device covering member 232 are coaxial with the rotation axis X of the developing unit 9.

Outside the developing device covering member 232 with respect to the longitudinal direction of the cartridge P, the driving side cartridge cover member 224 is provided.

Part (a) of FIG. 32 is a schematic sectional view illustrating an engaged state (coupled state) between the drive inputting portion 74*b* of the drive input member 74 and the recess 62*b* of the developing device drive output member 62 of the main assembly. In this manner, the drive inputting portion 74*b* is projected outwardly of the cartridge beyond an opening plane of the opening 224 of the driving side cartridge cover member 24.

Between the drive input member 74 and the release cam 272, the spring 270 (elastic member) as an urging member is provided to urge the release cam 272 in the direction of an arrow M (outwardly of the cartridge P).

Part (b) of FIG. 32 is a schematic sectional view of the state in which the drive inputting portion 74*b* is decoupled from the recess 62*b* of the developing device drive output member 62. The release cam 272 is movable in the direction of the arrow M (outward of the cartridge) by being urged by the spring 270.

By the movement in the direction of the arrow M, the release cam 272 urges the developing device drive output member 62 to move it in the direction of the arrow M, thus spacing the developing device drive output member 62 from the drive input member 74. By this, the coupling between the drive inputting portion 74*b* of the drive input member 74 and the recess 62*b* of the developing device drive output member 62 is broken, so that the rotational force is not transmitted from the recess 62*b* to the drive inputting portion 74*b*.

(Releasing Mechanism)

The releasing mechanism (drive disconnecting mechanism) will be described.

FIG. 33 shows a relationship between the release cam 272 and the developing device covering member 232. The release cam 272 is provided with a substantially cylindrical portion 272*k*, a disk portion 272*g* expanding outwardly at an inner end surface of the cylindrical portion 272*k*, a force receiving portion 272*b* (projected portion, portion-to-be-engaged) projecting from the disk portion 272*g*. In this embodiment, the force receiving portion 272*b* is in the form of a projection projecting radially with respect to the disk portion 272*g*.

The cylindrical portion 272*k* of the release cam 272 is supported slidably relative to the opening 232*d* of the developing device covering member 232 (slidable along the rotational axis of the developing roller 6). In other words, the release cam 272 is movable substantially in parallel with the rotational axis of the developing roller 6 relative to the developing device covering member 232.

The disk portion 272*g* functions as a portion-to-be-urged (elastic force receiving portion) urged by the spring 270 (FIG. 30). By the disk portion 272*g* receiving the elastic force from the spring 270, the release cam 172 is urged outwardly of the cartridge P (to the outside position which will be described hereinafter in conjunction with FIG. 37).

The disk portion 272*g* functions as a force receiving portion (releasing member side force receiving portion) for receiving a force outward of the cartridge P (outward in the longitudinal direction of the developing roller).

The centers of the cylindrical portion 272*k* of the release cam 272 and the opening 432*d* of the developing device covering member 232 are on the same axis.

The release cam 272 as the decoupling member is provided with a contact portion inclined surface, contact surface) 272*a* and a contact portion 272*c*. The developing device covering member 232 is provided with a contact portion (inclined surface, contact surface) 232*g* functioning as an operating portion actable on the contact portion 272*a* of the release cam 272, and a contact portion (contact surface) 232*f* as an operating portion actable on a contact portion 272*c* of the release cam 272.

The contact portion 272*a* of the release cam 272 and the contact portion 232*g* of the developing device covering member 232 are contactable to each other. The contact portion 272*a* of the release cam 272 and the contact portion 232*g* of the developing device covering member 232 are inclined relative to the rotation axis X.

The contact portion 272*c* of the release cam 272 and the contact portion 232*f* of the developing device covering member 232 are contactable to each other. The contact portion 272*c* of the release cam 272 and the contact portion 232*f* of the developing device covering member 232 are substantially perpendicular to the rotation axis X.

The release cam 272 is a rotatable member rotatable relative to the developing device frame (bearing member 45, developing device covering member 232) about the rotation axis X. That is, the release cam 272 is capable of rotatable about the axis X and slidable along the axis X relative to the bearing member 45 and the developing device covering member 232.

In the example of FIG. 33, two of the contact portions 232*g* of the developing device covering member 232, two of the contact portions 232*f* thereof, two of the contact portions 272*a* of the release cam 272, and two of the contact portions 272*c* thereof are provided, respectively, but the numbers are is not limited to two. For example, the numbers may be three.

[Drive Disconnecting Operation]

Referring to FIG. 7 and FIGS. 34-37, the operation of the drive connecting portion when the state thereof changes from the state in which the developing roller 6 and the drum 4 contact with each other to the state in which they are spaced from each other. For better illustration, FIGS. 334-37 omit some parts, and the release lever and the release cam are partly schematically shown.

[State 1]

As shown in part (a) of FIG. 7, the spacing force urging member 80 and the urging force receiving portion (spacing force receiving portion) 45*a* of the bearing member 45 are spaced from each other by a gap d. In this case, the drum 4 and the developing roller 6 contact with each other. This state is called "state 1" of the spacing force urging member 80. The state of the drive connecting portion is as shown in FIG. 35. In part (a) of FIG. 35, the pair of the drive input member 74 and the developing device drive output member 62, and the pair of the release cam 272 and the developing device covering member 232 are schematically and separately shown. Part (b) of FIG. 35 is a perspective view illustrating a structure of the drive connecting portion.

The contact portion 272*a* of the release cam 272 and the contact portion 232*g* of the developing device covering member 232 are not contacted with each other.

On the other hand, the contact portion 272*c* of the release cam 272 and the contact portion 232*f* of the developing device covering member 232 are contacted with each other. The contact portion 272*c* receives a reaction force from the contact portion 273*f* in the direction of the arrow N. That is, the developing device covering member 232 applies to the release cam 272 of force in the direction of the arrow N opposite to the direction of the force of the spring 270 (FIG. 31) urging the release cam 272 in the direction of the arrow M.

The contact portion 232*f* of the developing device covering member 232 functions as a limiting portion for limiting movement of the release cam 272 by the force of the spring 270 outwardly of the cartridge P (outside position), by contacting to a portion-to-be-limited (contact portion 272*c*) of the release cam 272. The developing device covering member 232 prevents the release cam 272 from moving outwardly of the cartridge P (in the longitudinal direction) to keep the release cam 272 in the inside position retracted in the cartridge (in the longitudinal direction).

At this time, the developing device drive output member 62 is in the second position, and the drive inputting portion 74*b* of the drive input member 74 and the recess 62*b* of the developing device drive output member 62 are engaged with each other by an engagement amount q, and therefore, the drive transmission is possible.

[State 2]

When the spacing force urging member 80 move from the development-contact-and-drive-transmission position ion the direction of an arrow F1 in the Figure by δ1, as shown in part (b) of FIG. 7, the developing unit 9 rotates by an angle θ1 about the rotation axis X in the direction of the arrow K. As a result, the developing roller 6 spaces from the drum 4 by a distance ε1. The developing device covering member 232 in the developing unit 9 rotates in the direction of the arrow K by an angle θ1 in interrelation with the rotation of the developing unit 9. On the other hand, when the cartridge P is mounted in the main assembly 2, the drum unit 8, the driving side cartridge cover member 224 and the non-driving side cartridge cover member 25 are fixed in place relative to the main assembly 2.

As shown in FIG. 34, the release cam 272 in the developing unit 9 is provided with a force receiving portion (projected portion, portion-to-be-engaged) 272*b* projected in a normal direction of the rotation axis X from the release cam 272. The force receiving portion 272*b* is engaged with an engaging portion 224*s* provided on the driving side cartridge cover member 224, by which the rotation is limited. Therefore, even if the rotation of the release cam 272 is limited, the developing unit 9 is capable of rotating, because of the provision of an opening 232*c* in the developing device covering member 232.

The developing device covering member 232 rotates in the direction of the arrow K in the Figure in interrelation with the rotation of the developing unit 9, relative to the release cam 272 which is limited in the rotation. However, because a part of the contact portion 272*c* of the release cam 272 and a part of the contact portion 232*f* of the developing device covering member 232 are contacted to each other, the release cam 272 is still limited by the developing device covering member 232 in the movement in the direction of the arrow M. That is, the release cam 272 is kept in the inside position. At this time, the developing device drive output member 62 is in the second position, in which the drive inputting portion 74*b* of the drive input member 74 and the recess 62*b* of the developing device drive output member 62 are engaged with each other (part (a) of FIG. 36).

Therefore, the driving force inputted to the drive input member 74 from the main assembly 2 is being transmitted to the developing roller 6 through the developing roller gear 69.

[State 3]

Part (a) of FIG. 37 and part (b) of FIG. 37 illustrate the drive connecting portion at the time when the main assembly side urging member of the spacing force urging member 80 move from the developing device separation drive transmission position in the direction indicated by the arrow F1 in the Figure by δ2 as shown in part (c) of FIG. 7. By the spacing force urging member 80 moving by δ2, the developing unit 9 is rotated by a angle θ2 (>θ1) by the urging force receiving portion 45*a* receiving the force from the spacing force urging member 80. In interrelation with the rotation of the developing unit 9 by the spacing force urging member 80 by the angle θ2, the developing device frame (developing device frame 29, bearing member 45, developing device covering member 232) rotates in the direction of the arrow K in the Figure. On the other hand, the release cam 272 does not displace from the state (position) 4 by the engagement with the engaging portion 224*s* of the driving side cartridge cover member 224, similarly to the foregoing. That is, the release cam 272 rotates relative to the developing device frame.

At this time, the contact portion 272*c* of the release cam 272 and the contact portion 232*f* of the developing device covering member become spaced from each other. That is, the release cam 272 is released from the limiting portion (contact portion 2320 of the release lever.

As described above, the release cam 272 is slidable along the axial direction (arrows M and N) while rotating about the axis X relative to the developing device covering member 232.

Therefore, the release cam 272 moves outwardly of the cartridge P by the force of the spring 270 while the contact portion 272*a* thereof is sliding on the contact portion 232*g* of the developing device covering member 232.

That is, the release cam 272 slides relative to the developing device covering member 232 in the direction of the arrow M by the movement distance p. By this, in interrelation with the movement of the release cam 272 in the direction indicated by an arrow M, the cylindrical portion 272*k* of the release cam 272 overlaps with the drive inputting portion 74*b* of the drive input member 74 in the axis X direction. The free end of the cylindrical portion 272*k* of the release cam 272 slides the developing device drive output member 62 in the direction of the arrow M by the movement distance p.

In summary, the urging force produced by the main assembly 2 is transmitted to the bearing member 45 (urging force receiving portion 45*a*) of the cartridge P through the spacing force urging member 80. By this, the developing unit 9 (developing device frame) rotates by θ2 (part (c) of FIG. 7). The developing device frame (developing device covering member 232) rotates relative to the release cam 272 engaged with the driving side cartridge cover member 224. By this, the release cam 272 is released from the developing device covering member 232 preventing the movement of the release cam 272. As a result, the release cam 272 moves to the outside position using the elastic force (urging force) received by the disk portion 272*g* (releasing member side force receiving portion, FIG. 33) from the spring 270 (FIG. 30), and urges the developing device drive output member 62 by the urging portion at the free end portion of the cylindrical portion 272*k*. And, the release cam 272 moves the developing device drive output member 62 in the direction of the arrow M to retract it to the first position (part (b) of FIG. 32, FIG. 37).

The developing device frame (developing device covering member 232) in this embodiment is a rotatable member rotatable relative to the release cam 272, and functions as an operating member actable on the release cam 272 to move in the release cam 272 relative to the driving force input portion 74*b*. The developing device covering member 232 rotates relative to the release cam 272, so as to move the release cam 272 in the direction of the arrow M (outwardly of the cartridge in the longitudinal direction of the developing roller).

When the drive input member 74 retracts to the first position, the movement distance p of the developing device drive output member 62 is larger than the engagement amount q between the drive input member 74 and the developing device drive output member 62 as shown in FIGS. 36 and 37, the engagement between the drive input member 74 and the developing device drive output member 62 is released. Although the developing device drive output member 62 of the main assembly 2 continues to rotate, the drive input member 74 stops. As a result, the rotation of the developing roller gear 69 and therefore the rotation of the developing roller 6 stop.

The release cam 272 and the rotational force receiving portion 74*b*4 (FIG. 17) of the drive inputting portion 74*b* are projected onto a phantom line parallel with the rotational axis of the developing roller 6 when the release cam 272 moves to the outside position. Then, an area of the release cam 272 and an area of the rotational force receiving portion 74*b*4 are overlapped with each other at least partly. In this embodiment, the area of the drive inputting portion 74*b* is within the area of the release cam 272.

As described hereinbefore, the movement distance p through which the developing device drive output member 62 is moved from the second position to the first position by the sliding of the release cam 272 is preferably larger than the engagement amount q between the drive input member 74 and the developing device drive output member 62. That is, in the state that the release cam 272 is in the outside position (FIG. 37), the urging portion (free end of the release cam 272) of the release cam 272 is preferably outside as compared with the free end of the drive inputting portion 74*b* in the longitudinal direction of the developing roller 6.

However, the end surface (free end) of the drive inputting portion 74*b* and the end surface of the release cam 272 may be substantially in the same plane. In addition, even if the position of the free end of the release cam 272 is inside the position of the free end of the drive inputting portion 74*b*, it will suffice if the driving force is not transmitted to the rotational force receiving portion 74*b*4 (FIG. 17) of the drive input member 74.

In the foregoing, the operation of the drive disconnection to the developing roller 6 in interrelation with the rotation of the developing unit 9 in the direction of the arrow K has been described. By employing such a structure, the developing roller 6 can be spaced from the drum 4 while rotating. As a result, the drive transmission to the developing roller 6 can be stopped depending on the spacing distance between the developing roller 6 and the drum 4.

[Drive Connecting Operation]

The description will be made as to the operation of the drive connecting portion when the state change from the state in which the developing roller 6 is spaced from the drum 4 to the state in which they are contacted with each other. This operation is opposite from the operation from the contact state to the spaced-developing-device-state described in the foregoing.

In the spaced-developing-device-state (the developing unit 9 is in the angle θ2 position, as shown in part (c) of FIG. 7), the drive connecting portion is in the state that the drive input member 74 and the developing device drive output member 62 are disconnected from each other, as shown in FIG. 15. That is, the developing device drive output member 62 is in the first position.

When the spacing force receiving member 145 is retracted gradually from the urging force receiving portion 45*a* in the direction of an arrow F2, the developing unit 9 is rotated by the force of an urging spring 95 (FIG. 4) in the direction of an arrow H shown in FIG. 7 (reverse rotation as compared with the K direction described above).

At this time, as shown in FIG. 34, the force receiving portion 272*b* of the release cam 272 is engaged with the engaging portion 224*t* which is the limiting portion for the driving side cartridge cover member 224 and is not rotated. As a result, the developing device covering member 232 rotates relative to the release cam 272.

By the rotation of the developing device covering member 232 relative to the release cam 272, the contact portion of the release covering member 232 (developing device frame side urging portion, rotatable member side urging portion, operating member side urging portion) 232*g* applies a force to the contact portion 272*a* of the release cam 272 in the direction of the arrow N. The contact portion 272*a* functions as a second releasing member side force receiving portion (inward force receiving portion) for receiving the force inward of the cartridge P.

As a result, with the rotation of the developing device covering member 232, the release cam 272 moves in the direction of the arrow N against the force of the spring 270 while the contact portion 272*a* thereof is sliding on the contact portion 232*g*.

In this state in which the developing unit 9 rotates by the angle θ1 (part (b) of FIG. 7 and FIG. 36), the contact portion 272*c* of the release cam 272 starts to contact to the contact portion 232*f* of the developing device covering member 232 two receives the force from the contact portion 232*f*. The contact portion 232*f* of the developing device covering member 232 retains the release cam 272 in the inside position against the urging force of the spring 270.

With the release cam 272 separating from the developing device drive output member 62, the developing device drive output member 62 is urged by a spring (unshown) of the main assembly 2 to move in the direction of the arrow N to the second position. Then, the drive input member 74 is engaged with the developing device drive output member 62, as shown in FIG. 14.

By this, the driving force is transmitted from the main assembly 2 to the developing roller 6, thus rotating the developing roller 6. At this time, the developing roller 6 and the drum 4 are kept spaced from each other.

Then, the spacing force urging member 80 is gradually moved in the direction of the arrow F2, and the developing unit 9 is further rotated in the direction of the arrow H shown in FIG. 7, by which the developing roller 6 can be contacted to the drum 4 (part (a) of FIG. 7). Also in this state, the developing device drive output member 62 is in the second position.

In summary, when the force received by the urging force receiving portion 45*a* decreases by the spacing force urging member 80 separating from the urging force receiving portion 45*a*, the developing device frame (developing device covering member 232) of the developing unit 9 rotates in the direction of the arrow H by the force of the urging spring 95 (FIG. 4).

Using the force of the urging spring 95, the developing device covering member 232 applies the force at the contact portion 232*g* (rotatable member side urging portion) to the contact portion (second releasing member side force receiving portion) 272*a* of the release cam 272 in the direction of the arrow N. That is, the developing device covering member 232 rotates using the force of the urging spring 95 to move the release cam 172 in the direction of the arrow N.

When the release cam 272 is moved to the inside position, the developing device covering member 232 limits the movement of the contact portion (limited portion) 272*c* of the release cam 272 in the direction of the arrow M, by the contact portion (limiting portion) 232*f* By this, the release cam 272 is kept in the inside position.

In the foregoing, the drive transmission operation to the developing roller 6 in interrelation with the rotation of the developing unit 9 in the direction of the arrow H has been described With this structure described above, the developing roller 6 is brought into contact to the drum 4 while rotating, and the driving force can be transmitted to the developing roller 6 depending on the spacing distance between the developing roller 6 and the drum 4.

As described in the foregoing, with the above-described structure, the switching between the drive disconnection and the drive transmission to the developing roller 6 can be definitely determined on the basis of the angle of rotation of the developing unit 9.

Embodiment 4

Referring FIG. 38-FIG. 45, Embodiment 4 of the present invention will be described. A release cam (releasing member) 372, a spring 370, a driving side cartridge cover 324 and a developing device covering member 332 in this embodiment corresponding to the release cam 72, the spring 70, the release lever 73, the driving side cartridge cover 24 and the developing device covering member 32, respectively.

On the other hand, the positions, the structures and the functions of the release cam 372, the spring 370, the driving side cartridge cover 324 and the developing device covering member 324 are partly different from those of the release cam 72, the spring 70, the driving side cartridge cover 24 and the developing device covering member 32, respectively. In this embodiment, no release lever 73 is provided. On the other hand, the release cam 372 is rotatable relative to the developing device frame. In the following, the detailed description will be made particularly on the points different from the foregoing embodiments. In the description of this embodiment, the same reference numerals as in the above-described Embodiments are assigned to the elements having the corresponding functions in this embodiment, and the detailed description thereof is omitted for simplicity.

[Drive Transmission to Developing Roller]

Referring to FIGS. 38 and 39, the structure of the drive connecting portion will be described.

In this embodiment, the drive connecting portion includes a drive input member 74, the release cam 372, the spring 370, the developing device covering member 332 and the driving side cartridge cover member 324.

As shown in FIGS. 38 and 39, the drive input member 74 penetrates an opening 324*e* of the driving side cartridge cover member 324, an opening 332*d* of the developing device covering member 332, an opening 370*a* of the spring 370 and an opening 372*f* of the release cam 372. The drive input member 74 is in coupling engagement with the developing device drive output member 62. More particularly, as shown in FIG. 38, the driving side cartridge cover member 324 which is a frame provided at a longitudinal end portion of the cartridge is provided with the openings 324*e* and 324*d* which are through-openings. The developing device covering member 332 connected with the driving side cartridge cover member 324 includes a cylindrical portion 332*b* which is provided with the opening 332*d* which is a through-opening.

Shaft portion 74*x* of the drive input member 74 is penetrated through the opening 332*d* of the developing device covering member 332, the opening 372*f* of the release cam 372, the opening 370*a* of the spring 370 and the opening 324*e* of the driving side cartridge cover member 324. A drive inputting portion 74*b* at the Free End of the Shaft Portion 74*x* is Exposed Outwardly of the Cartridge.

(Structure of Drive Connecting Portion)

Referring to FIGS. 38, 39 and 40, the drive connecting portion will be described in more detail.

The cartridge cover member 324 is a part of the frame at the longitudinal end portion of the cartridge P. Between the driving side cartridge cover member 324 and the bearing member 45, the drive input member 74, the developing device covering member 332, the release cam 372 and the spring 370, arranged in a named from the bearing member 45 toward the cartridge cover member 324. That is, the drive input member 74, the developing device covering member 332, the release cam 372 and the spring 370 are arranged in the order named from the inside toward the outside in the longitudinal direction of the developing roller. The rotational axes of these members are coaxial with the rotational axis (rotation axis X) of the drive input member 74.

Parts (a) and (b) of FIG. 40 are schematic sectional views of the drive connecting portion.

As described hereinbefore, a portion to be born 74*p* (inner surface of the cylindrical portion) of the drive input member 74 and the first bearing portion 45*p* (outer surface of the cylindrical portion) of the bearing member 45 are engaged with each other. In addition, the cylindrical portion 74*q* of the drive input member 74 and the inside circumference 332*q* of the developing device covering member 332 are engaged with each other. That is, the drive input member 74 is rotatably supported by the bearing member 45 and the developing device covering member 332 at each of the opposite end portions.

In addition, the centers of the first bearing portion 45*p* (outer surface of the cylindrical portion) of the bearing member 45 and the inside circumference 332*q* of the developing device covering member 332 are coaxial with the rotation axis X of the developing unit 9.

Outside the developing device covering member 332 with respect to the longitudinal direction of the cartridge P, the driving side cartridge cover member 24 is provided. Part (a) of FIG. 40 is a schematic sectional view illustrating the coupling state between the drive inputting portion 74*b* of the drive input member 74 and the recess 62*b* of the developing device drive output member 62 provided in the main assembly. In this manner, the drive inputting portion 74*b* is projected outwardly of the cartridge beyond an opening plane of the opening 324*e* of the driving side cartridge cover member 324.

Between the driving side cartridge cover member 324 and the release cam 372, the spring 370 which is an elastic member as an urging member to urge the release cam 372 in the direction of the arrow N (inward of the cartridge).

Part (b) of FIG. 40 is a schematic sectional view illustrating a spaced state (decoupled state) between the drive inputting portion 74*b* of the drive input member 74 and the recess 62*b* of the developing device drive output member 62. The release cam 372 is movable in the direction of the arrow M (outwardly of the cartridge) against the urging force of the spring 370. By the movement of the release cam 372 in the direction of the arrow M, the developing device drive output member 62 is urged to move in the direction of the arrow M to space the developing device drive output member 62 from the drive inputting portion 74*b*. By this, the drive input member 74 and the developing device drive output member 62 are decoupled from each other, so that the rotational force is not transmitted from the developing device drive output member 62 to a drive inputting portion 74*b*.

(Releasing Mechanism)

The releasing mechanism (drive disconnecting mechanism) will be described.

FIG. 41 shows a relationship between the release cam 372 and the developing device covering member 332. The release cam 372 is provided with a substantially cylindrical portion 372*k* (FIG. 39), a disk portion 372*g* expanding outwardly of the cylindrical portion at the inner end surface of the cylindrical portion 372*k*, a force receiving portion 372*b* (projected portion, portion-to-be-engaged) projecting from the disk portion 372*g*. In this embodiment, the force receiving portion 372*b* is in the form of a projection projecting radially with respect to the disk portion 372*g*.

The cylindrical portion 372*k* (FIG. 39) of the release cam 372 is supported so as to be slidable relative to the opening 324*e* of the driving side cartridge cover member 324 (slidable along the rotational axis of the developing roller 6). In other words, the release cam 372 movable relative to the driving side cartridge cover member 324 substantially in parallel with the rotational axis of the developing roller 6.

The disk portion 372*g* functions as a portion-to-be-urged (elastic force receiving portion) urged by the spring 3370 (FIG. 38). The disk portion 372*g* receives the elastic force from the spring 370 to urge the release cam 372 inwardly of the cartridge P (inside position the will be described hereinafter, FIG. 45). The disk portion 372*g* functions as a force receiving portion (second releasing member side force receiving portion) for receiving the force inward of the cartridge P in the longitudinal direction of the developing roller. The center of the cylindrical portion 372*k* of the release cam 372 and the center of the opening 324*e* of the driving side cartridge cover member 324 are coaxial with each other.

The release cam 372 as the decoupling member is provided with a contact portion (inclined surface, contact surface) 372*a*. In addition, the developing device covering member 332 is provided with a contact portion (inclined surface, contact) 332*g* as an operating portion actable on the contact portion 372*a* of the release cam 372. The contact portion 372*a* of the release cam 372 and the contact portion 332*g* of the developing device covering member 332 are contactable to each other. The contact portion 372*a* of the release cam 372 and the contact portion 332*g* of the developing device covering member 332 are inclined relative to the rotation axis X.

The release cam 372 is a rotatable member rotatable relative to the developing device frame (bearing member 45, developing device covering member 332) about the rotation axis X. That is, the release cam 372 is capable of rotatable about the axis X and slidable along the axis X relative to the bearing member 45 and the developing device covering member 332.

In the example of FIG. 41, two of the contact portions 332*g* of the developing device covering member 332, and two of the contact portions 372*a* of the release cam 372, but the numbers are not limited to two. For example, the numbers may be three.

[Drive Disconnecting Operation]

Referring to FIG. 7 and FIGS. 42-45, the operation of the drive connecting portion when the state thereof changes from the state in which the developing roller 6 and the drum 4 contact with each other to the state in which they are spaced from each other. For better illustration, FIGS. 42-45 omit some parts, and the release lever and the release cam are partly schematically shown.

[State 1]

As shown in part (a) of FIG. 7, the spacing force urging member 80 and the urging force receiving portion (spacing force receiving portion) 45*a* of the bearing member 45 are spaced from each other by a gap d. In this case, the drum 4 and the developing roller 6 contact with each other. This state is called "state 1" of the spacing force urging member 80. The state of the drive connecting portion is as shown in FIG. 43. In part (a) of FIG. 35, the pair of the drive input member 74 and the developing device drive output member 62, and the pair of the release cam 372 and the developing device covering member 332 are schematically and separately shown. Part (b) of FIG. 43 is a perspective view illustrating a structure of the drive connecting portion.

Between the contact portion 372*a* of the release cam 372 and the contact portion 332*g* of the developing device covering member 332, there is a gap e.

In this case, the release cam 372 is in the inside position, and the developing device drive output member 62 is in the second position, so that the drive inputting portion 74*b* of the drive input member 74 and the developing device drive output member 62 are engaged with each other by an engagement amount q, and therefore, the drive transmission is enabled.

[State 2]

When the spacing force urging member (main assembly side urging member thereof) 80 moves by δ1 in the direction of the arrow F1 from the development-contact-and-drive-transmission state, as shown in part (b) of FIG. 7, the developing unit 9 rotates about the rotation axis X by the angle θ1 in the direction of the arrow K, as described hereinbefore. As a result, the developing roller 6 spaces from the drum 4 by a distance ε1. The developing device covering member 332 in the developing unit 9 rotates in the direction of the arrow K by an angle θ1 in interrelation with the rotation of the developing unit 9. On the other hand, when the cartridge P is mounted in the main assembly 2, the drum unit 8, the driving side cartridge cover member 324 and the non-driving side cartridge cover member 25 are fixed in place relative to the main assembly 2.

As shown in FIG. 34, the release cam 372 in the developing unit 9 is provided with a force receiving portion (projected portion, portion-to-be-engaged) 372*b* projected in a normal direction of the rotation axis X from the release cam 372. The force receiving portion 372*b* is engaged with an engaging portion 324*s* provided on the driving side cartridge cover member 324, by which the rotation is limited. Therefore, even if the rotation of the release cam 372 is limited, the developing unit 9 is capable of rotating, because of the provision of an opening 332*c* in the developing device covering member 332.

The developing device covering member 332 rotates in the direction of the arrow K in the Figure in interrelation with the rotation of the developing unit 9, relative to the release cam 372 which is limited in the rotation. The contact portion 372*a* of the release cam 372 and the contact portion 332*g* of the developing device covering member 332 start to contact to each other.

Also at this time, the release cam 372 is in the inside position, and the developing device drive output member 62 is in the second position, so that the engagement between the drive inputting portion 74*b* of the drive input member 74 and the developing device drive output member 62 is kept (part (a) of FIG. 44).

Therefore, the driving force inputted to the drive input member 74 from the main assembly 2 is being transmitted to the developing roller 6 through the developing roller gear 69.

[State 3]

Part (a) of FIG. 45 and part (b) of FIG. 45 illustrate the drive connecting portion at the time when the main assembly side urging member of the spacing force urging member 80 move from the developing device separation drive transmission position in the direction indicated by the arrow F1 in the Figure by δ2 as shown in part (c) of FIG. 7. By the spacing force urging member 80 moving by δ2, the developing unit 9 is rotated by a angle θ2 (>θ1) by the urging force receiving portion 45*a* receiving the force from the spacing force urging member 80. In interrelation with the rotation of the developing unit 9 by the spacing force urging member 80 by the angle θ2, the developing device frame (developing device frame 29, bearing member 45, developing device covering member 332) rotates in the direction of the arrow K in the Figure. On the other hand, the release cam 372 does not displace from the state (position) 4 by the engagement with the engaging portion 324*s* of the driving side cartridge cover member 224, similarly to the foregoing. That is, the release cam 372 rotates relative to the developing device frame. At this time, the contact portion (first releasing member side force receiving portion) 372*a* of the release cam 372 receives a reaction force from the contact portion 332*g* of the development side-cover 332.

The release cam 372 is capable of the sliding movement along the axis X in the directions of the arrows M and N, while rotating about the axis X relative to the developing device covering member 332.

Therefore, the release cam 372 moves outwardly of the cartridge P (toward the outside in the longitudinal direction of the developing roller), while the contact portion 372*a* is sliding on the contact portion 332*g* by the force received by the contact portion 372*a* from the contact portion 332*g* of the developing device covering member 332. That is, the release cam 372 slides in the direction of the arrow M by the movement distance p while rotating relative to the developing device covering member 332. In interrelation with the movement of the release cam 372 in the direction of the arrow M, the cylindrical portion 372*k* of the release cam 372 becomes overlapped with the drive inputting portion 74*b* of the drive input member 74 in the axis X direction. The free end of the cylindrical portion 372*k* of the release cam 372 slides the developing device drive output member 62 in the direction of the arrow M by the movement distance p.

In summary, the urging force provided by the main assembly 2 is transmitted to the bearing member 45 (urging force receiving portion 45*a*) of the cartridge P through the spacing force urging member 80. By this, the developing unit 9 (developing device frame) rotates by θ2 (part (c) of FIG. 7). Therefore, the developing device frame (developing device covering member 332) rotates relative to the release cam 372 engaged with the driving side cartridge cover member 324. By this, the contact portion 372*a* of the release cam 372 receives the force from the contact portion 332*g* of the developing device covering member 332. As a result, the release cam 372 moves to the outside position against the elastic force (urging force) received from the second releasing member side force receiving portion (disk portion 372*g*, FIG. 41) from the spring 370 (FIG. 38).

The developing device frame (developing device covering member 332) in this embodiment is a rotatable member rotatable relative to the release cam 372, and is an operating member actable on the release cam 372 to move the release cam 372 relative to the drive inputting portion 74*b*. The developing device covering member 332 moves the release cam 372 in the direction of the arrow M (outward of the cartridge in the longitudinal direction of the developing roller).

The contact portion 332*g* of the developing device covering member 332 functions as a rotatable member side urging portion (developing device frame side urging portion, operating member urging portion) for applying the force to the releasing member side force receiving portion (contact portion 372*a*) of the release cam 372 by the rotation of the development cover 332. The contact portion 332*g* applies the force to the contact portion 372*a* of the release cam 372 outwardly of the cartridge P (in the longitudinal direction of the developing).

The contact portion 372*a* is an outward force receiving portion (first releasing member side force receiving portion) directed to the outside of the cartridge P.

The release cam 372 urges the developing device drive output member 62 by the urging portion at the free end of the cylindrical portion 372*k* (FIG. 38) by the movement to the outside position. And, the release cam 372 moves the developing device drive output member 62 in the direction of the arrow M to retract it to the first position (part (b) of FIG. 40, FIG. 45).

At this time, as shown in FIGS. 44 and 45, the movement distance p of the developing device drive output member 62 is larger than the engagement amount q between the drive input member 74 and the developing device drive output member 62, and therefore, the engagement between the drive input member 74 and the developing device drive output member 62 is broken. Although the developing device drive output member 62 of the main assembly 2 continues to rotate, the drive input member 74 stops. As a result, the rotation of the developing roller gear 69 and therefore the rotation of the developing roller 6 stop.

The release cam 372 and the rotational force receiving portion 74*b*4 (FIG. 17) of the drive inputting portion 74*b* are projected onto a phantom line parallel with the rotational axis of the developing roller 6 when the release cam 272 moves to the outside position. Then, an area of the release cam 372 and an area of the rotational force receiving portion 74*b*4 are overlapped with each other at least partly. In this embodiment, the area of the drive inputting portion 74*b* is within the area of the release cam 372.

As described hereinbefore, the movement distance p through which the developing device drive output member 62 is moved from the second position to the first position by the sliding of the release cam 372 is preferably larger than the engagement amount q between the drive input member 74 and the developing device drive output member 62. That is, in the state that the release cam 372 is in the outside position (FIG. 45), the urging portion (free end of the release cam 372) of the release cam 372 is preferably outside as compared with the free end of the drive inputting portion 74*b* in the longitudinal direction of the developing roller 6.

However, the end surface (free end) of the drive inputting portion 74*b* and the end surface of the release cam 372 may be substantially in the same plane. In the state that the release cam 372 is in the outside position, even if the position of the free end of the release cam 372 is inside of the position of the free end of the drive inputting portion 74*b*, it will suffice if the driving force is not transmitted to the rotational force receiving portion 74*b*4 (FIG. 17) of the drive input member 74.

In the foregoing, the operation of the drive disconnection to the developing roller 6 in interrelation with the rotation of the developing unit 9 in the direction of the arrow K has been described. By employing such a structure, the developing roller 6 can be spaced from the drum 4 while rotating. As a result, the drive transmission to the developing roller 6 can be stopped depending on the spacing distance between the developing roller 6 and the drum 4.

[Drive Connecting Operation].

The description will be made as to the operation of the drive connecting portion when the state changes from the state in which the developing roller 6 is spaced from the drum 4 to the state in which the are contacted with each other. This operation is opposite from the operation from the contact state to the spaced-developing-device-state described in the foregoing.

In the spaced-developing-device-state (the developing unit 9 is in the angle θ2 position, as shown in part (c) of FIG. 7), the drive connecting portion is in the state that the drive input member 74 and the developing device drive output member 62 are disconnected from each other, as shown in FIG. 45. That is, the developing device drive output member 62 is in the first position.

When the spacing force receiving member 145 is retracted gradually from the urging force receiving portion 45*a* in the direction of an arrow F2, the developing unit 9 is rotated by the force of an urging spring 95 (FIG. 4) in the direction of an arrow H shown in FIG. 7 (reverse rotation as compared with the K direction described above).

At this time, as shown in FIG. 42, the force receiving portion 272*b* of the release cam 372 is engaged with the engaging portion 324*t* which is the limiting portion for the driving side cartridge cover member 324 and is not rotated. As a result, the developing device covering member 332 rotates relative to the release cam 372.

With the rotation of the developing device covering member 332, the contact portion 332*g* of the developing device covering member 332 starts to retract from the contact portion 372*a* of the release cam 372. The release cam 372 is moved by the force of the spring 370 in the direction of the arrow N by the amount corresponding to the retraction of the contact portion 332*g*.

In the state that the developing unit 9 has rotated by the angle θ1 (part (b) of FIG. 7, and FIG. 44), the release cam 372 is in the inside position by the urging force of the spring 370.

With the separation of the release cam 372 from the developing device drive output member 62 by the movement to the inside position, the developing device drive output member 62 is moved to the second position by the spring (unshown) of the main assembly 4 urging it in the direction of the release cam 372. Then, the drive input member 74 is engaged with the developing device drive output member 62, as shown in FIG. 44.

By this, the driving force is transmitted from the main assembly 2 to the developing roller 6, thus rotating the developing roller 6. At this time, the developing roller 6 and the drum 4 are kept spaced from each other.

From this state, the developing unit 9 is rotated gradually in the direction of the arrow H in FIG. 7, by which the developing roller 6 can be contacted to the drum 4 (part (a) of FIG. 7). Also in this state, the developing device drive output member 62 is in the second position. In the foregoing, the drive transmission operation to the developing roller 6 in interrelation with the rotation of the developing unit 9 in the direction of the arrow H has been described With this structure described above, the developing roller 6 is brought into contact to the drum 4 while rotating, and the driving force can be transmitted to the developing roller 6 depending on the spacing distance between the developing roller 6 and the drum 4.

As described in the foregoing, with the above-described structure, the switching between the drive disconnection and the drive transmission to the developing roller 6 can be definitely determined on the basis of the angle of rotation of the developing unit 9.

Embodiment 5

Referring FIG. 46-FIG. 53, Embodiment 5 of the present invention will be described. In this embodiment, a releasing member 472, a driving side cartridge cover 424 and a developing device covering member 432 corresponds to the release cam 72, the spring 70, the release cam 72, the driving side cartridge cover 24 and the developing device covering member 32, respectively.

On the other hand, dispositions, structures and functions of the releasing member 472, the driving side cartridge cover 424 and the developing device covering member 432 are partly different from those of the release cam 72, the driving side cartridge cover 24 and the developing device covering member 32. In addition, the release lever 73 and the spring 70 are not provided in this embodiment. In the following, the detailed description will be made particularly on the points different from the foregoing embodiments. In the description of this embodiment, the same reference numerals as in Embodiments 1 and 2 are assigned to the elements having the corresponding functions in this embodiment, and the detailed description thereof is omitted for simplicity.

[Drive Transmission to Developing Roller].

Referring to FIGS. 46 and 47, the structure of the drive connecting portion will be described.

The drive connecting portion of this embodiment includes the drive input member 74, the releasing member (decoupling member) 472, the developing device covering member 432 and the driving side cartridge cover member 424.

As shown in FIGS. 46 and 47, the cartridge drive transmission member 74 penetrates an opening 424*e* of the driving side cartridge cover member 424, an opening 472*f* of the releasing member 472 and an opening 432*d* of the developing device covering member 432, and engages with the developing device drive output member 62. More particularly, as shown in FIG. 46, the driving side cartridge cover member 424 which is a frame provided at a longitudinal end portion of the cartridge is provided with the openings 424*e* and 424*d* which are through-openings. The developing device covering member 432 connected with the driving side cartridge cover member 424 includes a cylindrical portion 432*b* which is provided with the opening 432*d* which is a through-opening.

A shaft portion 74*x* of the drive input member 74 penetrates the opening 432*d* of the developing device covering member 432, the opening 472*f* of the releasing member, the opening 424*e* of the driving side cartridge cover member 424. A drive inputting portion 74*b* at the free end of the shaft portion 74*x* is exposed outwardly of the cartridge.

(Structure of Drive Connecting Portion)

Referring to FIGS. 46, 47 and 48, the drive connecting portion will be described in more detail. At a longitudinal end portion of the cartridge P, the driving side cartridge cover member 424 is provided as a part of the frame. The drive input member 74, the developing device covering member 432 and the releasing member 472 are disposed in the order named from the bearing member 45 toward the driving side cartridge cover member 424 (from the inside toward the outside in the longitudinal direction of the developing roller). The rotational axes of these members are coaxial with the rotational axis (rotation axis X) of the drive input member 74.

Parts (a) and (b) of FIG. 48 are schematic sectional views of the drive connecting portion. As described hereinbefore, a portion to be born 74*p* (inner surface of the cylindrical portion) of the drive input member 74 and the first bearing portion 45*p* (outer surface of the cylindrical portion) of the bearing member 45 are engaged with each other. In addition, the cylindrical portion 74*q* of the drive input member 74 and the inside circumference 432*q* of the developing device covering member 432 are engaged with each other. That is, the drive input member 74 is rotatably supported by the bearing member 45 and the developing device covering member 432 at each of the opposite end portions.

In addition, the centers of the first bearing portion 45*p* (outer surface of the cylindrical portion) of the bearing member 45 and the inside circumference 432*q* of the developing device covering member 432 are coaxial with the rotation axis X of the developing unit 9. Outside the developing device covering member 432 with respect to the longitudinal direction of the cartridge P, the driving side cartridge cover member 424 is provided.

Part (a) of FIG. 48 is a schematic sectional view illustrating a coupled state between the drive inputting portion 74*b* of the drive input member 74 and the recess 62 of the developing device drive output member 62. In this manner, the drive inputting portion 74*b* is projected outwardly of the cartridge beyond an opening plane of the opening 424*e* of the driving side cartridge cover member 424.

Part (b) of FIG. 48 is a schematic sectional view of the state in which the drive inputting portion 74*b* is decoupled from the recess 62*b* of the developing device drive output member 62. The releasing member 472 is movable in the direction of the arrow M (outward of the cartridge). By the movement in the direction of the arrow M, the releasing member 472 urges the developing device drive output member 62 to move in the direction of the arrow M, thus spacing the developing device drive output member 62 from the drive inputting portion 74*b*. By this, the drive input member 74 and the developing device drive output member 62 are decoupled from each other, so that the rotational force is not transmitted from the developing device drive output member 62 to a drive inputting portion 74*b*.

(Releasing Mechanism)

The releasing mechanism (drive disconnecting mechanism) will be described.

FIG. 49 shows a relationship between the releasing member 472 and the developing device covering member 432. The releasing member 472 includes a cylindrical portion 472*k* substantially cylindrical portion 472*k*, a disk portion 472*g* expanding outwardly from the outside at the inner end surface of the cylindrical portion 472*k*, a force receiving portion 472*b* (projected portion, portion-to-be-engaged) projecting from the disk portion 472*g*. In this embodiment, the force receiving portion 472*b* is in the form of a projection projecting radially with respect to the disk portion 472*g*. The disk portion 472*g* is provided with a guide groove 472*h*. The guide groove 472*h* is a recess recessed in the radial direction of the disk portion 472*g*.

The cylindrical portion 472*k* of the releasing member 472 is supported so as to be slidable (along the rotational axis of the developing roller 6) relative to the opening 424*e* of the driving side cartridge cover member 424. In other words, the releasing member 472 is movable substantially in parallel with the rotational axis of the developing roller 6 relative to the driving side cartridge cover member 424.

The center of the cylindrical portion 472*k* of the releasing member 472 and the center of the opening 424*e* of the driving side cartridge cover member 424 are coaxial with each other.

The developing device covering member 432 is provided with a guide 432*h* as a guide portion, and the releasing member 472 is provided with a guide groove 472*h* as a portion-to-be-guided, as described above. The guide 432*h* extends in parallel with the axial direction. The guide 432*h* of the developing device covering member 432 is engaged with the guide groove 472*h* of the releasing member 472. By the engagement between the guide 432*h* and the guide groove 472*h*, the releasing member 472 is slidable only in the axial direction (arrows M and N) relative to the developing device covering member 432.

In place of the parallel arrangement of the guide 432*h*, the guide groove 472*h* may be made parallel with the rotational axis X. The releasing member 472 can be made the movable in parallel with the rotation axis X if the width of the disk portion 472*g* is increased, and the guide groove 472*h* is extended in the disk portion 472*g* in parallel with the rotation axis X. It is not always necessary that the releasing member 472 moves in parallel with the rotation axis X, but it may be inclined relative to the rotation axis X.

FIG. 50 shows the driving side cartridge cover member 424. The force receiving portion (portion-to-be-engaged, projected portion releasing member side force receiving portion) 472*b* of the releasing member 472 is contactable to the engaging portion (contact portion, contact surface) 424*t* and the engaging portion (contact portion, the contact surface) 424*s* of the driving side cartridge cover member 424. The engaging portion 424*s* and the engaging portion 424*t* are inclined relative to the rotation axis X (inclined surface).

[Drive Disconnecting Operation]

Referring to FIG. 7 and FIGS. 50-53, the operation of the drive connecting portion when the state thereof changes from the state in which the developing roller 6 and the drum 4 contact with each other to the state in which they are spaced from each other. In FIGS. 50-53, some parts and the structure of the releasing member 472 are schematically illustrated, for better illustration.

[State 1]

As shown in part (a) of FIG. 7, the spacing force urging member 80 and the urging force receiving portion (spacing force receiving portion) 45*a* of the bearing member 45 are spaced from each other by a gap d. In this case, the drum 4 and the developing roller 6 contact with each other. This state is called "state 1" of the spacing force urging member 80. The state of the drive connecting portion is as shown in FIG. 51. In part (a) of FIG. 51, the engaging portion between the drive input member 74 and the developing device drive output member 62 is schematically illustrated. Part (b) of FIG. 51 is a perspective view illustrating a structure of the drive connecting portion.

Between the force receiving portion 472*b* of the releasing member 472 and the engaging portion 424*s* of the driving side cartridge cover member 424, a gap is provided. The releasing member 472 is in the inside position, and the developing device drive output member 62 is in the second position, so that the drive inputting portion 74*b* of the drive input member 74 and the developing device drive output member 62 are engaged with each other by an engagement amount q, and therefore, the drive transmission is enabled.

[State 2]

When the spacing force urging member (main assembly side urging member thereof) 80 moves by δ1 in the direction of the arrow F1 from the development-contact-and-drive-transmission state, as shown in part (b) of FIG. 7, the developing unit 9 rotates about the rotation axis X by the angle θ1 in the direction of the arrow K, as described hereinbefore. As a result, the developing roller 6 spaces from the drum 4 by a distance ε1. The releasing member 472 and the developing device covering member 432 in the developing unit 9 rotates in the direction of the arrow K by the angle θ1 in interrelation with the developing unit 9. On the other hand, when the cartridge P is mounted in the main assembly 2, the drum unit 8, the driving side cartridge cover member 424 and the non-driving side cartridge cover member 25 are fixed in place relative to the main assembly 2. Therefore, the releasing member 472 rotates relative to the driving side cartridge cover member 424. In other words, the driving side cartridge cover member 424 rotates relative to the releasing member 472.

Part (a) of FIG. 52 and part (b) of FIG. 52 illustrate the state of drive connecting portion. By the rotation of the releasing member 472, the force receiving portion 472*b* of the releasing member 472 and the engaging portion 424*s* of the driving side cartridge cover member 424 start to contact to each other. Also in this state, the releasing member 472 is still in the inside position, and the developing device drive output member 62 is still in the second position, and therefore, the drive input member 74 and the developing device drive output member 62 are kept engaged with each other (part (a) of FIG. 52).

Therefore, the driving force inputted to the drive input member 74 from the main assembly 2 is being transmitted to the developing roller 6 through the developing roller gear 69.

[State 3]

Part (a) of FIG. 53 and part (b) of FIG. 53 illustrate the drive connecting portion at the time when the main assembly side urging member of the spacing force urging member 80 move from the developing device separation drive transmission position in the direction indicated by the arrow F1 in the Figure by δ2 as shown in part (c) of FIG. 7.

By the spacing force urging member 80 moving by δ2, the developing unit 9 is rotated by an angle θ2 (>θ1) by the urging force receiving portion 45*a* receiving the force from the spacing force urging member 80. In interrelation with the rotation of the developing unit 9 by the spacing force urging member 80 by the angle θ2, the releasing member 472 and the developing device frame (developing device frame 29, bearing member 45, developing device covering member 432) rotate in the direction indicated by the arrow K in the Figure.

The releasing member 472 rotates while the force receiving portion 472*b* is in contact with the engaging portion 424*s* of the driving side cartridge cover member 424. Therefore, the releasing member 472 rotates relative to the driving side cartridge cover member 424, and receives a reaction force from the engaging portion 424*s*. The engaging portion 424*s* is an inclined surface inclined relative to the rotation axis X. Therefore, the releasing member 472 receives the outward force (arrow M direction) from the engaging portion 424*s* through the force receiving portion 572*b*.

As described above, the releasing member 472 is slidable only in the axial direction (arrows M and N) by the engagement between the guide groove 472*h* of the releasing member 472 and the guide 432*h* of the developing device covering member 432 (FIG. 10).

Therefore, the releasing member 472 moves outwardly of the cartridge P (outward in the longitudinal direction of the developing roller) by the force received by the force receiving portion 472*a* from the engaging portion 424*s* of the driving side cartridge cover member 424. When the releasing member 472 moves, the force receiving portion 472*b* slides relative to the engaging portion 424*s* of the driving side cartridge cover member 424.

The engaging portion 424*s* functions as an urging portion (first operating member side urging portion, first rotatable member side urging portion, first photosensitive member frame side urging portion) for applying the outward force to the force receiving portion (releasing member side force receiving portion) 472*b*.

Thus, the releasing member 472 rotates in the direction of the arrow K (part (c) of FIG. 7) relative to the driving side cartridge cover member 424 and slides by the movement distance p in the direction of the arrow M. In interrelation with the movement of the releasing member 472 in the direction of the arrow M, the cylindrical portion 472*k* of the releasing member 472 is overlapped with the drive inputting portion 74*b* of the drive input member 74 in the direction of the axis X. The free end of the cylindrical portion 472*k* of the releasing member 472 slides the developing device drive output member 62 in the direction of the arrow M by the movement distance p.

In summary, the urging force provided by the main assembly 2 is transmitted to the bearing member 45 (urging force receiving portion 45*a*) of the cartridge P through the spacing force urging member 80. By this, the developing unit 9 (developing device frame) rotates by θ2 (part (c) of FIG. 7). Therefore, the releasing member 472 also rotates relative to the driving side cartridge cover member 424 by the angle θ2.

At this time, the force receiving portion 472*b* of the releasing member 472 receives the force by the engagement (contact) to the engaging portion 424*s* of the development side-cover member 424. As a result, the releasing member 472 slides along the rotation axis X to the outside position.

The driving side cartridge cover member 424 which is a part of the photosensitive member frame is a rotatable member rotatable relative to the release cam 472 and is an operating member actable on the release cam 472 to move in the release cam 472. By rotating relative to the release cam 472, the driving side cartridge cover member 424 moves the release cam 472 in the direction of the arrow M (outward of the cartridge P in the longitudinal direction of the developing roller 6).

The engaging portion 424*s* of the driving side cartridge cover member 424 functions as the rotatable member side urging portion (photosensitive member frame side urging portion, operating member side urging portion) for applying the force to the releasing member side force receiving portion (force receiving portion 472*b*) of the release cam 472. With the rotation of the cartridge cover member 424 relative to the release cam 472, the engaging portion 424*s* applies the outward force (outward with respect to the longitudinal direction of the developing roller 6) to the force receiving portion 472*b*.

As a result, the releasing member 472 moves to the outside position, and urges the developing device drive output member 62 by the urging portion at the free end of the cylindrical portion 472*k* (FIG. 46).

The releasing member 472 move the developing device drive output member 62 in the direction of the arrow M to retract it to the first position (part (b) of FIG. 48, FIG. 53).

At this time, as shown in FIGS. 52 and 53, the movement distance p of the developing device drive output member 62 is larger than the engagement amount q between the drive input member 74 and the developing device drive output member 62, and therefore, the engagement between the drive input member 74 and the developing device drive output member 62 is broken. Although the developing device drive output member 62 of the main assembly 2 continues to rotate, the drive input member 74 stops. Although the developing device drive output member 62 of the main assembly 2 continues to rotate, the drive input member 74 stops. As a result, the rotation of the developing roller gear 69 and therefore the rotation of the developing roller 6 stop.

The releasing member 472 and the rotational force receiving portion 74*b*4 of the drive inputting portion 74*b* (FIG. 17) are projected onto a phantom line parallel with the rotational axis of the developing roller 6 when the releasing member 472 moves to the outside position. Then, an area of the releasing member 472 and an area of the rotational force receiving portion 74*b*4 at least partly overlap with each other. In this embodiment, the area of the drive inputting portion 74*b* is within the area of the release cam 472.

As described above, the movement distance p through which the developing device drive output member 62 moves from the second position to the first position by the sliding movement of the releasing member 472 is preferably larger than an engagement amount q between the drive input member 74 and the developing device drive output member 62. That is, in the state that the releasing member 472 is in the outside position (FIG. 53), the urging portion (free end of the releasing member 472) of the releasing member 472 is preferably outside of the free end of the drive inputting portion 74*b* with respect to the longitudinal direction of the developing roller.

However, the end surface (free end) of the drive inputting portion 74*b* and the end surface of the releasing member 472 are substantially in the amendment plane. Even if the position of the free end of the releasing member 472 is inside the position of the free end of the drive inputting portion 74*b*, it will suffice if the driving force is not transmitted to the rotational force receiving portion 74*b*4 (FIG. 17) of the drive input member 74.

In the foregoing, the operation of the drive disconnection to the developing roller 6 in interrelation with the rotation of the developing unit 9 in the direction of the arrow K has been described. By employing such a structure, the developing roller 6 can be spaced from the drum 4 while rotating. As a result, the drive transmission to the developing roller 6 can be stopped depending on the spacing distance between the developing roller 6 and the drum 4.

[Drive Connecting Operation].

The description will be made as to the operation of the drive connecting portion when the state change from the state in which the developing roller 6 is spaced from the drum 4 to the state in which they are contacted with each other. This operation is opposite from the operation from the contact state to the spaced-developing-device-state described in the foregoing.

In the spaced-developing-device-state (the developing unit 9 is in the angle θ2 position, as shown in part (c) of FIG. 7), the drive connecting portion is in the state that the drive input member 74 and the developing device drive output member 62 are disconnected from each other, as shown in FIG. 15. That is, the developing device drive output member 62 is in the first position.

When the spacing force receiving member 145 is retracted gradually from the urging force receiving portion 45*a* in the direction of an arrow F2, the developing unit 9 is rotated by the force of an urging spring 95 (FIG. 4) in the direction of an arrow H shown in FIG. 7 (reverse rotation as compared with the K direction described above). The release cam 472 of the developing unit 9 rotates relative to the photosensitive member frame (driving side cartridge cover 424).

By the rotation of the release cam 472 relative to the driving side cartridge cover member 424, the force receiving portion 472*b* of the release cam 472 separates from the engaging portion 424*s* of the cartridge cover and starts to contact to the engaging portion 424*t*.

As shown in FIG. 50, the engaging portion 424*t* is an inclined surface inclined relative to the rotation axis X, and therefore, the force receiving portion 472*b* receives a reaction force comprising a component in the direction of the arrow N, by the contact with the engaging portion 424*t*.

Therefore, with the rotation, the release cam 472 is moved in the direction of the arrow N while the force receiving portion 472*b* is sliding on the engaging portion 424*t*, by the force received from the engaging portion 424*t*. The engaging portion 424*t* functions as an urging portion (second rotation portion, second operating member side urging portion, second photosensitive member frame side urging portion) for applying the inward force to the force receiving portion 472*b*.

In the state that the developing unit 9 is rotated by the angle θ1 (part (b) of FIG. 7, FIG. 52), the releasing member 472 is moved to the inside position by the reaction force received by the force receiving portion 472*b* from the engaging portion 424*t* of the driving side cartridge cover member 424.

With the movement of the releasing member 472 to the inside position to separate from the developing device drive output member 62, the developing device drive output member 62 is moved to the second position by being urged by a spring (unshown) of the main assembly 2 in the direction of the arrow N. Then, the drive input member 74 is engaged with the developing device drive output member 62, as shown in FIG. 52.

By this, the driving force is transmitted from the main assembly 2 to the developing roller 6, thus rotating the developing roller 6. At this time, the developing roller 6 and the drum 4 are kept spaced from each other.

From this state, the developing unit 9 is rotated gradually in the direction of the arrow H in FIG. 7, by which the developing roller 6 can be contacted to the drum 4 (part (a) of FIG. 7). Also in this state, the developing device drive output member 62 is in the second position.

In the foregoing, the drive transmission operation to the developing roller 6 in interrelation with the rotation of the developing unit 9 in the direction of the arrow H has been described With this structure described above, the developing roller 6 is brought into contact to the drum 4 while rotating, and the driving force can be transmitted to the developing roller 6 depending on the spacing distance between the developing roller 6 and the drum 4.

The engaging portion 424*t* (FIGS. 50, 52, 53) of the driving side cartridge cover member 424 functions as the second rotatable member side urging portion (second photosensitive member frame side urging portion, second operating member side urging portion) for applying the force to the force receiving portion (second releasing member side force receiving portion) 472*b* of the releasing member 472. By the rotation of the driving side cartridge cover member 424 relative to the release cam 472, the engaging portion 424*t* urges the force receiving portion 472*b* to move the releasing member 472 to the inside position.

In this embodiment, the force receiving portion 472*b* functions as both of the force receiving portion (first releasing member side force receiving portion) for receiving the outward force and the force receiving portion (second releasing member side force receiving portion) for receiving the inward force.

As described in the foregoing, with the above-described structure, the switching between the drive disconnection and the drive transmission to the developing roller 6 can be definitely determined on the basis of the angle of rotation of the developing unit 9.

According to this embodiment, the decoupling member can be moved without using an elastic member.

Embodiment 6

Referring FIG. 54-FIG. 61, Embodiment 6 of the present invention will be described. A drive input member 574, a bearing member 545, a releasing member 572, a driving side cartridge cover 524 and a developing device covering member 532 of this embodiment corresponding to the drive input member 74, the bearing member 45, the release cam 72, the driving side cartridge cover 24 and the developing device covering member 32 of Embodiment 1.

On the other hand, dispositions, structures and functions of the drive input member 574, the bearing member 45, the releasing member 572, the driving side cartridge cover 524 and the developing device covering member 532 are partly different from those of the drive input member 74, the bearing member 45, the release cam 72, the driving side cartridge cover 24 and the developing device covering member 32 of Embodiment 1.

In addition, the release lever 73 and the spring 70 are not provided in this embodiment. In the following, the detailed description will be made particularly on the points different from the foregoing embodiments. In the description of this embodiment, the same reference numerals as in Embodiments 1 and 2 are assigned to the elements having the corresponding functions in this embodiment, and the detailed description thereof is omitted for simplicity.

[Drive Transmission to Developing Roller]

Referring to FIGS. 54 and 55, the structure of the drive connecting portion will be described.

The drive connecting portion of this embodiment includes the drive input member 574, the releasing member 572, the developing device covering member 532 and the driving side cartridge cover member 524.

As shown in FIGS. 54 and 55, the drive transmission member 574 penetrates an opening 524*e* of the driving side cartridge cover member 524 and an opening 532*d* of the developing device covering member 532 to engage with the developing device drive output member 62. More particularly, as shown in FIG. 54, the driving side cartridge cover member 524 which is a frame provided at a longitudinal end portion of the cartridge is provided with the openings 524*e* and 524*d* which are through-openings. The developing device covering member 532 connected with the driving side cartridge cover member 524 includes a cylindrical portion 532*b* which is provided with the opening 532*d* which is a through-opening.

The shaft portion 574*x* of the drive input member 574 extends through the opening 532*d* of the developing device covering member 532 and the opening 524*e* of the driving side cartridge cover member 524, and the drive inputting portion 574*b* at the free end portion is exposed to the outside of the cartridge.

On the other hand, the shaft portion 572*x* of the releasing member 572 penetrates a through hole (opening) 574*r* provided inside the drive input member 574. The through hole 574*r* is provided coaxially with the drive input member 574 and penetrates the drive inputting portion 574*b*. The shaft portion 572*x* of the releasing member 572 is supported so as to be slidable in the through hole 574*r*, and the releasing member 572 is reciprocable between the inside position and the outside position while the releasing member 572 is in the through hole 574*r*.

The drive inputting portion 574*b* receives a rotational force by coupling with the recess 62*b* of the developing device drive output member 62. More particularly, the drive inputting portion 574*b* includes a rotational force receiving portion for contacting the recess 62*b* to receive the rotational force.

(Structure of Drive Connecting Portion)

Referring to FIGS. 54, 55, 56, the drive connecting portion will be described in more detail. At the longitudinal end portion of the cartridge P, the driving side cartridge cover member 524 is provided as a part of the cartridge frame (developing device frame). The shaft of the developing roller is supported by the bearing member 545.

The releasing member 572, the drive input member 574 and the developing device covering member 532 are provided in the order named from the bearing member 545 toward the driving side cartridge cover member 524 (from the inside to the outside in the longitudinal direction of the developing roller). The rotational axes of these members are coaxial with the rotational axis of the drive input member 574.

Parts (a) and (b) of FIG. 56 are schematic sectional views of the drive connecting portion.

As described hereinbefore, a portion to be born 5'74*p* (inner surface of the cylindrical portion) of the drive input member 574 and the first bearing portion 545*p* (outer surface of the cylindrical portion) of the bearing member 545 are engaged with each other. In addition, the cylindrical portion 574*q* of the drive input member 574 and the inside circumference 532*q* of the developing device covering member 532 are engaged with each other. That is, the drive input member 574 is rotatably supported by the bearing member 545 and the developing device covering member 532 at each of the opposite end portions.

In addition, the centers of the first bearing portion 545*p* (outer surface of the cylindrical portion) of the bearing member 545 and the inside circumference 532*q* of the developing device covering member 532 are coaxial with the rotation axis X of the developing unit 9. Outside the developing device covering member 532 with respect to the longitudinal direction of the cartridge P, the driving side cartridge cover member 524 is provided.

Part (a) of FIG. 56 is a schematic sectional view illustrating a couple state between the drive inputting portion 574*b* of the drive input member 574 and the recess 62*b* of the developing device drive output member 62. In this manner, the drive inputting portion 574*b* is projected outwardly of the cartridge beyond an opening plane of the opening 524*e* of the driving side cartridge cover member 524. Part (b) of FIG. 56 is a schematic sectional view of the state in which the drive inputting portion 574*b* is decoupled from the recess 62*b* of the developing device drive output member 62.

The releasing member 572 is movable in the direction of the arrow M (outward of the cartridge). By the movement in the direction of the arrow M, the releasing member 572 urges the developing device drive output member 62 to move in the direction of the arrow M, thus spacing the developing device drive output member 62 from the drive inputting portion 574*b*. By this, the drive input member 574 is decoupled from the developing device drive output member 62, so that the rotational force is not transmitted from the recess 62*b* of the developing device drive output member 62 to the drive inputting portion 574*b*.

(Releasing Mechanism)

The releasing mechanism (drive disconnecting mechanism) will be described. FIG. 57 shows the relationship between the drive input member 574, the releasing member 572 and the developing device covering member 532. The releasing member 572 is provided with a shaft portion 572*x* standing substantially in parallel with the rotation axis X and force receiving portion 572*b* extending in a direction crossing with the shaft portion 572*x*. The force receiving portion 572*b* extends in a direction substantially perpendicular to the shaft portion 572*x* (perpendicular to the rotation axis X).

The shaft portion 572*x* penetrates the through hole 574*r* of the driving force inputting member 574 and the opening 545*r* of the bearing member 545. That is, the releasing member 572 is supported at the opposite ends of the shaft portion 572*x* by the bearing member 545 and the driving force inputting member 574. The shaft portion 572*x*, the through hole 574*r* and the opening 545*r* are coaxial with the rotation axis X. The through hole 574*r* is in parallel with the axis X, and therefore, the releasing member 572 is slidable relative to the through hole 574*r* in the direction of the rotation axis X. In other words, the releasing member 572 is movable in the direction of the arrow M (outward of the cartridge) and in the direction of the arrow N (inward of the cartridge) substantially along a line parallel with the rotational axis of the developing roller 6.

The cylindrical portion 545*q* of the bearing member 545 is provided with an engaging portion 545*h* in the form of a groove. The engaging portion 545*h* is engaged by the force receiving portion 572*b* of the releasing member 572. The engaging portion 545*h* which is the groove is substantially in parallel with the rotation axis X.

FIG. 58 shows the driving side cartridge cover member 424. The force receiving portion (portion-to-be-engaged, projected portion releasing member side force receiving portion) 572*b* of the releasing member 572 is contactable to the engaging portion (contact portion, contact surface) 524*t* and the engaging portion (contact portion, the contact surface) 524*s* of the driving side cartridge cover member 524. The engaging portion 524*s* and the engaging portion 524*t* are inclined relative to the rotation axis X (inclined surface).

[Drive Disconnecting Operation]

Referring to FIG. 7 and FIGS. 58-61, the operation of the drive connecting portion when the state thereof changes from the state in which the developing roller 6 and the drum 4 contact with each other to the state in which they are spaced from each other. In FIGS. 58-61, some parts and the structure of the releasing member 472 are schematically illustrated, for better illustration.

[State 1]

As shown in part (a) of FIG. 7, the spacing force urging member 80 and the urging force receiving portion (spacing force receiving portion) 545*a* of the bearing member 545 are spaced from each other by a gap d. In this case, the drum 4 and the developing roller 6 contact with each other. This state is called "state 1" of the spacing force urging member 80. The state of the drive connecting portion is as shown in FIG. 59. In part (a) of FIG. 59, the engaging portion between the drive input member 574 and the developing device drive output member 62 is schematically illustrated. Part (b) of FIG. 59 is a perspective view illustrating a structure of the drive connecting portion.

Between the force receiving portion 572*b* of the releasing member 572 and the engaging portion 524*s* of the driving side cartridge cover member 524, a gap is provided. The releasing member 572 is in the inside position, and the developing device drive output member 62 is in the second position, so that the drive inputting portion 574*b* of the drive input member 574 and the developing device drive output member 62 are engaged with each other by an engagement amount q, and therefore, the drive transmission is enabled.

[State 2]

When the spacing force urging member (main assembly side urging member thereof) 80 moves by δ1 in the direction of the arrow F1 from the development-contact-and-drive-transmission state, as shown in part (b) of FIG. 7, the developing unit 9 rotates about the rotation axis X by the angle θ1 in the direction of the arrow K, as described hereinbefore. As a result, the developing roller 6 spaces from the drum 4 by a distance ε1. The releasing member 572 and the developing device covering member 532 in the developing unit 9 rotates in the direction of the arrow K by the angle θ1 in interrelation with the developing unit 9.

As shown in FIG. 57, the force receiving portion 572*b* of the releasing member 572 projecting in the direction of the normal line to the rotation axis X is engaged with the engaging portion 545*h* of the bearing member 545*h*. Therefore, in interrelation with the rotation of the developing unit 9, the releasing member 572 rotates in the direction of the arrow K (FIG. 7).

On the other hand, when the cartridge P is mounted in the main assembly 2, the drum unit 8, the driving side cartridge cover member 524 and the non-driving side cartridge cover member 525 are fixed in place relative to the main assembly 2. Therefore, the releasing member 572 rotates relative to the driving side cartridge cover member 524. In other words, the driving side cartridge cover 524 rotates relative to the releasing member 572.

Part (a) of FIG. 60 and part (b) of FIG. 60 shows the state of the drive connecting portion at this time. As shown in part (a) of FIG. 60, the force receiving portion 572*b* of the releasing member 572 start to contact to the engaging portion 524*s* of the driving side cartridge cover member 524.

At this time, the releasing member 572 is in the inside position, and the developing device drive output member 62 is in the second position, and therefore, the drive input member 574 and the developing device drive output member 62 are kept engaged with each other (part (a) of FIG. 60).

Therefore, the driving force inputted to the drive input member 574 from the main assembly 2 is being transmitted to the developing roller 6 through the developing roller gear 69.

[State 3]

Part (a) of FIG. 61 and part (b) of FIG. 61 illustrate the drive connecting portion at the time when the main assembly side urging member of the spacing force urging member 80 move from the developing device separation drive transmission position in the direction indicated by the arrow F1 in the Figure by δ2 as shown in part (c) of FIG. 7. By the spacing force urging member 80 moving by δ2, the developing unit 9 is rotated by an angle θ2 (>θ1) by the urging force receiving portion 545*a* receiving the force from the spacing force urging member 80.

In interrelation with the rotation of the developing unit 9 by the spacing force urging member 80 by the angle θ2, the releasing member 572 and the developing device frame (developing device frame 29, bearing member 545, developing device covering member 532) rotate in the direction indicated by the arrow K in the Figure.

The releasing member 572 rotates while the force receiving portion (releasing member side force receiving portion) 572*b* is in contact with the engaging portion 524*s* of the driving side cartridge cover member 524. Therefore, the releasing member 572 receives the reaction force from the engaging portion 524*s* while rotating. The engaging portion 524*s* is an inclined surface inclined relative to the rotation axis X. Therefore, the releasing member 572 receives the outward force (arrow M direction) from the engaging portion 524*s* through the force receiving portion 572*b*.

The releasing member 572 is slidable only in the axial direction (arrows M and N) by the engagement between the force receiving portion 572*b* of the releasing member 572 and the engaging portion 545*h* of the bearing member 545 (FIG. 57), as described above.

Therefore, the releasing member 572 moves outwardly of the cartridge P (outward in the longitudinal direction of the developing roller) by the force received by the force receiving portion 572*a* from the engaging portion 524*s* of the driving side cartridge cover member 524. When the releasing member 572 moves, the force receiving portion 572*b* slides on the engaging portion 524*s* of the driving side cartridge cover member 524.

Thus, the releasing member 572 rotates in the direction of the arrow K (part (c) of FIG. 7) relative to the driving side cartridge cover member 524 and slides by the movement distance p in the direction of the arrow M. By this, in interrelation with the movement of the releasing member 572 in the direction of the arrow M, the shaft portion 572*x* of the releasing member 572 is overlapped with the drive inputting portion 574*b* of the drive input member 574 in the rotation axis X direction. The free end portion of the shaft portion 572*x* of the releasing member 572 slides the developing device drive output member 62 in the direction of the arrow M by the movement distance p.

In summary, the urging force provided by the main assembly 2 is transmitted to the bearing member 545 (urging force receiving portion 545*a*) of the cartridge P through the spacing force urging member 80. By this, the developing unit 9 (developing device frame) rotates by θ2 (part (c) of FIG. 7). Therefore, the releasing member 572 also rotates relative to the driving side cartridge cover member 524 by the angle θ2.

At this time, the force receiving portion 572*b* of the releasing member 572 receives the force by the engagement (contact) to the engaging portion 524*s* of the development side-cover member 524. As a result, the releasing member 572 slides along the rotation axis X to the outside position.

The driving side cartridge cover member 524 which is a part of the photosensitive member frame functions as a rotatable member rotatable relative to the releasing member 572 and an operating member for moving the releasing member 572 relative to the drive inputting portion 74*b* by acting on the releasing member 572. The driving side cartridge cover member 524 rotates relative to the releasing member 572 to move releasing member 572 in the direction of the arrow M (outward of the cartridge P in the longitudinal direction of the developing roller 6).

The engaging portion 524*s* of the driving side cartridge cover member 524 functions as a rotatable member side urging portion (photosensitive member frame side urging portion, operating member urging portion) for applying the force to the force receiving portion 572*b* of the releasing member 572.

With the rotation of the driving side cartridge cover member 524 relative to the releasing member 572, the engaging portion 524*s* applies the outward force (outward with respect to the longitudinal direction of the developing roller 6) to the force receiving portion 572*b*. The force receiving portion 572*b* of the releasing member 572 is a releasing member side force receiving portion (outward force receiving portion) for receiving the outward force for urging the drive output member 62.

As a result, the releasing member 572 is moved to the outside position, and urges the developing device drive output member 62 at the free end portion (urging portion) of the shaft portion 572*x* (FIG. 57).

The releasing member 572 move the developing device drive output member 62 in the direction of the arrow M to retract it to the first position (part (b) of FIG. 56, FIG. 61).

At this time, as shown in FIGS. 60 and 61, the movement distance p of the developing device drive output member 62 is larger than the engagement amount q between the drive input member 574 and the developing device drive output member 62, and therefore, the engagement between the drive input member 574 and the developing device drive output member 62 is broken. Although the developing device drive output member 62 of the main assembly 2 continues to rotate, the drive input member 574 stops. As a result, the rotation of the developing roller gear 69 and therefore the rotation of the developing roller 6 stop.

The releasing member 572 and the rotational force receiving portion (rotational force receiving portion **74*b*4, FIG. 17) of the drive inputting portion 574*b* are projected onto a phantom line parallel with the rotational axis of the developing roller 6 when the releasing member 572 is in the outside position. Then, an area of the releasing member 572 and an area of the rotational force receiving portion 74*b*4 at least partly overlap with each other. In this embodiment, the area of the drive inputting portion 574*b* is within the area of the releasing member 572**.

The movement distance p through which the developing device drive output member 62 moves from the second position to the first position by the sliding of the releasing member 572 is preferably larger than the engagement amount q between the drive input member 574 and the developing device drive output member 62.

Therefore, the urging portion (free end portion of the releasing member 572) of the releasing member 572 is outside of the free end portion of the drive inputting portion **574*b* in the longitudinal direction of the developing roller in the state that the releasing member 572 is in the outside position (FIG. 61). That is, the releasing member 572 projects outwardly in the longitudinal direction of the developing roller 6 beyond the drive inputting portion 574*b***.

However, the free end of the releasing member 572 and the free end of the drive inputting portion **574*b* may be substantially in the same planer with respect to the longitudinal direction. It will suffice if the free end of the releasing member 572 is inside the free end of the drive inputting portion 574*b*, as long as the rotational force receiving portion (rotational force receiving portion 47*b*4, FIG. 17) of the drive inputting portion 574*b* does not receive the rotational driving force from the developing device drive output member 62**.

In the foregoing, the operation of the drive disconnection to the developing roller 6 in interrelation with the rotation of the developing unit 9 in the direction of the arrow K has been described. By employing such a structure, the developing roller 6 can be spaced from the drum 4 while rotating. As a result, the drive transmission to the developing roller 6 can be stopped depending on the spacing distance between the developing roller 6 and the drum 4.

[Drive Connecting Operation].

The description will be made as to the operation of the drive connecting portion when the state changes from the state in which the developing roller 6 is spaced from the drum 4 to the state in which the are contacted with each other. This operation is opposite from the operation from the contact state to the spaced-developing-device-state described in the foregoing.

In the spaced-developing-device-state (the developing unit 9 is in the angle θ2 position, as shown in part (c) of FIG. 7), the drive connecting portion is in the state that the drive input member 574 and the developing device drive output member 62 are disconnected from each other, as shown in FIG. 61. That is, the developing device drive output member 62 is in the first position.

When the spacing force receiving member 145 is retracted gradually from the urging force receiving portion **45*a* in the direction of an arrow F2, the developing unit 9 is rotated by the force of an urging spring 95 (FIG. 4) in the direction of an arrow H shown in FIG. 7 (reverse rotation as compared with the K direction described above). The release cam 472 of the developing unit 9 rotates relative to the photosensitive member frame (driving side cartridge cover 524**).

By the rotation of the release cam 572 relative to the driving side cartridge cover member 524, the force receiving portion **572*b* of the release cam 572 separates from the engaging portion 524*s* of the cartridge cover and starts to contact to the engaging portion 524*t***.

As shown in FIG. 58, the engaging portion **524*t* is an inclined surface inclined relative to the rotation axis X, and therefore, the force receiving portion 572*b* receives a reaction force comprising a component in the direction of the arrow N, by the contact with the engaging portion 524*t*. Therefore, with the rotation, the release cam 572 is moved in the direction of the arrow N while the force receiving portion 472*b* is sliding on the engaging portion 424*t*, by the force received from the engaging portion 524*t***.

In the state that the developing unit 9 is rotated by the angle θ1 (part (b) of FIG. 7, Figure), the releasing member 572 is moved to the inside position by the reaction force received by the force receiving portion **572*b* from the engaging portion 524*t* of the driving side cartridge cover member 524. The force receiving portion 572*b*** functions as an inward force receiving portion (second releasing member side force receiving portion) for receiving the force directed inward of the cartridge P.

In this embodiment, the force receiving portion **572*b*** functions as both of the force receiving portion (first releasing member side force receiving portion) for receiving the outward force and the force receiving portion (second releasing member side force receiving portion) for receiving the inward force.

With the movement of the releasing member 572 to the inside position to separate from the developing device drive output member 62, the developing device drive output member 62 is moved to the second position by being urged by a spring (unshown) of the main assembly 2 in the direction of the arrow N. Then, the drive input member 574 is engaged with the developing device drive output member 62, as shown in FIG. 60.

By this, the driving force is transmitted from the main assembly 2 to the developing roller 6, thus rotating the developing roller 6. At this time, the developing roller 6 and the drum 4 are kept spaced from each other.

From this state, the developing unit 9 is rotated gradually in the direction of the arrow H in FIG. 7, by which the developing roller 6 can be contacted to the drum 4 (part (a) of FIG. 7). Also in this state, the developing device drive output member 62 is in the second position.

In the foregoing, the drive transmission operation to the developing roller 6 in interrelation with the rotation of the developing unit 9 in the direction of the arrow H has been described With this structure described above, the developing roller 6 is brought into contact to the drum 4 while rotating, and the driving force can be transmitted to the developing roller 6 depending on the spacing distance between the developing roller 6 and the drum 4.

The engaging portion **424*t* (FIGS. 58, 56, 61) of the driving side cartridge cover member 524 functions as a second rotatable member side urging portion (second photosensitive member frame side urging portion, second operating member side urging portion) for applying the force to the force receiving portion 572***b* of the releasing member 572. By the rotation of the driving side cartridge cover member 524 relative to the releasing member 572, the engaging portion 524*t* urges the force receiving portion 572*b* to move the releasing member 572 to the inside position.

As described in the foregoing, with the above-described structure, the switching between the drive disconnection and the drive transmission to the developing roller 6 can be definitely determined on the basis of the angle of rotation of the developing unit 9.

According to this embodiment, the decoupling member can be moved without using an elastic member.

In this embodiment, the releasing member 572 as the decoupling member penetrates the drive input member 562. In this manner, in the structure in which the releasing member 572 is provided inside the drive input member 562, the releasing member 572 is said to be disposed adjacent to the drive input member 562.

Embodiment 7

Referring to FIG. 62, Embodiment 7 will be described. In the process cartridge P of the embodiment, the release lever 73 in Embodiment 1 is replaced with a release lever 973.

In Embodiment 1, by the force receiving portion 73*b* of the release lever 73 engaging with the driving side cartridge cover member 24, the release lever 73 rotates relative to the release cam 72 when the developing unit 9 rotates.

In this embodiment, a force receiving portion 973*b* of the release lever 973 directly engages with the spacing force urging member 80 (FIG. 7) to directly move the spacing force urging member 80. Force receiving portion 973*b* functions as an urging force receiving portion for receiving the urging force from an outside (main assembly 2) of the cartridge.

When the spacing force urging member 80 move in the direction indicated by a arrow F2, the release lever 973 moves in the direction of the arrow F2 to rotate relative to the release cam 72. By this, the release lever moves the release cam 72 in the direction of the arrow M to move the release cam 72 to the outside position.

On the other hand, when the spacing force urging member 80 moves in the direction of the arrow F1, the release lever 973 moves in the direction of the arrow F1 to rotate relative to the release cam 72. By this, the release cam 72 moves in the direction of the arrow N to the inside position using the force of the spring 70.

In this embodiment, the spacing force urging member 80 (FIG. 7) engages with the release lever 973 and does not engage with the developing device frame (bearing member 45). Therefore, the entirety of the developing unit 9 does not all rotate. More particularly, the developing roller 6 does not space from the photosensitive drum 4. With the structure of this embodiment, under such a condition, the release lever 72 can be moved to couple or decouple between the drive inputting portion 74*b* of the drive input member 74 and the recess 62*b* of the developing device drive output member 62.

The release lever 173 in Embodiment 2 may be replaced with the release lever 973 of this embodiment.

Embodiment 8

Referring to FIG. 63, Embodiment 8 will be described. FIG. 63 is a perspective view of a developing cartridge according to this embodiment. In the description of this embodiment, the same reference numerals as in Embodiment 1 are assigned to the elements having the corresponding functions in this embodiment, and the detailed description thereof is omitted for simplicity.

In Embodiment 1, the process cartridge P comprising the drum unit 8 and the developing unit 9 is detachably mountable to the main assembly 2 of the image forming apparatus 1 (FIGS. 3 and 9).

In this embodiment, the developing unit 9 per se constitutes a cartridge (developing cartridge) D which is to be detachably mountable to the main assembly 2.

On the other hand, the drum unit 8 (FIG. 4) is fixed in the main assembly 2 (cartridge tray 60, FIG. 3, for example). Or, the drum unit 8 may be another cartridge (photosensitive member cartridge) which is mounted to the main assembly 2 by being supported by the cartridge tray 60.

By mounting the developing cartridge D on the cartridge tray 60, a force receiving portion 73*b* provided on the release cam 73 is engaged with the drum unit 9.

The developing unit 9 of Embodiments 2-8 may be a developing cartridge D as in this embodiment.

While the invention has been described with reference to the structures disclosed herein, it is not confined to the details set forth, and this application is intended to cover such modification or changes as may come within the purposes of the improvements or the scope of the following claims.

INDUSTRIAL APPLICABILITY

According to the present invention, the cartridge, the process cartridge and the image forming apparatus in which the switching of the drive for the developing roller can be effected between the cartridge and the main assembly of the image forming apparatus can be provided.

The invention claimed is:

1. A process cartridge comprising:

(i) a photosensitive drum;

(ii) a developing roller configured to develop a latent image formed on the photosensitive drum;

(iii) a casing having a first end and a second end opposite to the first end with respect to an axial direction of the developing roller, the casing rotatably supporting the photosensitive drum and the developing roller;

(iv) a coupling operatively connected to the developing roller and including a projection, the coupling being disposed adjacent to the first end of the casing;

(v) a lever movable relative to the casing; and (vi) a pushing member disposed adjacent to the first end of the casing, the pushing member being movable relative to the coupling between a first position and a second position with movement of the lever, wherein a tip of the pushing member is disposed farther from the second end of the casing when the pushing member is in the first position than when the pushing member is in the second position with respect to the axial direction of the developing roller, wherein, when the pushing member is in the first position, (a) the tip of the pushing member is exposed from the casing, and (b) a distance from the second end of the casing to the tip of the pushing member measured along the axial direction of the developing roller is equal to or longer than a distance from the second end of the casing to a tip of the projection of the coupling measured along the axial direction, and wherein, when the pushing member is in the second position, the distance from the second end of the casing to the tip of the pushing member measured along the axial direction is shorter than the distance from the second end of the casing to the tip of the projection of the coupling measured along the axial direction.

2. A process cartridge according to claim 1, wherein the coupling is configured to transmit a rotational force from the projection toward the developing roller.

3. A process cartridge according to claim 1, wherein the pushing member is movable in the axial direction of the developing roller.

4. A process cartridge according to claim 1, wherein the pushing member is disposed adjacent to the coupling.

5. A process cartridge according to claim 1, wherein the pushing member has a cylindrical shape, and the pushing member is reciprocal in a state that the coupling is inside the pushing member.

6. A process cartridge according to claim 1, wherein the coupling is provided with a through hole, and wherein the pushing member is reciprocal in the through hole of the coupling.

7. A process cartridge comprising:

(i) a photosensitive drum;

(ii) a developing roller configured to develop a latent image formed on the photosensitive drum;

(iii) a casing having a first end and a second end opposite to the first end with respect to an axial direction of the developing roller, the casing rotatably supporting the photosensitive drum and the developing roller;

(iv) a coupling operatively connected to the developing roller and including a projection, the coupling being disposed adjacent to the first end of the casing;

(v) an urging force receiving portion movable by receiving an urging force; and (vi) a pushing member disposed adjacent to the first end of the casing, the pushing member being movable relative to the coupling between a first position and a second position with movement of the urging force receiving portion, wherein a tip of the pushing member is disposed farther from the second end of the casing when the pushing member is in the first position than when the pushing member is in the second position with respect to the axial direction of the developing roller, wherein, when the pushing member is in the first position, (a) the tip of the pushing member is exposed from the casing, and (b) a distance from the second end of the casing to the tip of the pushing member measured along the axial direction of the developing roller is equal to or longer than a distance from the second end of the casing to a tip of the projection of the coupling measured along the axial direction, and wherein, when the pushing member is in the second position, the distance from the second end of the casing to the tip of the pushing member measured along the axial direction is shorter than the distance from the second end of the casing to the tip of the projection of the coupling measured along the axial direction.

8. A process cartridge according to claim 7, wherein the coupling is configured to transmit a rotational force from the projection toward the developing roller.

9. A process cartridge according to claim 7, wherein the pushing member is movable in the axial direction of the developing roller.

10. A process cartridge according to claim 7, wherein the pushing member is disposed adjacent to the coupling.

11. A process cartridge according to claim 7, wherein the pushing member has a cylindrical shape, and the pushing member is reciprocal in a state that the coupling is inside the pushing member.

12. A process cartridge according to claim 7, wherein the coupling is provided with a through hole, and wherein the pushing member is reciprocal in the through hole of the coupling.

* * * * *